US011132867B2

(12) United States Patent
Wortmann

(10) Patent No.: US 11,132,867 B2
(45) Date of Patent: Sep. 28, 2021

(54) SOFTWARE-BASED SIMULATION OF TRIGGER SYMBOL MOVEMENT

(71) Applicant: Fusion Holdings Limited, Douglas (IM)

(72) Inventor: Jonathan Bruce Wortmann, Ballarat (AU)

(73) Assignee: Fusion Holdings Limited, Douglas (IM)

( * ) Notice: Subject to any disclaimer, the term of this patent is extended or adjusted under 35 U.S.C. 154(b) by 97 days.

(21) Appl. No.: 16/660,535

(22) Filed: Oct. 22, 2019

(65) Prior Publication Data

US 2020/0051396 A1 Feb. 13, 2020

Related U.S. Application Data

(63) Continuation of application No. 15/887,084, filed on Feb. 2, 2018, now Pat. No. 10,522,005.

(30) Foreign Application Priority Data

Feb. 6, 2017 (GB) ..... 1701938

(51) Int. Cl.
*G07F 17/32* (2006.01)

(52) U.S. Cl.
CPC ..... *G07F 17/3267* (2013.01); *G07F 17/3213* (2013.01); *G07F 17/3269* (2013.01); *G07F 17/3288* (2013.01)

(58) Field of Classification Search
None
See application file for complete search history.

(56) References Cited

U.S. PATENT DOCUMENTS 5,704,835 A 1/1998 Dietz, II
6,142,872 A 11/2000 Walker et al.
(Continued)

FOREIGN PATENT DOCUMENTS

AU 2003246319 10/2003
AU 2011253848 1/2014
(Continued)

OTHER PUBLICATIONS

Non-Final Office Action dated Dec. 26, 2018, issued in connection with U.S. Appl. No. 15/392,946, filed Dec. 28, 2016, 13 pages.
(Continued)

*Primary Examiner* — James S. McClellan
*Assistant Examiner* — Peter J Iannuzzi
(74) *Attorney, Agent, or Firm* — MBHB LLP

(57) ABSTRACT

An embodiment may involve a software application executed on behalf of a client machine with a graphical display unit, the software application graphically displaying animations that simulate spinning a plurality of reels. A set of symbols may be selected, including first and second trigger symbols in a third position a fourth position, respectively, adjacent to one another. The embodiment may involve determining a third set of symbols identical to the second set of symbols except that: when the third and fourth positions are vertically adjacent on a particular reel, all symbols on the particular reel are wild, when the third and fourth positions are horizontally adjacent on a pair of adjacent reels, all symbols on the pair of adjacent reels are wild, (iii) when the third and fourth positions are diagonally adjacent to one another, a 2×2 grid of symbols are wild.

20 Claims, 28 Drawing Sheets

(56) References Cited

U.S. PATENT DOCUMENTS 6,146,271 A 11/2000 Kadlic
6,186,894 B1 2/2001 Mayeroff
6,190,255 B1 2/2001 Thomas et al.
6,203,429 B1 3/2001 Demar et al.
6,224,483 B1 5/2001 Mayeroff
6,231,442 B1 5/2001 Mayeroff
6,234,897 B1 5/2001 Frohm et al.
6,251,013 B1 6/2001 Bennett
6,315,560 B1 11/2001 Krouglicof et al.
6,322,309 B1 11/2001 Thomas et al.
6,379,248 B1 4/2002 Jorasch et al.
6,439,993 B1 8/2002 O'Halloran
6,482,089 B2 11/2002 DeMar et al.
6,508,707 B2 1/2003 DeMar et al.
6,520,855 B2 2/2003 DeMar et al.
6,561,904 B2 5/2003 Locke et al.
6,609,971 B2 8/2003 Vancura
6,506,117 B2 10/2003 DeMar et al.
6,645,074 B2 11/2003 Thomas et al.
6,712,697 B2 3/2004 Acres
6,743,102 B1 6/2004 Fiechter et al.
6,852,028 B2 2/2005 Vancura
6,855,054 B2 2/2005 White et al.
6,869,360 B2 3/2005 Marks et al.
6,905,412 B2 6/2005 Thomas et al.
6,939,228 B2 9/2005 Shimizu
7,063,617 B2 6/2006 Brosnan et al.
7,090,580 B2 8/2006 Rodgers et al.
7,172,505 B2 2/2007 Vancura
7,195,560 B2 3/2007 DeMar et al.
7,237,775 B2 7/2007 Thomas et al.
7,258,611 B2 8/2007 Bigelow et al.
7,291,068 B2 11/2007 Bryant et al.
7,316,609 B2 1/2008 Dunn et al.
7,331,862 B2 2/2008 Rodgers et al.
7,331,866 B2 2/2008 Rodgers et al.
7,331,867 B2 2/2008 Baelocher et al.
7,341,518 B2 3/2008 Muskin
7,381,134 B2 6/2008 Cuddy et al.
7,390,260 B2 6/2008 Englman
7,393,278 B2 7/2008 Gerson et al.
7,419,429 B2 9/2008 Taylor
7,452,271 B2 11/2008 DeMar et al.
7,520,809 B2 4/2009 Thomas et al.
7,553,231 B2 6/2009 Rodgers et al.
7,584,505 B2 9/2009 Mondri
7,618,319 B2 11/2009 Casey et al.
7,736,222 B2 6/2010 Casey et al.
7,801,040 B1 9/2010 Singh et al.
7,819,737 B2 10/2010 Englman et al.
7,850,521 B2 12/2010 Rodgers et al.
7,857,695 B2 12/2010 Rodgers et al.
7,901,283 B2 3/2011 Thomas et al.
7,922,579 B2 4/2011 Walker et al.
7,950,994 B2 5/2011 Berman et al.
8,029,358 B2 10/2011 Bigelow et al.
8,030,078 B2 10/2011 Robichaud
RE43,297 E 4/2012 Taylor
8,157,634 B2 4/2012 Englman et al.
8,177,630 B2 5/2012 Bryant
8,235,790 B2 8/2012 Yoshizawa
8,360,840 B2 1/2013 Bennett
8,382,576 B2 2/2013 Nakamura
8,430,743 B2 4/2013 Moshal
8,444,467 B2 5/2013 Englman et al.
8,449,382 B2 5/2013 Bryant
8,449,383 B2 5/2013 Bryant
8,460,094 B2 6/2013 Bigelow et al.
8,480,480 B2 7/2013 Thomas et al.
8,529,332 B2 9/2013 Bennett et al.
8,535,143 B2 9/2013 Hornik et al.
8,540,565 B2 9/2013 Burghard et al.
8,585,484 B2 11/2013 Louie
8,591,312 B2 11/2013 Roukis et al.
8,591,316 B2 11/2013 Bryant
8,602,867 B2 12/2013 Owen et al.
8,616,950 B2 12/2013 Robichaud
8,632,393 B2 1/2014 Bryant
8,636,584 B2 1/2014 Bryant
8,641,517 B2 2/2014 Bryant
8,647,194 B2 2/2014 Bigelow et al.
8,651,940 B2 2/2014 Loat et al.
8,702,489 B2 4/2014 Cuddy et al.
8,721,423 B2 5/2014 Saito
8,734,222 B2 5/2014 Owen et al.
8,734,237 B2 5/2014 Moshal
8,747,207 B2 6/2014 Thomas et al.
8,834,249 B2 9/2014 Bryant
8,864,568 B2 10/2014 Mizue
8,864,570 B2 10/2014 Jackson
8,876,589 B2 11/2014 Strom
8,974,288 B2 3/2015 Welty et al.
9,092,938 B2 7/2015 Robichaud
9,098,976 B2 8/2015 Zimmermann
9,129,480 B2 9/2015 Nakamura
9,135,781 B2 9/2015 Nakamura
9,135,782 B2 9/2015 Nakamura
9,165,436 B2 10/2015 Welty et al.
9,208,657 B2 12/2015 Fujisawa et al.
9,214,071 B2 12/2015 Hornik et al.
9,224,270 B2 12/2015 Lee et al.
9,230,411 B2 1/2016 Englman et al.
9,336,658 B2 5/2016 Suda
9,336,659 B2 5/2016 Beria
9,361,756 B2 6/2016 Bryant et al.
9,412,239 B2 8/2016 Gugler
9,424,720 B2 8/2016 Suda
9,564,001 B2 2/2017 Owen et al.
9,659,456 B2 5/2017 Van Linden
9,685,035 B2 6/2017 Schattauer et al.
9,697,694 B2 7/2017 Beria
9,792,776 B2 10/2017 Bigelow et al.
9,830,780 B2 11/2017 Cuddy et al.
9,852,588 B2 12/2017 Roukis et al.
9,911,280 B2 3/2018 Beria
9,934,646 B2 4/2018 Igesund
9,940,784 B2 4/2018 Schattauer et al.
9,959,703 B2 5/2018 Igesund
9,997,012 B2 6/2018 Wortmann et al.
10,043,348 B2 8/2018 Meyer
10,068,432 B2 9/2018 Wortmann
10,068,435 B2 9/2018 Gugler
10,078,942 B2 9/2018 Suda
10,147,264 B1 12/2018 Halvorson
10,169,956 B2 1/2019 Beria
2001/0009865 A1 7/2001 DeMar
2001/0031659 A1 10/2001 Perrie et al.
2002/0025847 A1 2/2002 Thomas et al.
2002/0039920 A1 4/2002 Bryant
2002/0043759 A1 4/2002 Vancura
2002/0045474 A1 4/2002 Singer et al.
2002/0068623 A1 6/2002 Gauselmann
2002/0132659 A1 9/2002 DeMar et al.
2002/0137560 A1 9/2002 DeMar et al.
2002/0142823 A1 10/2002 DeMar et al.
2002/0151359 A1 10/2002 Rowe
2002/0137561 A1 11/2002 DeMar et al.
2003/0060259 A1 3/2003 Mierau et al.
2003/0064810 A1 4/2003 Okada
2003/0073483 A1 4/2003 Glavich et al.
2003/0155715 A1 8/2003 Walker et al.
2003/0162585 A1 8/2003 Bigelow et al.
2003/0162588 A1 8/2003 Brosnan et al.
2003/0181238 A1 9/2003 DeMar et al.
2003/0190943 A1 10/2003 Walker et al.
2003/0199307 A1 10/2003 DeMar et al.
2003/0199309 A1 10/2003 DeMar et al.
2004/0032086 A1 2/2004 Barragan
2004/0048646 A1 3/2004 Visocnik
2004/0072607 A1 4/2004 Thomas et al.
2004/0097280 A1 5/2004 Gauselmann
2004/0162134 A1 8/2004 Walker et al.
2004/0185930 A1 9/2004 Thomas et al.
2004/0219968 A1 11/2004 Fiden et al.

(56) References Cited

U.S. PATENT DOCUMENTS

2004/0242312 A1 12/2004 Gomez
2004/0254011 A1 12/2004 Muskin
2004/0259640 A1 12/2004 Gentles et al.
2005/0010715 A1 1/2005 Davies et al.
2005/0043082 A1 2/2005 Peterson et al.
2005/0054420 A1 3/2005 Cregan et al.
2005/0130731 A1 6/2005 Englman
2005/0130737 A1 6/2005 Englman
2005/0153770 A1 7/2005 Vancura
2005/0153778 A1 7/2005 Nelson et al.
2005/0170883 A1 8/2005 Muskin
2005/0181867 A1 8/2005 Thomas et al.
2005/0239545 A1 10/2005 Rowe
2006/0005239 A1 1/2006 Mondri
2006/0030396 A1 2/2006 Marks et al.
2006/0084494 A1 4/2006 Belger et al.
2006/0264254 A1 11/2006 Aoki
2006/0281525 A1 12/2006 Borissov
2007/0026933 A1 2/2007 Tanimura
2007/0054732 A1 3/2007 Baerlocher
2007/0060254 A1 3/2007 Muir
2007/0060303 A1 3/2007 Govender et al.
2007/0060314 A1 3/2007 Baerlocher et al.
2007/0060317 A1 3/2007 Martin
2007/0123340 A1 5/2007 Vancura
2007/0167226 A1 7/2007 Kelly et al.
2007/0265062 A1 11/2007 Thomas et al.
2007/0287529 A1 12/2007 Kojima
2008/0039171 A1 2/2008 Slomiany et al.
2008/0070673 A1 3/2008 Bennett et al.
2008/0076574 A1 3/2008 Okada
2008/0113742 A1 5/2008 Amos et al.
2008/0108411 A1 8/2008 Jensen et al.
2008/0254875 A1 10/2008 Fujimoto et al.
2008/0287178 A1 11/2008 Berman et al.
2009/0042652 A1 2/2009 Baerlocher et al.
2009/0054129 A1 2/2009 Yoshimura et al.
2009/0069071 A1 3/2009 Aoki
2009/0104979 A1 4/2009 Ruymann
2009/0117979 A1 5/2009 Decasa et al.
2009/0131145 A1 5/2009 Aoki et al.
2009/0156303 A1 6/2009 Kiely et al.
2009/0227340 A1 9/2009 Yoshizawa
2009/0227356 A1 9/2009 Moroney
2009/0305769 A1 12/2009 Plowman
2009/0305770 A1 12/2009 Bennett et al.
2010/0004048 A1 1/2010 Brito
2010/0004050 A1 1/2010 Caputo
2010/0022297 A1 1/2010 Saunders
2010/0029381 A1 2/2010 Vancura
2010/0056249 A1 3/2010 Yamauchi
2010/0120507 A1* 5/2010 Rodgers ..... G07F 17/3262 463/20
2010/0120525 A1 5/2010 Baerlocher et al.
2010/0178976 A1* 7/2010 Berman ..... G07F 17/34 463/20
2010/0197377 A1 8/2010 Aoki et al.
2010/0323780 A1 12/2010 Acres
2011/0003630 A1 1/2011 Rasmussen et al.
2011/0028202 A1 2/2011 Naicker et al.
2011/0065492 A1 3/2011 Acres
2011/0098101 A1 4/2011 Gomez et al.
2011/0117987 A1 5/2011 Aoki et al.
2011/0118001 A1 5/2011 Vann
2011/0124394 A1 7/2011 Thomas et al.
2012/0015713 A1 1/2012 Cannon
2012/0122546 A1 5/2012 Lange
2012/0122547 A1 5/2012 Aoki et al.
2012/0244928 A1 9/2012 Visser
2012/0258787 A1 10/2012 Bennett
2012/0276980 A1 11/2012 Moroney
2012/0295688 A1 11/2012 Watkins et al.
2013/0023329 A1 1/2013 Saunders
2013/0065662 A1 3/2013 Watkins et al.
2013/0143635 A1 6/2013 Arora
2013/0157733 A1 6/2013 Thorne et al.
2013/0184047 A1 7/2013 Haykin et al.
2013/0281191 A1 10/2013 Thomas et al.
2013/0288793 A1 10/2013 Fujisawa et al.
2013/0344939 A1 12/2013 Aokie et al.
2014/0066169 A1 3/2014 Watkins et al.
2014/0135096 A1 5/2014 Aida et al.
2014/0179400 A1 6/2014 Lee
2014/0228091 A1 8/2014 Berman et al.
2014/0274292 A1 9/2014 Suda
2014/0295939 A1 10/2014 Thomas et al.
2014/0323198 A1 10/2014 Tuck
2014/0339767 A1 11/2014 Hirato
2015/0018069 A1 1/2015 Montenegro et al.
2015/0057068 A1 2/2015 Burghard
2015/0248810 A1 9/2015 Wortmann et al.
2015/0248811 A1 9/2015 Wortmann et al.
2015/0287276 A1 10/2015 Humphrey et al.
2015/0302704 A1 10/2015 Montenegro et al.
2015/0363999 A1 12/2015 Little
2016/0104345 A1 4/2016 MacGregor et al.
2016/0180637 A1 6/2016 Honeycutt et al.
2016/0328910 A1 11/2016 Shaik
2016/0351005 A1 12/2016 Igesund
2016/0351006 A1 12/2016 Igesund
2017/0069160 A1 3/2017 Bennett
2017/0162003 A9 6/2017 Burghard
2017/0213416 A1 7/2017 Wortmann
2017/0316648 A1 11/2017 Wortmann
2017/0316649 A1 11/2017 Wortmann
2017/0316651 A1 11/2017 Wortmann et al.
2018/0122182 A1 5/2018 Wortmann
2018/0122183 A1 5/2018 Wortmann
2018/0122184 A1 5/2018 Wortmann
2018/0122189 A1 5/2018 Wortmann
2018/0130308 A1* 5/2018 Berman ..... G07F 17/3269
2018/0225926 A1 8/2018 Wortmann
2018/0286174 A1 10/2018 Merkel et al.
2018/0286175 A1 10/2018 Kuhlmann et al.
2018/0374296 A1 12/2018 Bennett
2019/0019370 A1 1/2019 Ono

FOREIGN PATENT DOCUMENTS

AU 2013251288 5/2014
AU 2017200271 1/2016
CA 2827968 3/2014
CA 2868773 4/2015
EP 1351180 10/2003
EP 2615591 3/2013
EP 2713347 4/2014
EP 2866211 4/2015
EP 2894612 7/2015
EP 2916299 9/2015
GB 2139390 11/1984
WO 2002/41963 5/2002
WO 2006/027677 3/2006
ZA 201400816 10/2014

OTHER PUBLICATIONS

Non-Final Office Action dated Jan. 16, 2019, issued in connection with U.S. Appl. No. 15/487,838, filed Apr. 14, 2017, 12 pages.
Australian Examination Report No. 4 dated Sep. 28, 2018, issued in connection with Australian Patent Application No. 2017200271,5 pages.
Notice of Allowance dated Oct. 29, 2018, issued in connection with U.S. Appl. No. 15/487,022, filed Apr. 13, 2017, 5 pages.
Notice of Allowance dated Jul. 18, 2018, issued in connection with U.S. Appl. No. 15/487,869, filed Apr. 4, 2017, 9 pages.
United Kingdom Intellectual Property Office, Examination Report dated Jul. 30, 2018, issued in connection with Great Britain Patent Application No. 1701938.1,6 pages.
Non-Final Office Action dated Sep. 25, 2018, issued in connection with U.S. Appl. No. 16/056,721, filed Aug. 7, 2018, 10 pages.
Notice of Allowance dated Jan. 8, 2019, issued in connection with U.S. Appl. No. 16/056,721, filed Aug. 7, 2018, 5 pages.

(56) References Cited

OTHER PUBLICATIONS

Notice of Allowance dated Feb. 21, 2019, issued in connection with U.S. Appl. No. 16/056,721, filed Aug. 7, 2018, 7 pages.
Australian Government, IP Australia, Examination Report No. 3 dated Jul. 23, 2018, issued in connection with Australian Patent Application No. 2017101574, 4 pages.
Australian Government, IP Australia, Examination Report No. 4 dated Jan. 15, 2019, issued in connection with Australian Patent Application No. 2017101574, 4 pages.
Australian Government, IP Australia, Examination Report No. 2 dated Aug. 9, 2018, issued in connection with Australian Patent Application No. 2017235913, 4 pages.
Australian Government, IP Australia, Examination Report No. 3 dated Sep. 28, 2018, issued in connection with Australian Patent Application No. 2017235921, 3 pages.
Australian Government, IP Australia, Examination Report No. 4 dated Jan. 31, 2019, issued in connection with Australian Patent Application No. 2017235921,3 pages.
Australian Government, IP Australia, Examination Report No. 5 dated Mar. 4, 2019 issued in connection with Australian Patent Application No. 2017235921,3 pages.
Australian Government, IP Australia, Examination Report No. 2 dated Aug. 21, 2018, issued in connection with Australian Patent Application No. 2017235939, 4 pages.
Australian Government, IP Australia, Examination Report No. 3 dated Jan. 18, 2019, issued in connection with Australian Patent Application No. 2017235939, 3 pages.
Australian Government, IP Australia, Examination Report No. 4 dated Mar. 6, 2019, issued in connection with Australian Patent Application No. 2017235939, 3 pages.
Australian Government, IP Australia, Examination Report No. 2 dated Jul. 24, 2018, issued in connection with Australian Patent Application No. 2017235945, 4 pages.
Australian Government, IP Australia, Examination Report No. 3 dated Feb. 4, 2019, issued in connection with Australian Patent Application No. 2017235945, 3 pages.
Australian Government, IP Australia, Examination Report No. 4 dated Mar. 5, 2019, issued in connection with Australian Patent Application No. 2017235945, 3 pages.
Canadian Intellectual Property Office, Examiner's Report dated Nov. 1, 2018, issued in connection with Canadian Patent Application No. 2,954,790, 5 pages.
European Patent Office, Office Action dated Aug. 21, 2018, issued in connection with European Patent 17153144.5, 10 pages.
United Kingdom Intellectual Property Office, Combined Search Report dated Sep. 20, 2017, issued in connection with Great Britain Patent Application No. 1607374.4, 7 pages.
Australian Government, IP Australia, Examination Report No. 2 dated Mar. 25, 2019, issued in connection with Australian Patent Application No. 2018200695, 3 pages.
Australian Government, IP Australia, Examination Report No. 1 dated Oct. 12, 2018, issued in connection with Australian Patent Application No. 2018200695, 4 pages.
Australian Government, IP Australia, Examination Report No. 1 dated Mar. 28, 2017, issued in connection with Australian Patent Application No. 2016202966, 2 pages.
Australian Government, IP Australia, Examination Report No. 1 dated Mar. 29, 2017, issued in connection with Australian Patent Application No. 2016202965, 3 pages.
Australian Government, IP Australia, Patent Examination Report No. 1, dated Dec. 20, 2012, Bsued in connection with Australian Patent Application No. 2011253848, 4 pages.
Canadian Intellectual Property Office, Examiner's Repod dated Dec. 7, 2016, issued in connection with CA Application No. 2929222, 3 pages.
Canadian Intellectual Property Office, Office Action dated Mar. 13, 2017, issued in connection with Canadian Patent Application No. 2929218, 6 pages.
Canadian Intellectual Property Office, Examiner's Repod dated Feb. 5, 2013, issued in connection with CA Application No. 2760112, 2 pages.
European Patent Office, European Search Report dated Jul. 27, 2016, issued in connection with EP Application No. 16171834.1, 8 pages.
European Patent Office, European Search Report dated Jun. 28, 2016, issued in connection with EP Application No. 16171832.5, 8 pages.
European Patent Office, Extended European Search Report dated Feb. 24, 2012, issued in connection with EP Application No. 11194636.4, 6 pages.
European Patent Office, Extended European Search Report dated Oct. 26, 2010, issued in connection with EP Application No. 10251152.4, 8 pages.
European Patent Office, Supplementary European Search Report dated Oct. 8, 2008, issued in connection with EP Application No. 05789874.4, 6 pages.
Final Office Action dated Sep. 14, 2012, issued in connection with U.S. Appl. No. 12/511,391, filed Jul. 29, 2009, 14 pages.
Final Office Action dated Jun. 23, 2010, issued in connection with U.S. Appl. No. 10/550,744, filed Aug. 24, 2006, 13 pages.
Final Office Action dated Sep. 28, 2009, issued in connection with U.S. Appl. No. 10/550,744, filed Aug. 24, 2006, 11 pages.
Intellectual Property Office, Combined Search Report and Abbreviated Examination Report dated Nov. 29, 2016, issued in connection with Application No. GB1509339.6, 7 pages.
Intellectual Property Office, Combined Search Report and Abbreviated Examination Report dated Nov. 29, 2016, issued in connection with Application No. GB1509340.4, 7 pages.
International Bureau, International Preliminary Report on Patentability dated Mar. 13, 2007, issued in connection with International Application No. PCT/IB2005/002678, filed on Sep. 9, 2005, 4 pages.
International Searching Authority, International Search Report and Written Opinion dated Jan. 16, 2007, issued in connection with International Application No. PCT/IB2005/002678, filed on Sep. 9, 2005, 4 pages.
Non-Final Office Action dated Apr. 4, 2008, issued in connection with U.S. Appl. No. 10/550,744, filed Aug. 24, 2006, 8 pages.
Non-Final Office Action dated Dec. 10, 2012, issued in connection with U.S. Appl. No. 12/974,690, filed Dec. 21, 2009, 25 pages.
Non-Final Office Action dated Dec. 24, 2009, issued in connection with U.S. Appl. No. 10/550,744, filed Aug. 24, 2006, 12 pages.
Non-Final Office Action dated Mar. 29, 2012, issued in connection with U.S. Appl. No. 12/511,391, filed Jul. 29, 2009, 10 pages.
Non-Final Office Action dated Nov. 29, 2013, issued in connection with U.S. Appl. No. 13/856,124, filed Apr. 3, 2013, 19 pages.
Non-Final Office Action dated Jul. 31, 2013, issued in connection with U.S. Appl. No. 13/856,124, filed Apr. 3, 2013, 19 pages.
Notice of Allowability dated Nov. 26, 2010, issued in connection with U.S. Appl. No. 10/550,744, filed Aug. 24, 2006,4 pages.
Notice of Allowance dated Apr. 10, 2014, issued in connection with U.S. Appl. No. 13/856,124, filed Apr. 3, 2013, 7 pages.
Notice of Allowance dated Mar. 11, 2013, issued in connection with U.S. Appl. No. 12/974,690, filed an Dec. 21, 2010.
Wortmann, Jonathan, U.S. Appl. No. 15/485,984, filed Apr. 12, 2017.
Wortmann, Jonathan, U.S. Appl. No. 15/487,869, filed Apr. 14, 2017.
Wortmann, Jonathan, U.S. Appl. No. 15/487,022, filed Apr. 13, 2017.
Wortmann, Jonathan, U.S. Appl. No. 15/487,838, filed Apr. 14, 2017, 64 pages.
European Patent Office, Extended European Search Report dated Jun. 6, 2017, issued in connection with Application No. EP 17153144.5, 9 pages.
Australian Government, IP Australia, Examination Report No. 2 dated Jul. 14, 2017, issued in connection with Australian Patent Application No. 2016202966, 6 pages.
Australian Government, IP Australia, Examination Report No. 1 dated Oct. 14, 2017, issued in connection with Australian Patent Application No. 2017200271, 4 pages.

(56) References Cited

OTHER PUBLICATIONS

Australian Government, IP Australia, Examination Report No. 2 dated Jun. 26, 2017, issued in connection with Australian Patent Application No. 2016202965, 2 pages.
Australian Government, IP Australia, Examination Report No. 3 dated Oct. 12, 2017, issued in connection with Australian Patent Application No. 2016202965, 3 pages.
Non-Final Office Action dated Oct. 18, 2017, issued in connection with U.S. Appl. No. 15/140,945, filed Apr. 28, 2016, 11 pages.
Wortmann, Jonathan, U.S. Appl. No. 15/795,798, filed Oct. 27, 2017.
Wortmann, Jonathan, U.S. Appl. No. 15/796,122, filed Oct. 27, 2017.
Wortmann, Jonathan, U.S. Appl. No. 15/796,380, filed Oct. 27, 2017.
Canadian Intellectual Property Office, Examiner's Report dated Jan. 16, 2018, issued in connection with Canadian Patent Application No. 2,929,218.
Australian Government, IP Australia, Examination Report No. 3 dated Nov. 21, 2017, issued in connection with Australian Patent Application No. 2016202966.
Notice of Allowance dated Dec. 20, 2017, issued in connection with U.S. Appl. No. 15/141,1010, filed Apr. 28, 2016, 8 pages.
Non-Final Office Action dated Jan. 29, 2018, issued in connection with U.S. Appl. No. 15/487,869, filed Apr. 14, 2017, 12 pages.
Canadian Intellectual Property Office, Examiner's Report dated Dec. 19, 2017, in connection with Canadian Patent Application No. 2,954,790, 3 pages.
United Kingdom Intellectual Property Office, Search Report dated Jun. 28, 2017, issued in connection with Great Brian Patent Application No. 1601306.2, 6 pages.
Canadian Intellectual Property Office, Examiner's Report dated Dec. 19, 2017, issued in connection with Canadian Patent Application No. 2,929,222, 6 pages.
European Patent Office, Office Action dated Aug. 23, 2017, issued in connection with EP Application No. 6171832.5, 7 pages.
Notice of Allowance dated Jan. 16, 2018, issued in connection with U.S. Appl. No. 15/140,945, filed Apr. 28, 2016, 5 pages.
Non-Final Office Action dated Feb. 20, 2018, issued in connection with U.S. Appl. No. 15/485,984, filed Apr. 12, 2017, 11 pages.
Notice of Allowance dated Feb. 13, 2018, issued in connection with U.S. Appl. No. 15/141,010, filed Apr. 28, 2016, 5 pages.
Australian Government, IP Australia, Examination Report No. 1 dated Jan. 30, 2018, issued in connection with Australian Patent Application No. 2017202577, 2 pages.
Australian Government, IP Australia, Examination Report No. 1 dated Jan. 30, 2018, issued in connection with Australian Patent Application No. 2017202579, 2 pages.
Australian Government, IP Australia, Examination Report No. 1 dated Jan. 30, 2018, issued in connection with Australian Patent Application No. 2017202474, 2 pages.
Australian Government, IP Australia, Examination Report No. 1 dated Jan. 30, 2018, issued in connection with Australian Patent Application No. 2017202574, 2 pages.
Australian Government, IP Australia, Examination Report No. 4 dated Feb. 19, 2018, issued in connection with Australian Patent Application No. 2016202965, 3 pages.
United Kingdom Intellectual Property Office, Search Report dated Aug. 16, 2017, issued in connection with Grea Britain Patent Application No. 1607379.3, 6 pages.
United Kingdom Intellectual Property Office, Search Report dated Aug. 11, 2017, issued in connection with Grea Britain Patent Application No. 1607380.1,8 pages.
Australian Government, IP Australia, Notice of Acceptance dated Sep. 25, 2013, issued in connection with Australian Patent Application No. 2011253848, 2 pages.
Australian Government, IP Australia, Examination Report No. 4 dated Mar. 9, 2018, issued in connection with Australian Patent Application No. 2016202966, 3 pages.
Australian Government, IP Australia, Examination Report No. 2 dated Mar. 6, 2018, issued in connection with Australian Patent Application No. 2017200271,3 pages.
Australian Government, IP Australia, Examination Report No. 3 dated Jun. 5, 2018, issued in connection with Australian Patent Application No. 2017200271,3 pages.
Australian Government, IP Australia, Examination Report No. 2 dated May 11, 2018, issued in connection with Australian Patent Application No. 2017202474, 4 pages.
Australian Government, IP Australia, Examination Report No. 2 dated May 14, 2018, issued in connection with Australian Patent Application No. 2017202574, 4 pages.
Australian Government, IP Australia, Examination Report No. 2 dated May 14, 2018, issued in connection with Australian Patent Application No. 2017202577, 3 pages.
Australian Government, IP Australia, Examination Report No. 2 dated May 14, 2018, issued in connection with Australian Patent Application No. 2017202579, 4 pages.
Australian Government, IP Australia, Examination Report No. 1 dated Mar. 20, 2018, issued in connection with Australian Patent Application No. 2017235913, 2 pages.
Australian Government, IP Australia, Examination Report No. 1 dated Mar. 6, 2018, issued in connection with Australian Patent Application No. 2017235921, 2 pages.
Australian Government, IP Australia, Examination Report No. 1 dated Mar. 6, 2018, issued in connection with Australian Patent Application No. 2017235939, 2 pages.
Australian Government, IP Australia, Examination Report No. 1 dated Mar. 6, 2018, issued in connection with Australian Patent Application No. 2017235945, 2 pages.
Canadian Intellectual Property Office, Examiner's Report dated Feb. 6, 2014, issued in connection with Canadian Patent Application No. 2,760, 112, 3 pages.
Canadian Intellectual Property Office, Examiner's Report dated Mar. 18, 2015, issued in connection with Canadian Patent Application No. 2,760, 112, 6 pages.
Canadian Intellectual Property Office, Final Office Action dated Dec. 2, 2016, issued in connection with Canadian Patent Application No. 2,760, 112, 5 pages.
Canadian Intellectual Property Office, Examiner's Report dated May 11, 2018, issued in connection with Canadian Patent Application No. 2,964,233, 5 pages.
Canadian Intellectual Property Office, Examiner's Report dated Mar. 29, 2018, issued in connection with Canadian Patent Application No. 2,964,558, 6 pages.
Canadian Intellectual Property Office, Examiner's Report dated May 11, 2018, issued in connection with Canadian Patent Application No. 2,964,587, 5 pages.
Canadian Intellectual Property Office, Examiner's Report dated Apr. 24, 2018, issued in connection with Canadian Patent Application No. 2,964,739, 5 pages.
European Patent Office, Office Action dated Sep. 10, 2013, issued in connection with EP Application No. 1194636.4, 5 pages.
United Kingdom Intellectual Property Office, Search Report dated Apr. 13, 2018, issued in connection with Great Britain Patent Application No. 1618347.7, 6 pages.
United Kingdom Intellectual Property Office, Search Report dated Apr. 17, 2018, issued in connection with Great Britain Patent Application No. 1618349.3, 7 pages.
United Kingdom Intellectual Property Office, Search Report dated Apr. 17, 2018, issued in connection with Great Britain Patent Application No. 1618352.7, 7 pages.
United Kingdom Intellectual Property Office, Search Report dated Apr. 13, 2018, issued in connection with Great Britain Patent Application No. 1618353.5, 6 pages.
Notice of Allowance dated Mar. 8, 2018, issued in connection with U.S. Appl. No. 15/140,945, filed Apr. 28, 2016, 5 pages.
Notice of Allowance dated Apr. 11, 2018, issued in connection with U.S. Appl. No. 15/485,984, filed Apr. 12, 2017, 7 pages.
Non-Final Office Action dated May 22, 2018, issued in connection with U.S. Appl. No. 15/487,022, filed Apr. 13, 2017, 12 pages.

* cited by examiner

645

645

1400

1400

SOFTWARE-BASED SIMULATION OF TRIGGER SYMBOL MOVEMENT

CROSS-REFERENCE TO RELATED APPLICATIONS

This application claims priority to U.S. patent application Ser. No. 15/887,084, filed Feb. 2, 2018, which is hereby incorporated by reference in its entirety.

U.S. patent application Ser. No. 15/887,084 claims priority to U.K. patent application no. 1701938.1, filed Feb. 6, 2017, which is hereby also incorporated by reference in its entirety.

BACKGROUND

Wager games come in a variety of forms, including for example a mechanical slot machine. A mechanical slot machine may include one or more reels, each of which includes a fixed pattern of symbols distributed around the circumference of the reel. When a player places a wager (e.g., by placing a coin in the machine), the player is allowed to spin the reels. Each reel then comes to rest, typically with either one of the symbols, or a space in between symbols, in alignment with a pay line. A predefined winning symbol or a predefined combination of winning symbols that are aligned with the pay line can result in the player winning the game and receiving a payout. In one example, the machine may include three reels, and the pay line may be a horizontal line disposed across a centre of each of the three reels.

In another example of a wager game, a mechanical slot machine may present symbols in a matrix arrangement, with each symbol changing during a spin of the game according to the fixed pattern of symbols on the reels. For example, the machine may have five columns and three rows of symbols, for a total of fifteen symbols. Such machines often have multiple pay lines, each being defined by a collection of positions within the matrix. For instance, the machine may have three pay lines, each corresponding to one row of the matrix.

SUMMARY

While slot machines were traditionally mechanical, modern slot machines often take the form of a video gaming machine (e.g., a dedicated gaming machine located in a casino) that includes a graphical user interface (GUI), and that may emulate a mechanical slot machine. With a video gaming machine, the GUI may display an image of one or more reels or a matrix as described above, together with animation effects to simulate a spin of the one or more reels, or a spin of the columns or rows of the matrix. A computer software program, which may reside in the video gaming machine, may randomly select one or more symbols in response to a spin, and may display the selected one or more symbols on the display.

A modern slot machine may also be played over a computer network, such as by a player using a client machine that is connected to a server machine by the computer network. In this instance, the server machine may perform the spins of the game and may send data representing the resulting symbols to the client machine, thereby instructing the client machine to display the symbols.

The popularity of video slot games has increased due to the incorporation of novel features, such as a "WILD" symbol, into such games. A WILD symbol, which is usually the highest-ranking symbol of the game, offers line payouts, just like any other symbol and, additionally, substitutes for any other symbol in the game, thereby assisting in making winning results and providing a player with entertainment and additional opportunities to win games.

The embodiments described herein overcome limitations of past technology by increasing the number and variety of possible outcomes in a random selection of data entries based on a reel-based game of luck. Existing arrangements could only address this problem by changing the reels and/or increasing the number of symbols on the reels. The present solution includes a transformation of data entries selected in a computer-implemented draw, wherein some of the selected data entries can be transformed, without carrying out another draw, to take a different value than originally selected depending on the number and relative positional arrangement of other data entries in the same draw. By creating a cross-dependency between the data entries for each of the reels in a draw (e.g., by checking whether two or more trigger symbols are adjacent to one another) where symbols are transformed or changed depending on the positional arrangement of two or more trigger symbols, the present solution can increase the number of possible outcomes with the same number of entries in a reel.

Viewed from a first aspect, the disclosure provides a computer-implemented method for symbol replacement in a reel-based game. The reel-based game is executed on behalf of a client machine. The reel-based game involves spinning reels to determine outcome events. A first set of symbols associated with respective positions of each of the reels is selected as a first outcome event of the reel-based game. The first set of symbols includes a first trigger symbol in a first position and a second trigger symbol in a second position. A second set of symbols associated with respective positions of each of the reels is selected as a second outcome event of the reel-based game. The second set of symbols includes the first trigger symbol in a third position and the second trigger symbol in a fourth position. The third position is different from the first position, the fourth position is different from the second position, and the third position and fourth position are adjacent to one another. A representation of the second set of symbols is transmitted to the client machine. Reception of the representation of the second set of symbols causes the client machine to display a spin of the reels resulting in the second set of symbols. Based on the third position and fourth position being adjacent to one another, at least one symbol adjacent to the first trigger symbol or the second trigger symbol is transformed into a WILD symbol. The transformation occurs without further spinning of the reels. A representation of the second set of symbols as transformed is transmitted to the client machine. Reception of the representation of the second set of symbols as transformed causes the client machine to display the transformation of the at least the one symbol adjacent to the first trigger symbol or the second trigger symbol into the WILD symbol.

Viewed from a second aspect, the disclosure provides an article of manufacture including a non-transitory computer-readable medium, having stored thereon program instructions that, upon execution by a gaming machine, cause the gaming machine to perform the operations of the first aspect.

Viewed from a third aspect, the disclosure provides a gaming machine configured to perform the operations of the first aspect.

Viewed from a fourth aspect, the disclosure provides a system comprising means for performing the operations of the first aspect.

Viewed from a fifth aspect, the disclosure provides a gaming system that comprises a plurality of gaming devices each including at least one display device and a plurality of input devices including: (i) an acceptor of a physical item associated with a monetary value, (ii) a validator configured to identify the physical item, and (iii) a cash-out button actuatable to cause an initiation of a payout associated with a credit account; one or more gaming device processors; and one or more gaming device memory devices storing (i) respective pluralities of symbols for the reels and (ii) a plurality of gaming device instructions. The gaming device instructions are executable by the one or more gaming device processors to perform the operations of the first aspect.

In embodiments of the disclosure in which a computer software product is used, the product may be non-transitory and store instructions on physical media such as a DVD, or a solid state drive, or a hard drive. Alternatively, the product may be transitory and in the form of instructions provided over a connection such as a network connection which is linked to a network such as the Internet.

These aspects, as well as other embodiments, aspects, advantages, and alternatives will become apparent to those of ordinary skill in the art by reading the following detailed description, with reference where appropriate to the accompanying drawings. Further, this summary and other descriptions and figures provided herein are intended to illustrate embodiments by way of example only and, as such, that numerous variations are possible. For instance, structural elements and process steps can be rearranged, combined, distributed, eliminated, or otherwise changed, while remaining within the scope of the embodiments as claimed.

DETAILED DESCRIPTION

I. Introduction

This description describes several example embodiments including, but not limited to, example embodiments pertaining to performing aspects of an outcome event using a machine. Performing the outcome event can include playing a game. The machine can display a variety of symbols during performance of an outcome event. A symbol displayed within a symbol-display-portion of a display during an outcome event may be replaced by or transformed into another symbol. The replacement symbols can be used to determine a payout amount for an outcome event in which a wager is won.

Throughout this description, the articles "a" or "an" are used to introduce elements of the example embodiments. Any reference to "a" or "an" refers to "at least one," and any reference to "the" refers to "the at least one," unless otherwise specified, or unless the context clearly dictates otherwise. The intent of using the conjunction "or" within a described list of at least two terms is to indicate any of the listed terms or any combination of the listed terms.

The use of ordinal numbers such as "first," "second," "third" and so on is to distinguish respective elements rather than to denote a particular order of those elements. For purpose of this description, the terms "multiple" and "a plurality of" refer to "two or more" or "more than one."

Further, unless context suggests otherwise, the features illustrated in each of the figures may be used in combination with one another. Thus, the figures should be generally viewed as component aspects of one or more overall embodiments, with the understanding that not all illustrated features are necessary for each embodiment.

Disclosed herein are machines, systems, and methods for carrying out aspects of outcome events that include displaying symbols. These aspects may be incorporated into games, in particular, wager games. In one aspect, the machines, systems, and methods provide a feature that may enhance traditional wager games (e.g., slot machines or other reel-type games) by providing a player with additional opportunities to win the game, thereby increasing the player's interest, anticipation, and excitement in connection with the game. This may in turn benefit a casino or another entity that provides a game with this feature. Indeed, wager games are typically configured to have odds that favour the casino (sometimes referred to as the "house"). Accordingly, based on the law of averages, casinos often increase their profits simply by getting more players to play more games. Due to the provided features, players may be drawn in (e.g., from competing casinos that lack games with such a feature) and they may play the game often. The feature can include new data communications between a server machine and a client machine within a server-client based configuration.

II. Example Architecture

Figure 1:
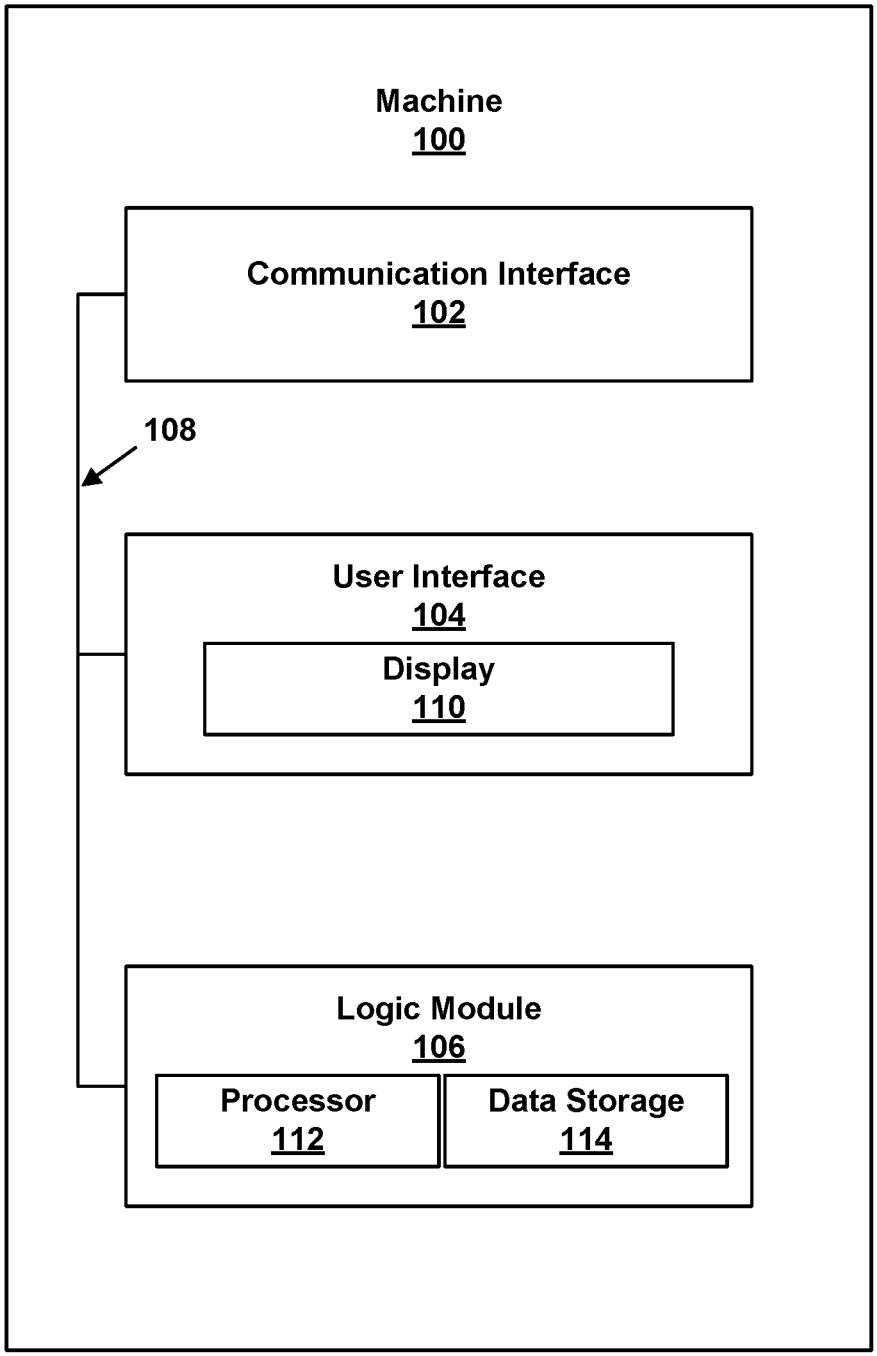
FIG. 1 is a simplified block diagram of a machine, in accordance with example embodiments.

FIG. 1 shows a simplified block diagram of an example machine 100 arranged to implement operations in accordance with example methods described herein. Machine 100 may take any of a variety of forms, including for example a dedicated gaming machine, a personal computer, a server computer, a personal digital assistant, a mobile phone, a tablet device, or some other computing device.

Machine 100 may include a communication interface 102, a user interface 104, and a logic module 106, all of which may be coupled together by a system bus, network, or other connection mechanism 108. The communication interface 102 may include a wired or wireless network communication interface. For purposes of this description, any data described as being provided, sent, or transmitted by machine 100 can be data sent by communication interface 102 over a communication network. Also, for purposes of this description, any data described as being received by machine 100 can be data sent to communication interface 102 over a communication network.

The user interface 104 may facilitate interaction with a user (e.g., a player of a game) if applicable. As such, the user interface 104 may take the form of a GUI and may include output components such as a speaker and a display 110, and input components such as a keypad, keyboard, mouse, or a touch-sensitive screen. As described in greater detail below, display 110 may be configured to show, among other things, a symbol set in a game or a portion thereof.

The logic module 106 can take the form of a processor 112 and a data storage 114. The processor 112 can include a general-purpose processor (e.g., a microprocessor) or a special-purpose processor (e.g., a digital signal processor or an application specific integrated circuit) and may be integrated in whole or in part with the communication interface 102 or the user interface 104. Any processor discussed in this description or shown in the drawings can be referred to as a computer-readable processor. Any data storage discussed in this description or shown in the drawings can be referred to as computer-readable data storage.

Data storage 114 may include volatile or non-volatile storage components and may be integrated in whole or in part with processor 112. Data storage 114 may take the form of a non-transitory computer-readable medium and may include software program instructions, that when executed by processor 112, cause machine 100 to perform one or more of the operations described herein. Any software program instructions discussed in this description or shown in the drawings can be referred to as computer-readable program instructions, or more simply, program instructions.

Data storage 114 may also include operating system software on which machine 100 may operate. For example, machine 100 may operate on a Windows®-based operating system (e.g., Windows 7 or Windows 10) provided by the Microsoft® Corporation of Redmond, Wash. Other examples of operating systems are possible.

Figure 2:
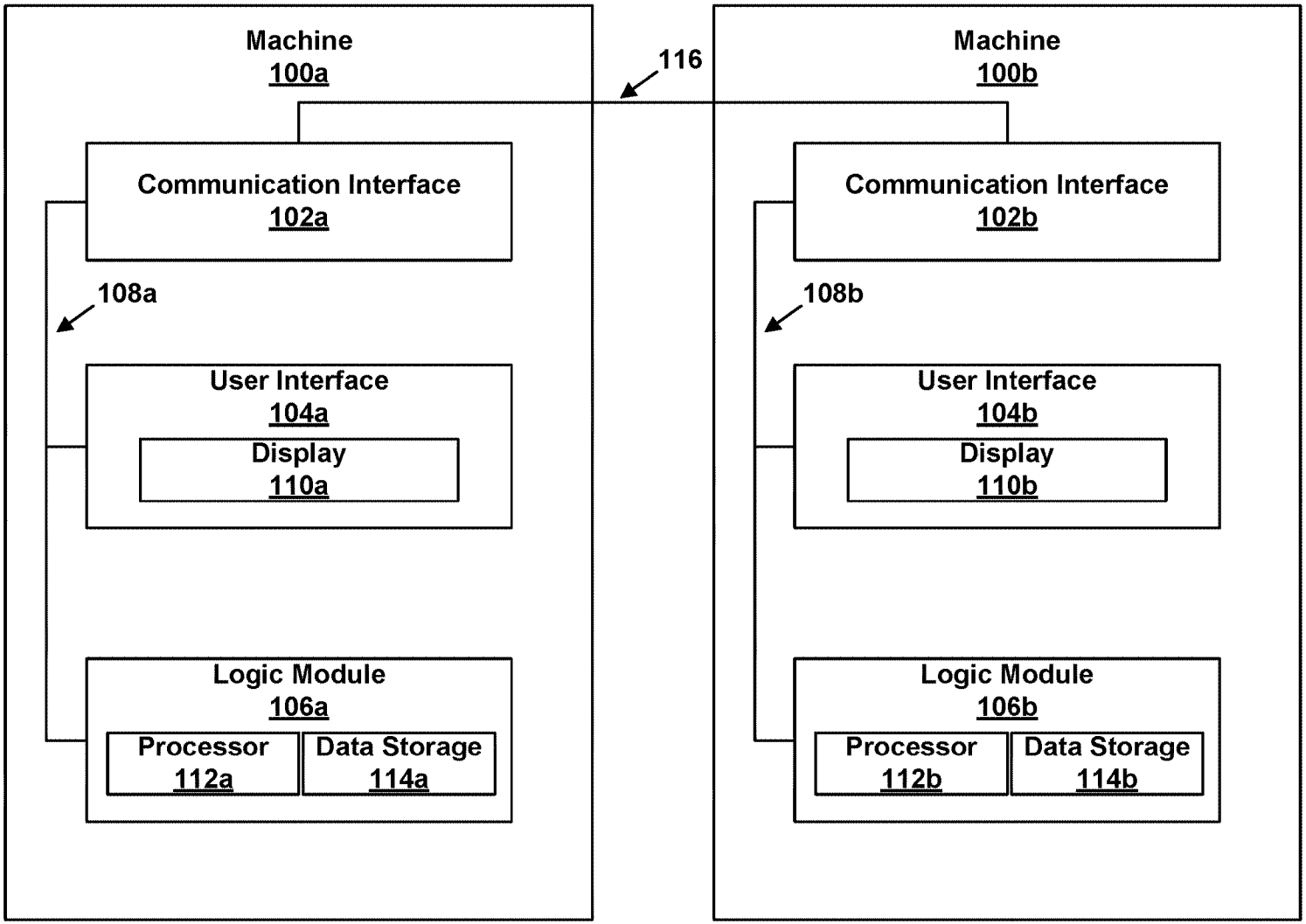
FIG. 2 is a simplified block diagram of an example server machine connected to an example client machine over a computer network, in accordance with example embodiments.

FIG. 2 is a simplified block diagram of an example server machine 100*a* connected to an example client machine (sometimes referred to as a workstation) 100*b* over a communication network 116. A configuration of elements including server machine 100*a* and client machine 100*b* can be referred to as a server-client based configuration.

The components of the server machine 100*a* and the client machine 100*b* are shown with corresponding "a" and "b" reference numerals (i.e., based on machine 100). Server machine 100*a* includes communication interface 102*a*, user interface 104*a* (which incorporates display screen 110*a*), logic module 106*a* (which incorporates processor 112*a* and data storage 114*a*), and communication bus 108*a*. Likewise, client machine 100*b* includes communication interface 102*b*, user interface 104*b* (which incorporates display screen 110*b*), logic module 106*b* (which incorporates processor 112*b* and data storage 114*b*), and communication bus 108*b*.

The server machine 100*a* is configured to communicate with the client machine 100*b* over communication network 116 (via the communication interfaces 102*a*, 102*b*). Likewise, the client machine 100*b* is configured to communicate with the server machine 100*a* over the communication network 116. For purposes of this description, any data described as being sent or transmitted by the server machine 100*a* can be data sent by communication interface 102*a* over communication network 116. Similarly, any data described as being sent or transmitted by the client machine 100*b* can be data sent by communication interface 102*b* over communication network 116. Furthermore, for purposes of this description, any data described as being received by the server machine 100*a* can be data the server machine 100*a* receives from the communication network 116 using communication interface 102*a*. Similarly, any data described as being received by the client machine 100*b* can be data the client machine 100*b* receives from the communication network 116 using communication interface 102*b*.

The communication network 116 for the server-client based configuration described above may take a variety of forms. For example, the communication network 116 may be a local area network (LAN) in a casino, such that client machines 100*b* dispersed throughout the casino may communicate with the server machine 100*a* in the casino.

In another example, the communication network 116 may be a wide-area network (WAN), such as an Internet network or a network of the World Wide Web. In such a configuration, the client machine 100*b* may communicate with the server machine 100*a* via a website portal (for a virtual casino) hosted on the server machine 100*a*. The data described herein as being transmitted by server machine 100*a* to client machine 100*b* or by client machine 100*b* to server machine 100*a* can be transmitted as datagrams according to the user datagram protocol (UDP), the transmission control protocol (TCP), or another protocol.

The communication network 116 may include any of a variety of network topologies and network devices, and may employ traditional network-related technologies, including for example the public switched telephone network, cable networks, cellular wireless networks, WiFi, and WiMAX. Further, the communication network 116 may include one or more databases (e.g., a player credit account database), to allow for the storing and retrieving of data related to performing an outcome event by a machine, as well as adjusting account balances associated with client machines.

In some examples, machine 100 may include an acceptor of a physical item associated with a monetary value, such as a paper money acceptor, coin acceptor, or a card reader. This acceptor may include a validator configured to identify the physical item, and determine whether the physical item is suitable as payment to the machine.

In some examples, machine 100 may also physically dispense a corresponding payout (e.g., cash), or otherwise facilitate the payout to the player (by adding funds to an electronic account associated with a gaming card). Such an activity may be triggered by a cash-out button either on display 110 or elsewhere on machine 100. Additionally or alternatively to determining the payout amount, machine 100 may perform other actions to award the player. For instance, the machine may display an indication of a tangible prize. Other types of awards may be used as well.

For purposes of this description, any operation listed in a sentence including the words the "machine 100 can cause," the "server machine 100*a* can cause," or the "client machine 100*b* can cause" can be carried out, at least in part, as a result of that particular machine executing software program instructions. Those software program instructions can be stored within data storage 114, 114*a*, or 114*b*.

Data storage 114, 114*a*, and 114*b* can also store data. As an example, a global symbol group for a reel-based game may include multiple symbols, such as a WILD, an ace, a king, a queen, a jack and a ten that may be used in connection with the outcome event, such as a wager game. The ace, king, queen, jack and ten symbols can represent symbols found on a standard deck of playing cards. The WILD symbol may have special properties that allow it to form winning combinations with other symbols.

However, such a global symbol group may be customized with particular symbols as desired. As some possible examples, the symbols may include images of people, animals, dinosaurs, fanciful creatures, cartoon characters, inanimate objects, or other things in addition to or instead of WILD, ace, king, queen, jack, or ten symbols. Furthermore, WILD symbols may vary in design. Examples of some possible symbols are shown in the accompanying drawings.

Figure 3:
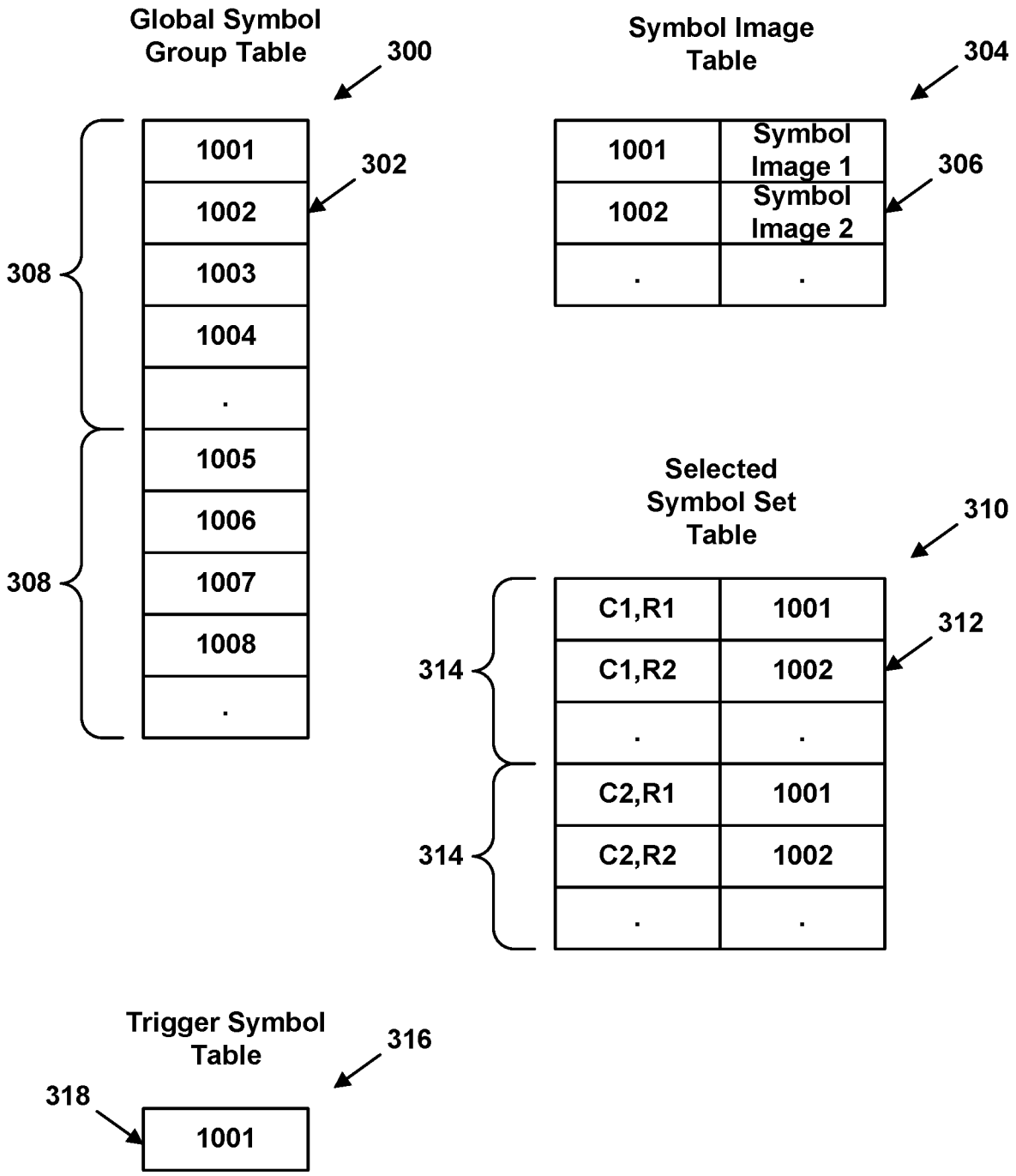
FIG. 3 depicts diagrams of tables that may be used with the processes, machines, and systems herein, in accordance with example embodiments.

In one example, the global symbol group may be represented as a table (or other data structure) stored in data storage 114. FIG. 3 shows an example global symbol group table 300. The global symbol group table 300 includes multiple records 302, each including an identifier (e.g., 1001, 1002, 1003 1004, etc.) that represents a particular symbol. In one example, the global symbol group, and therefore the global symbol group table 300, may be divided into multiple sub-groups 308 as discussed in greater detail below.

The global symbol group table 300 may be used in connection with a symbol image table 304. The symbol image table 304 includes multiple records 306 (shown as distinct rows of table 304), each including an identifier that represents a particular symbol, and a corresponding displayable image. As such, the symbol image table 304 may be used to map an identifier in the global symbol group table 300 to a displayable image. Such an image may be arranged according to the Joint Photographic Experts Group (JPEG), Graphics Interchange Format (GIF), or Portable Network Graphics (PNG) encodings, for example.

During the course of a game, various symbol sets may be selected for display. Each selected symbol set may be stored in a table such as selected symbol set table 310. Selected symbol set table 310 includes multiple records 312 (shown as distinct rows in selected symbol set table 310), each record including an arrangement position of the symbol, and an identifier that represents the symbol. As such, each symbol in the selected symbol set may correspond with a respective arrangement position in a display arrangement (e.g., both a column number and a row number in a column-and-row arrangement). As an example, C1,R1, shown in the selected symbol set table 310, represents a symbol position at column 1 (e.g., a left-most column of a plurality of columns in a symbol-display-portion of display 110) and row 1 (e.g., a top row of a plurality of rows in a symbol-display-portion of display 110). The column identifiers in selected symbol set table 310 (e.g., C1 and C2) can refer to columns in a symbol matrix or reels of a plurality of reels that can be spun.

In one example, machine 100 may select the first symbol set by iterating through each record 312 in the selected symbol set table 310, and selecting a symbol identifier from among the symbol identifiers in the global symbol group table 300. In some examples, the symbol identifiers are numbers and machine 100 uses a random number generator to select such numbers, and therefore to randomly select symbols.

In some examples, machine 100 may select each subset in the first symbol set from the corresponding sub-group in the global symbol group. This type of selection may be used when the symbol set represents one or more reels in a reel-type wager game. In this instance, each sub-group includes all the symbols of a given reel, and the selected sub-set includes the symbols of the reel that are "in play," namely those included in the selected symbol set.

In some examples, the selected symbol set may be partially restricted. For instance, the selected symbol set may include an instance of a predetermined symbol from the global symbol group, for example, a WILD symbol. In another example, the predetermined symbol may be in a subgroup of global symbol group table 300 distinct from the subgroups from which symbols for the reels are selected.

As noted above, for each symbol in the selected first symbol set, the example embodiments can include machine 100 randomly determining a corresponding arrangement position. As such, in an example where the arrangement is a column-and-row arrangement, machine 100 may randomly determine a column identifier and a row identifier (from a set of potential column identifier and row identifier combinations) for each symbol in the selected first symbol set. In an example where the arrangement has symbol position identifiers (e.g., whole number 1 through 15, inclusive, as described above), machine 100 may randomly select a symbol position identifier for each symbol in the selected first symbol set.

Where the column and row arrangement is used to simulate reels, machine 100 may display the each subset in a corresponding column, such as by superimposing each subset over a virtual reel in a corresponding column. Thus, a sub-group 308 may represent an ordering of symbols on a particular reel.

Figure 4:
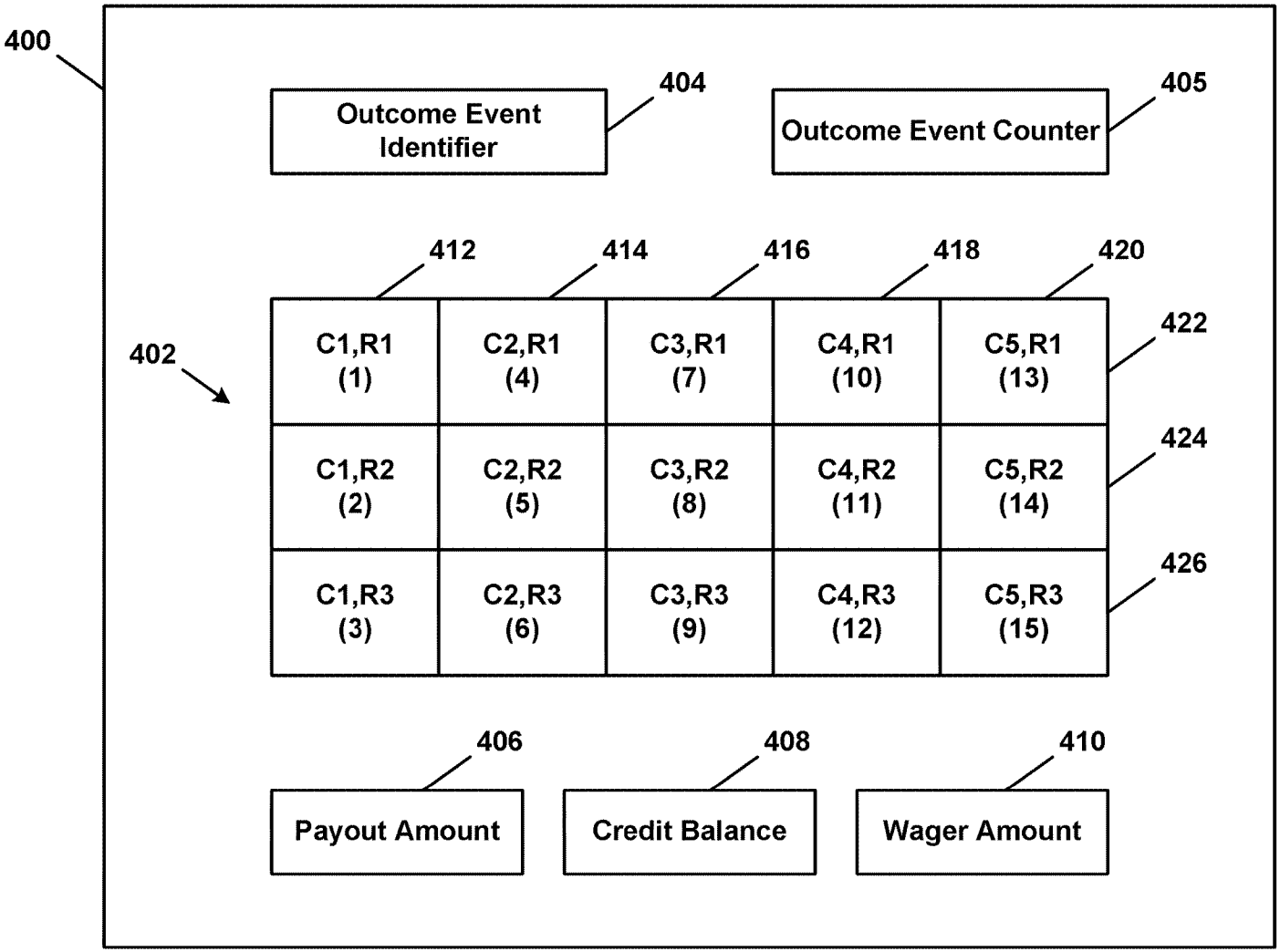
FIG. 4 depicts elements displayable by a display of a machine, in accordance with example embodiments.

FIG. 4 depicts a screenshot 400 that machine 100, server machine 100*a*, or client machine 100*b* can visually present (i.e., display) using displays 110, 110*a*, and 110*b*, respectively. For purposes of this description, each element of screenshot 400 can be a displayable element of the display. Screenshot 400 includes a symbol-display-portion 402, an outcome event identifier 404, an outcome event counter 405, a payout amount indicator 406, a credit balance indicator 408, and a wager amount indicator 410.

Symbol-display-portion 402 can include multiple symbol-display-segments and multiple symbol positions. As an example, the symbol-display-segments can include vertical symbol-display-segments 412, 414, 416, 418, and 420 (or more simply, vertical SDSs 412-420). As another example, the symbol-display-segments can include horizontal symbol-display-segments 422, 424, and 426 (or more simply, horizontal SDSs 422-426). Each symbol-display-segment can include multiple symbol positions. The vertical SDSs 412-420 are shown in FIG. 4 as having three symbol positions. The horizontal SDSs 422-426 are shown in FIG. 4 as having five symbol positions. A person skilled in the art will understand that those symbol-display-segments can be configured with different numbers of symbol positions than shown in FIG. 4.

The vertical SDSs 412-420 can be configured as spinnable reels. The processor of a machine or system displaying screenshot 400 can display the spinnable reels spinning and stopped after spinning. For vertical SDSs 412-420, the spinnable reels may spin in a vertical direction (e.g., top to bottom or bottom to top, with respect to the symbol-display-portion 402).

The horizontal SDSs 422-426 can be configured as spinnable reels. The processor of a machine or system displaying screenshot 400 can display the spinnable reels spinning and stopped after spinning. For horizontal SDSs 422-426, the spinnable reels may spin in a horizontal direction (e.g., left to right or right to left, with respect to the symbol-display-portion 402).

Machine 100 can cause symbol-display-segments to spin, and to cause spinning symbol-display-segments to stop spinning. The spinning and stopping of the spinning symbol-display-segments can be carried out for each outcome event. In accordance with the embodiments in which the symbol-display-portion 402 includes columns or reels that spin from top to bottom or bottom to top, spinning the reels can include starting the spinning from a left-most column or reel to a right-most column or reel. Stopping the reels can occur using a similar sequence. Other sequences of spinning and stopping the spinning can be used. Moreover, the spinning or stopping of spinning of two or more columns or reels could occur simultaneously.

The multiple symbol positions in symbol-display-portion 402 are identified by column and row designators, in which C1=column 1, C2=column 2, C3=column 3, C4=column 4, C5=column 5, R1=row 1, R2=row 2, and R3=row 3. The multiple symbol positions in symbol-display-portion 402 are also identified by distinct numerical identifiers shown within parenthesis. C1 can be a first SDS. C2 can be a second SDS. C3 can be a third SDS. C4 can be a fourth SDS. C5 can be a fifth SDS. As shown in FIG. 4, C2 is between C1 and C3, C3 is between C2 and C4, and C4 is between C3 and C5.

For a matrix arrangement with 15 symbol positions as shown in FIG. 4, the numerical identifiers can be whole numbers 1 through 15, inclusive. The processors or machines described herein can be configured to select a symbol position of symbol-display-portion 402 using a random number generator that is configured to generate a number within the range 1 through N, inclusive, where N equals the number of symbol positions in symbol-display-portion 402. For the matrix arrangement, each symbol-display-segment can be a distinct column of the multiple columns within the matrix. Alternatively, for the matrix arrangement, each symbol-display-segment can be a distinct row of the multiple rows within the matrix.

The processor of the machines or systems described herein can determine a state the machine or system is operating in or an outcome event that can occur during the determined state of the machine or system. In response to making that determination, the processor can cause the outcome event identifier 404 to display an identifier of the outcome event that can occur during the determined state. For example, the outcome event identifier can identify a base outcome event, a bonus outcome event or another type of outcome event. The bonus outcome event can be a "free spins" outcome event or some other outcome event.

The processor of the machines or systems described herein can determine a wager amount placed on an outcome event, a payout amount after or during occurrence of an outcome event resulting in a win, a credit balance after or while decreasing a number of credits based on placement of a wager or after or while increasing a number of credits based on a determined payout amount, and a number of awarded remaining outcome events that can occur.

The processor can cause the determined wager amount to be displayed by the wager amount indicator 410, the determined payout amount to be displayed by the payout amount indicator 406, the determined credit balance to be displayed by the credit balance indicator 408, and the number of awarded remaining outcome events to be displayed by the outcome event counter 405.

Figure 5:
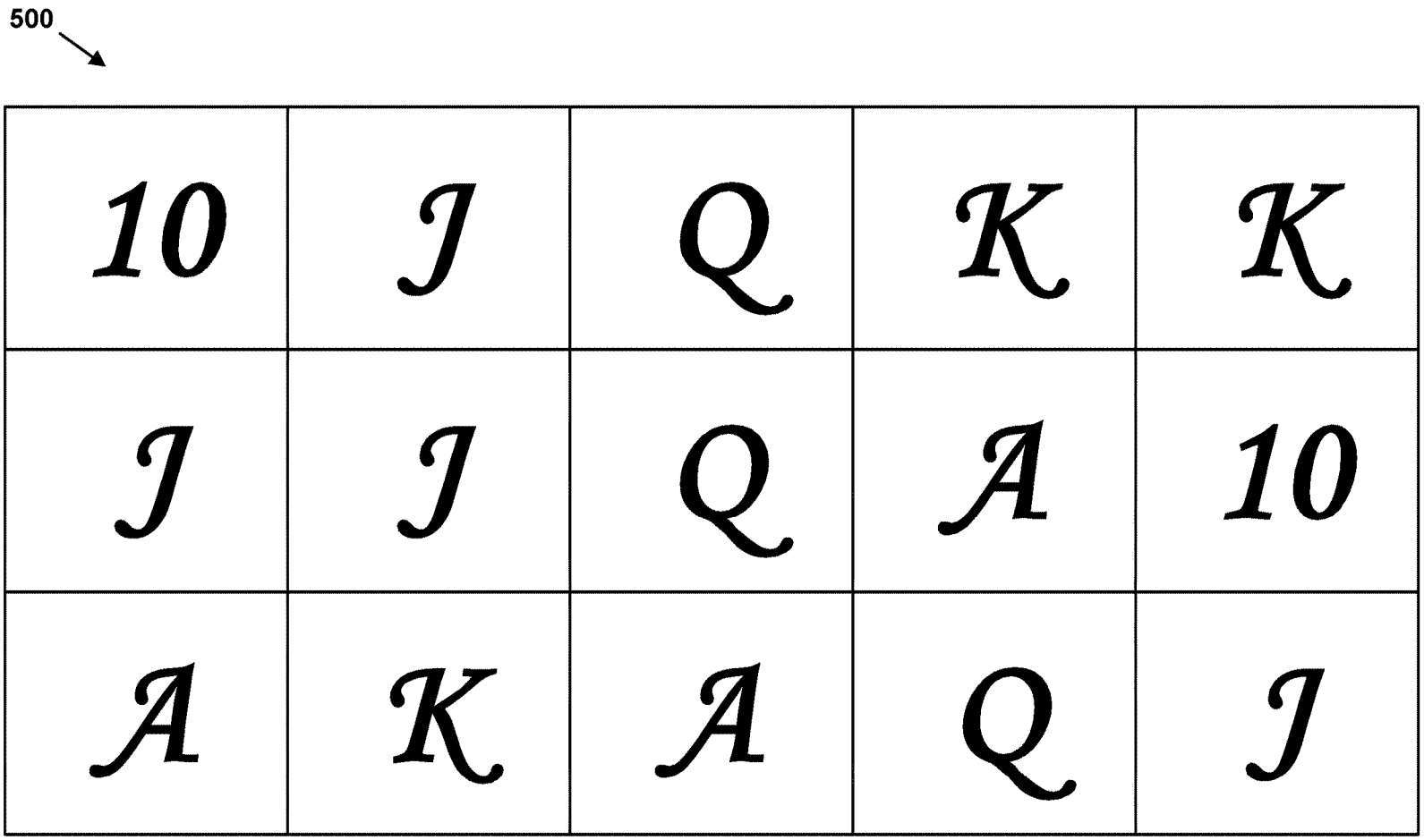
FIG. 5 depicts a selected symbol set in a display, in accordance with example embodiments.

FIG. 5 shows an example of a selected symbol set 500 from the global symbol group for display during a base or bonus outcome event. The selected symbol set 500 includes (i) symbol "10" at arrangement positions C1,R1 and C5,R2, (ii) symbol "J" at arrangement positions C2,R1, C1,R2, C2,R2, and C5,R3, (iii) symbol "Q" at arrangement positions C3,R1, C3,R2, and C4,R3, (iv) symbol "K" at arrangement positions C4,R1, C5,R1, and C2,R3, and (v) symbol "A" at arrangement position C4,R2, C1,R3, and C3,R3. Other arrangements of symbols, in terms of the number of columns, number of rows, or the layout of symbols, are possible.

III. Example Reel-Based Game

FIG. 6A, FIG. 6B, FIG. 6C, and FIG. 6D (i.e., FIGS. 6A-6D) depict a flow chart showing a set of operations 645 (or more simply, "the set 645") that can, for example, be carried out using machine 100. Nonetheless, some or all of these operations may be carried out on server machine 100*a* and/or client machine 100*b*.

The operations of the set 645 are shown within blocks labeled with integers between 600 and 642, inclusive, and can pertain to a method in connection with machine 100. The example method can relate to performing outcome events, such as a wager game. Any other operation(s) described herein as being performed by machine 100 can be performed prior to, while, or after performing any one or more of the operations of the set 645, unless context clearly dictates otherwise. Those other operation(s) can be performed in combination with or separately from any one or more of the operations of the set 645. Any operation described below, or elsewhere in this description, with respect to FIGS. 6A, 6B, 6C, and 6D, can be performed, at least in part, by a processor, such as processor 112 executing software program instructions.

Figure 6A:
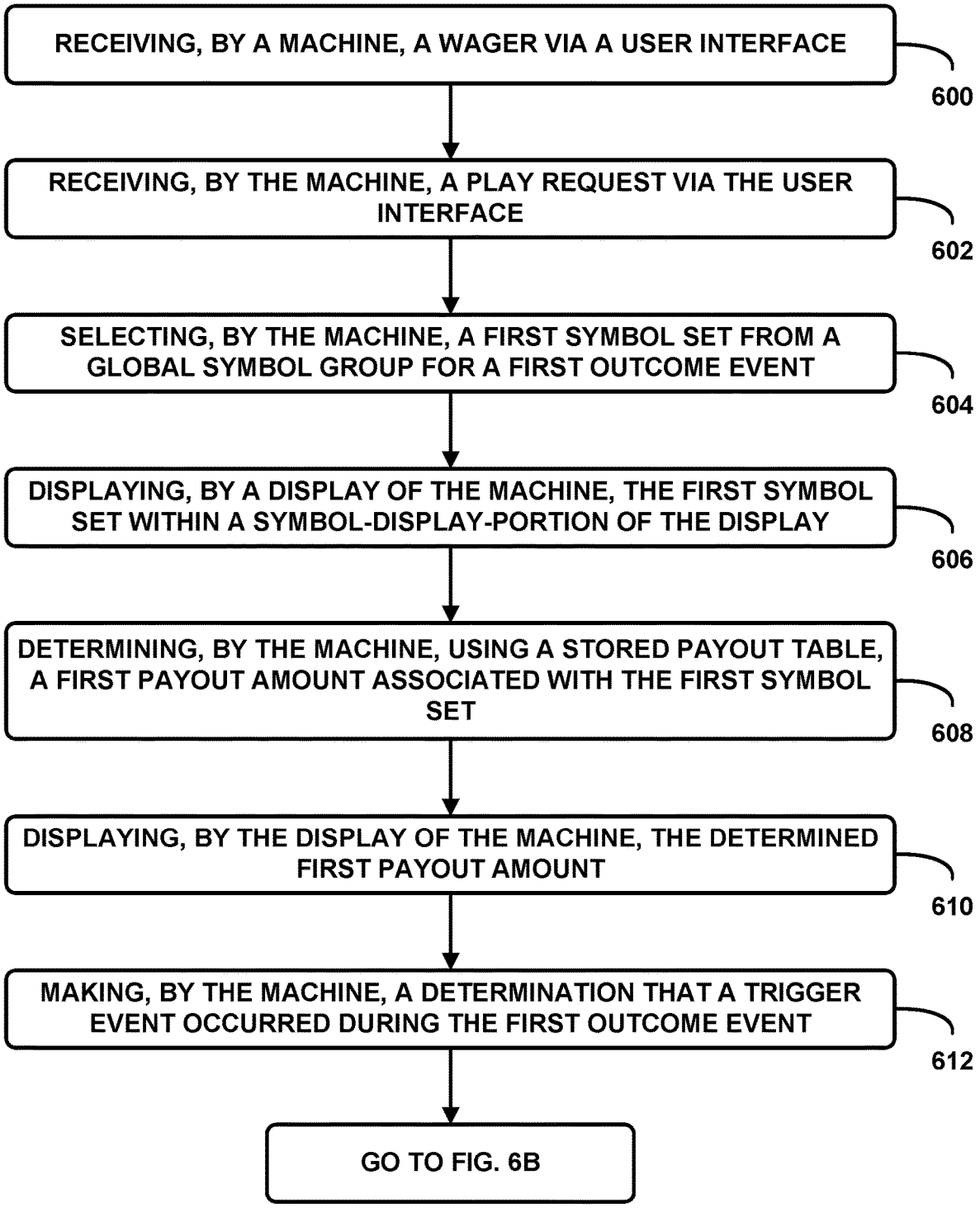
FIG. 6A is a first part of a flow chart, in accordance with example embodiments.

Turning to FIG. 6A, block 600 includes receiving, by machine 100, a wager via the user interface 104. In one example, this may allow a player to enter a wager (e.g., a wager amount) using a keypad of the user interface 104. The wager can be placed on an outcome event, such as, but not limited to, a base outcome event configured as a wager game. The received wager may or may not provide a user of the machine with an opportunity to earn (e.g., win) a payout. Since a received wager does not necessarily provide an opportunity to earn a payout, the received wager can be referred to as a payment. A base outcome event can be carried out after or in response to receiving a payment.

Machine 100 can be configured such that a bonus outcome event can be carried out without receiving any additional payment after receiving a payment to carry out a base outcome event that results in an award of a predetermined number of bonus outcome events.

A player using machine 100 may have a corresponding player credit balance from which the entered wager may be deducted in response to the wager being entered or machine 100 receiving a play request from the player. For example, a player may have a player credit balance of 100,000 credits, which may be reduced to 99,750 credits upon the player requesting a play of the game with a wager of 250 credits. Additionally, or alternatively, the wager can be received by entry of a token, coin, or paper bill into the user interface 104 or by sliding or inserting a payment card, such as a credit or debit card, into the user interface 104. Machine 100 can cause display 110 to display wager information such as, but not limited to, a player credit balance on the credit balance indicator 408, possible wager amounts in wager amount indicator 410, and a received wager amount in wager amount indicator 410.

Next, block 602 includes receiving, by machine 100, a play request (e.g., a "spin" request) via the user interface 104. Receiving the play request may involve or allow a player to pull a lever or push a button on machine 100 to initiate occurrence of an outcome event or to request a play of the wager game. Receiving the play request can result in the player's credit balance being reduced by an amount of the player's wager or payment to carry out the outcome event.

Next, block 604 includes selecting, by machine 100, a first symbol set from a global symbol group to display within the symbol-display-portion 402 of display 110 for a first outcome event. Determining the first symbol set can include processor 112 carrying out a random selection, such as a random selection of the first symbol set from a global symbol group, as described with respect to FIG. 3. The first outcome event may be a base outcome event.

Next, block 606 includes displaying, by the machine 100 on the symbol-display-portion of the display 110, the selected first symbol set. FIG. 5 shows an example of a first symbol set 500 selected from the global symbol group for display during an outcome event (e.g., a base outcome event).

Next, block 608 includes determining, by machine 100, using a stored payout table (not shown), a first payout amount, where the first payout amount is a function of the selected first symbol set and the received wager. Processor 112 can execute program instructions to determine whether a payout is earned (e.g., won) as a result of each outcome event occurring at machine 100. If a payout is not earned, the payout amount can be zero. If a payout is earned, the payout amount can be a function of the received wager and the symbol set selected for the outcome event (e.g., the first symbol set selected for the first outcome event) or the corresponding arrangements of symbols in the selected first symbol set.

Next, block 610, includes displaying, by display 110 of machine 100, the determined first payout amount. For example, where machine 100 has determined, using the stored payout table, a first payout amount of 500 credits, machine 100 may display on display 110 the determined payout amount of 500 credits. Additionally or alternatively, machine 100 may add the determined payout amount to the player credit balance and display the updated player credit balance. For instance, where the player credit balance was 99,750 credits before the payout amount was determined, machine 100 may add the determined payout amount of 500 credits to the player credit balance so that the updated balance is 100,250 credits. Furthermore, machine 100 can cause display 110 to display a count-up from a first balance amount (e.g., 99,750 credits) to a second balance amount (e.g., 100,250 credits), where the second balance amount equals a sum of the first balance amount and the determined payout amount.

Next, block 612 includes making, by machine 100, a determination that a trigger event occurred during the first outcome event. The trigger event can be a randomly occurring event, such as an event that randomly occurs during performance of at least some outcome events. For example, occurrence of the trigger event can include the presence of at least one predetermined symbol in the first symbol set, such as in connection with a previous play of the game (e.g., a base outcome event).

Similar to the selection of the first symbol set, in one example, machine 100 may use a random number generator to select the predetermined symbol from the global symbol group. In another example, the predetermined symbol may be non-randomly selected, such as selected by a user (e.g. a player, machine designer, or casino personnel). In another example, the predetermined symbol may be, for example, a WILD symbol (e.g., a WILD symbol having a unique appearance that signals the trigger event).

Making the determination that the trigger event occurred can take place while machine 100 operates in a first machine state (or more simply, the first state). Machine 100 can be configured such that, while machine 100 is operating in the first state, machine 100 allows the player to play base outcome events in which sets of symbols selected from a global symbol group can be selected by processor 112 and displayed by display 110.

Figure 6B:
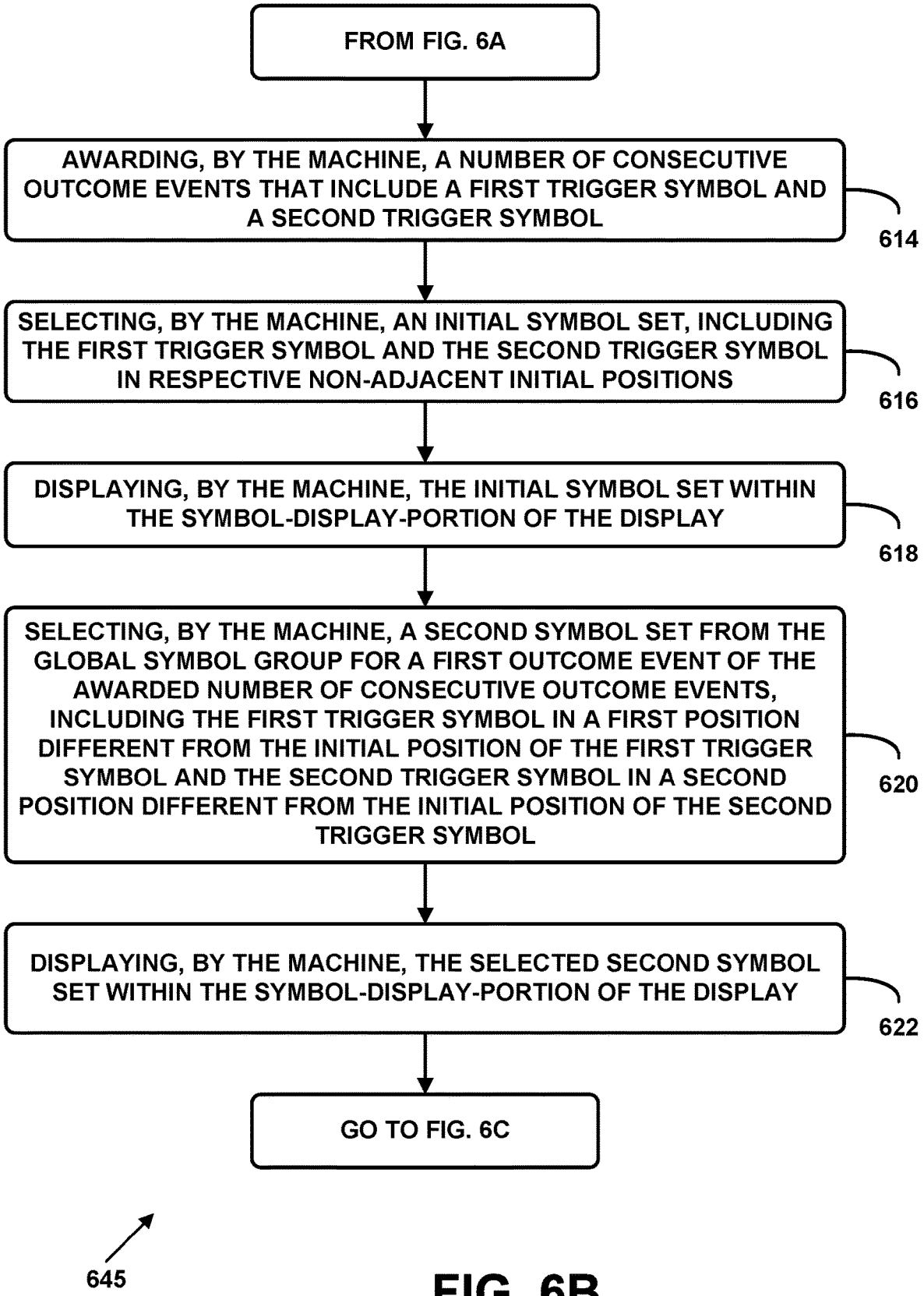
FIG. 6B is a second part of the flow chart of FIG. 6A, in accordance with example embodiments.

Turning to FIG. 6B, block 614 includes, responsive to machine 100 making the determination that a trigger event occurred (i.e., the determination made at block 612), awarding, by machine 100, a number of consecutive outcome events that include a first trigger symbol and a second trigger symbol. The awarded number of consecutive outcome events may be a predetermined number of consecutive plays (e.g., spins and/or patterns of symbols being displayed) of a base game or a bonus game. Each respective outcome event of the awarded number of consecutive outcome events may include, within a symbol set selected for the respective outcome event, the first trigger symbol and the second trigger symbol. Thus, the first trigger symbol and the second trigger symbol may persist for the awarded number of consecutive outcome events, regardless of whether they have been part of a winning combination during any of the awarded number of outcome events. In some embodiments, more than two trigger symbols may be included in the awarded number of outcome events.

The first trigger symbol and the second trigger symbol may be predetermined symbols selected from the global symbol group. The first trigger symbol and the second trigger symbol may be the same trigger symbol. For example, the first trigger symbol and the second trigger symbol may each be WILD symbols. Additionally or alternatively, the first trigger symbol and the second trigger symbol may be visually distinct from one another and from other symbols within the global symbol group. The visual distinctiveness of the first and second trigger symbols may allow their movements between consecutive outcome events to be easily discernible.

In some embodiments, the awarded outcome events may be base outcome events of a base game and may require additional wagers to be played. Alternatively, the awarded outcome events may be bonus outcome events that do not require an additional wager to be played. The awarded number of consecutive outcome events can be conditioned upon a combination of symbols displayed by display 110 as a result of playing a base outcome event (e.g., the awarded number of outcome events may be conditioned on the number of predetermined symbols present during the trigger event). Machine 100 can cause outcome event identifier 404 to identify the outcome event awarded (e.g., a "free spins" bonus) and to cause the outcome event counter 405 to display the number of awarded outcome events.

Furthermore, in response to making the determination at block 612, machine 100 can transition from operating in the first state to operating in a second machine state (or more simply, the second state). Machine 100 can be configured such that, while machine 100 is operating in the second state, machine 100 allows the player to play the awarded number of outcome events in which sets of symbols selected from a global symbol group can be selected by processor 112 and displayed by display 110. In accordance with an embodiment in which the symbol-display-portion includes 15 symbol positions, selecting a set of symbols for an outcome event of the awarded outcome events can include selecting 15 symbols, 2 of which are the first trigger symbol and the second trigger symbol.

Machine 100 can be configured to transition from operating in the second state back to operating in the first state. This transition can occur in response to machine 100 determining any of a variety of trigger events, such as, but not limited to, occurrence of all of the awarded number of consecutive plays of the outcome event, or a player stopping play of machine 100 while one or more of the awarded number of consecutive plays of the outcome event remain to occur. Machine 100 can be configured to store a number indicating any remaining consecutive plays of the outcome event and to allow a player awarded the consecutive plays to commence playing any remaining consecutive plays of the outcome event at a time after the player stops performing (e.g., playing) the outcome events.

Next, block 616 includes selecting, by machine 100, an initial symbol set. The initial symbol set includes the first trigger symbol and the second trigger symbol in respective non-adjacent initial positions. The initial symbol set might not be one of the awarded consecutive outcome events. Rather, the initial symbol set may be a default starting symbol configuration intended to show the initial positions of the first and second trigger symbols prior to a first iteration of the awarded number of outcomes.

Accordingly, selecting the initial symbol set may include determining the respective non-adjacent initial positions for the first trigger symbol and the second trigger symbol. The initial positions may be predetermined default positions or randomly selected positions at which the first and second trigger symbols are displayed within the symbol-display-portion prior to a first outcome event of the awarded number of outcome events.

Figure 7:
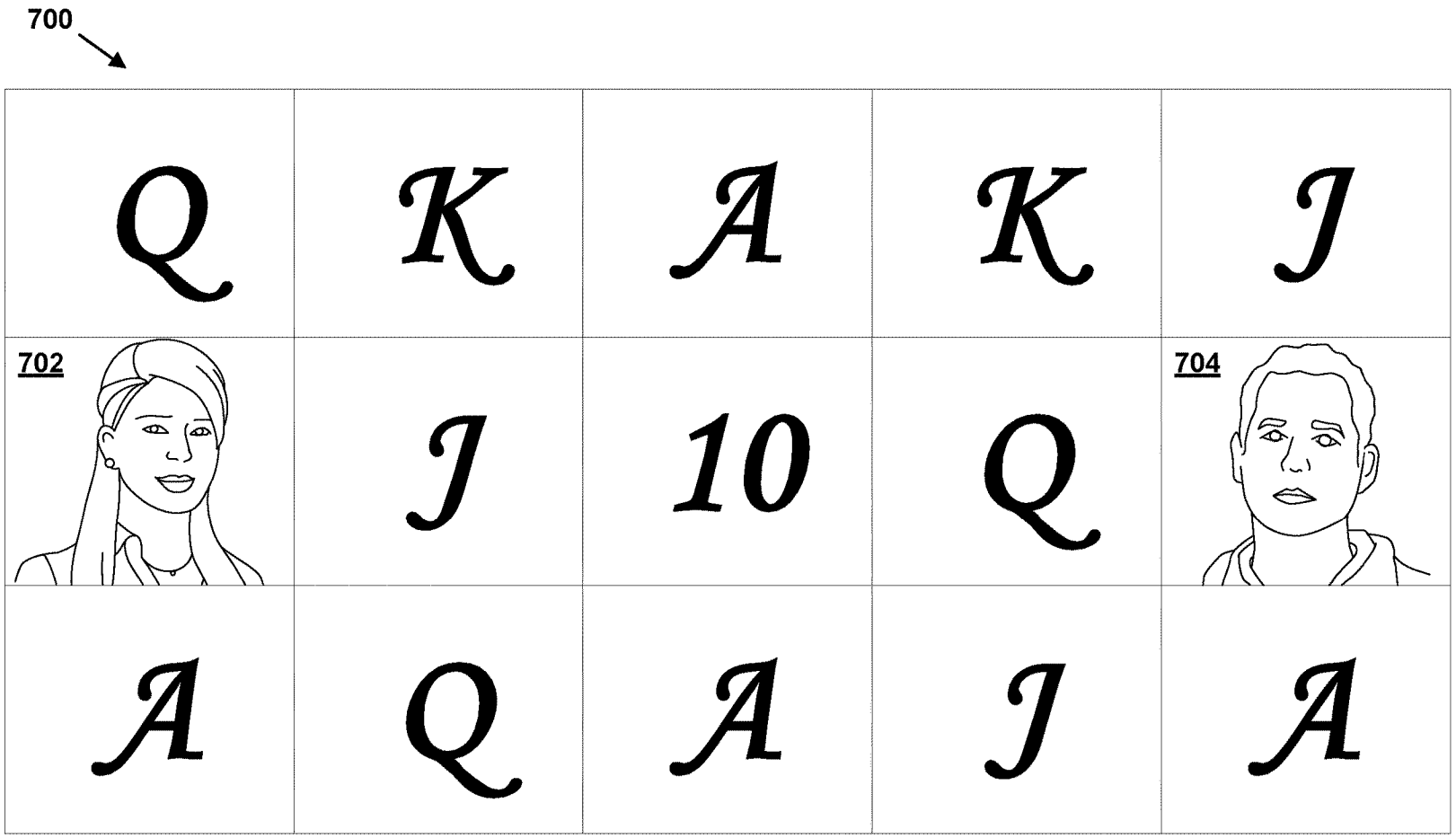
FIG. 7 depicts another selected symbol set in a display, in accordance with example embodiments.

Next, block 618 includes displaying, by machine 100, the initial symbol set within the symbol-display-portion of the display. Displaying the initial symbol set includes displaying the first trigger symbol and the second trigger symbol at the respective non-adjacent initial positions within the symbol-display-portion of the display. FIG. 7 shows an example initial symbol set 700 that includes first trigger symbol 702 at initial position C1,R2 and second trigger symbol 704 at initial position C5,R2. Symbol set 700 consists of (i) one "10" symbol at arrangement position C3,R2; (ii) three "J" symbols at arrangement positions C2,R2, C4,R3, and C5,R1; (iii) three "Q" symbols at arrangement positions C1,R1, C2,R3, and C4,R2; (iv) two "K" symbols at arrangement positions C2,R1, and C4,R1; and (v) four "A" symbols at arrangement positions C1,R3, C3,R1, C3,R3, and C5,R3. Notably, first trigger symbol 702, having a first visual appearance, is visually distinct from second trigger symbol 704, having a second visual appearance.

Symbol set 700 (i.e., the initial symbol set) may be a modified version the symbol set of the outcome event associated with the occurrence of the trigger event at block 612 (i.e., the first symbol set). In particular, selecting symbol set 700 may include starting with the first symbol set selected at block 604 and replacing the symbols at positions C1,R2 and C5,R2 with the first and second trigger symbols 702 and 704, respectively. Alternatively, symbol set 700 may be a default symbol set (e.g., a predetermined starting symbol configuration for the awarded number of outcome events) or a symbol set selected randomly from the global symbol group. Symbol set 700 may be selected in response to the occurrence of the trigger event at block 612 and prior to selecting a symbol set for a first of the awarded number of consecutive outcome events.

Next, block 620 includes selecting, by machine 100, a second symbol set from the global symbol group for a first outcome event of the awarded number of consecutive outcome events. The second symbol set may include the first trigger symbol in a first position different from the initial position of the first trigger symbol and the second trigger symbol in a second position different from the initial position of the second trigger symbol. In some embodiments, the first position of the first trigger symbol may be adjacent to the initial position of the first trigger symbol. Likewise, the second position of the second trigger symbol may be adjacent to the initial position of the second trigger symbol. Thus, trigger symbols 702 and 704 may move across the symbol-display-portion in "one-step" increments (i.e., only to adjacent positions) between consecutive outcomes of the awarded number of outcomes. Alternatively, in some embodiments, the first and second positions may be randomly selected and thus might not be adjacent to the respective initial positions.

Adjacent is herein defined to include neighboring arrangement positions as well as overlapping arrangement positions. Thus, symbols adjacent to a particular symbol may include a symbol directly above the particular symbol, a symbol directly below the particular symbol, a symbol directly to the left of the particular symbol, a symbol directly to the right of the particular symbol, up to four symbols directly diagonal from the particular symbol (i.e., above and left of, above and right of, below and left of, and below and right of the particular symbol), and the particular symbol itself. For example, referring to FIG. 4, arrangement positions adjacent to C3,R2 include C2,R1, C2,R2, C2,R3, C3,R3, C4,R3, C4,R2, C4,R1, C3,R1, and C3,R2 (i.e., itself). Arrangement positions adjacent to C5,R2 include C5,R1, C4,R1, C4,R2, C4,R3, C5,R3, and C5,R2 (i.e., itself). Arrangement positions adjacent to C1,R1 include C2,R1, C2,R2, C1,R2, and C1,R1 (i.e., itself). In some implementations, columns 1 and 5 may be considered adjacent. Accordingly, in such implementations, C5,R2 may also be considered adjacent to C1,R1, C1,R2, and C1,R3.

Figure 8:
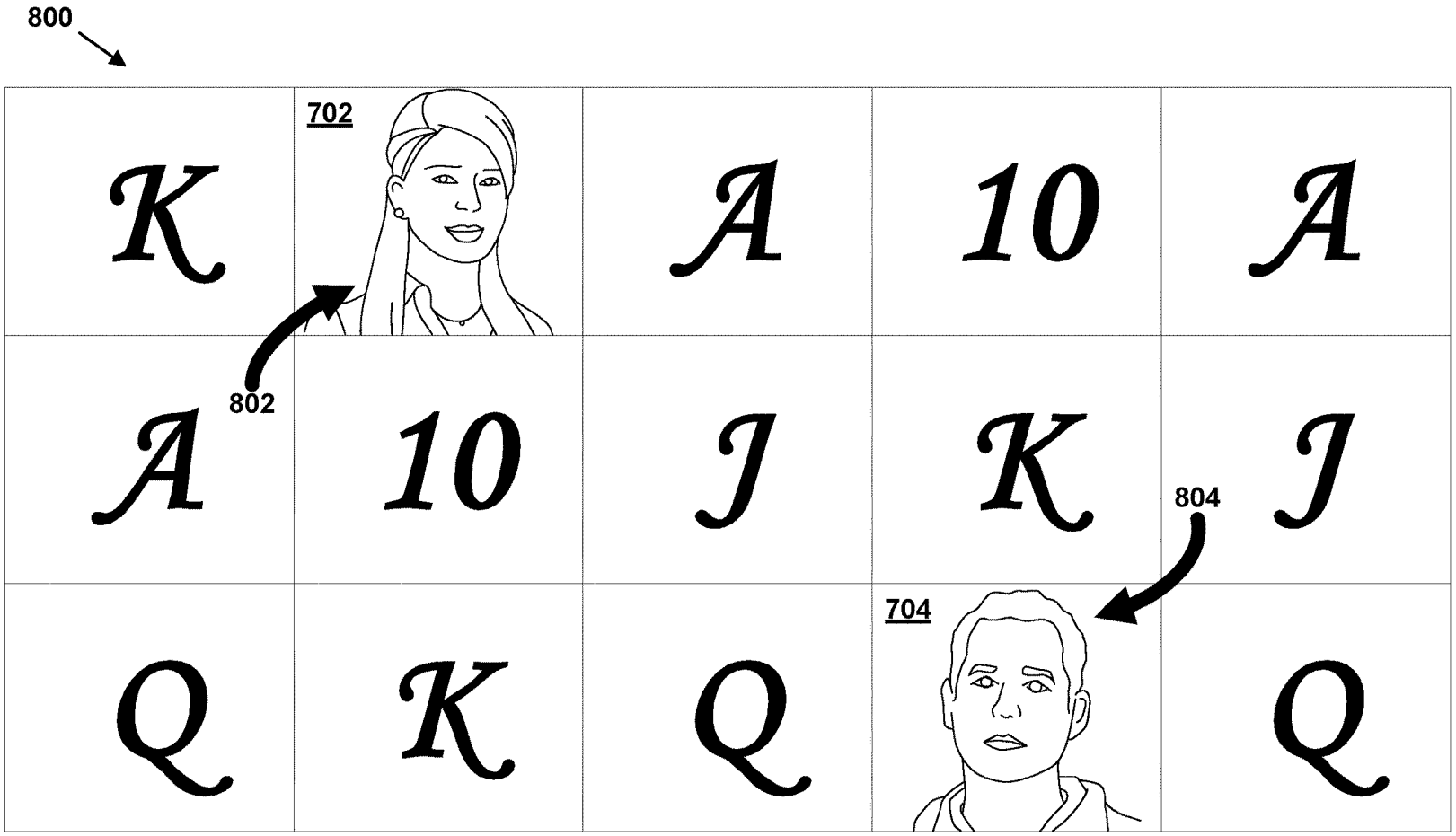
FIG. 8 depicts an additional selected symbol set in a display, in accordance with example embodiments.

Next, block 622 includes displaying, by machine 100, the selected second symbol set within the symbol-display-portion of display 110. FIG. 8 shows an example of such a symbol set 800 selected from the global symbol group. Symbol set 800 includes first trigger symbol 702 at first position C2,R1 and second trigger symbol 704 at second position C4,R3. Symbol set 800 additionally includes (i) two "10" symbols at arrangement positions C2,R2, and C4,R1; (ii) two "J" symbols at arrangement positions C3,R2, and C5,R2; (iii) three "Q" symbols at arrangement positions C1,R3, C3,R3, and C5,R3; (iv) three "K" symbols at arrangement positions C1,R1, C2,R3, and C4,R2; and (v) three "A" symbols at arrangement positions C1,R2, C3,R1, and C5,R1.

Displaying the selected second symbol set may include displaying a first animation of spinning reels that results in selection of the second set of symbols. In some embodiments, the first and second trigger symbols 702 and 704 might not spin in the first animation. Rather, a second animation may be displayed that includes the first trigger symbol 702 translating or otherwise moving from the initial position C1,R2 of first trigger symbol 702 in symbol set 700 to the first position C2,R1 of first trigger symbol 702 in symbol set 800. Likewise, the second animation may include the second trigger symbol 704 translating or otherwise moving from initial position C5,R2 of second trigger symbol 704 in symbol set 700 to the second position C4,R3 of second trigger symbol 704 in symbol set 800. The second animation may take place before, during, of after the first animation.

In some embodiments, the positions of trigger symbols 702 and 704 prior to the second animation may be referred to as "start positions" and the positions of trigger symbols 702 and 704 after the second animation is carried out may be referred to as "end positions." Further, in some examples, the end positions of the trigger symbols within an outcome event may be the starting positions of the trigger symbols in the next outcome event.

Notably, the first position C2,R1 of first trigger symbol 702 in symbol set 800 is selected to be adjacent to the initial position C1,R2 of first trigger symbol 702 in symbol set 700, as indicated by arrow 802. Likewise, the second position C4,R3 of second trigger symbol 704 in symbol set 800 is selected to be adjacent to the initial position C5,R2 of second trigger symbol 704 in symbol set 700, as indicated by arrow 804. By moving a trigger symbol to adjacent positions, rather than any random positions, between consecutive outcome events, trigger symbols 702 and 704 may appear to "walk" or "dance" with respect to one another. Movement to adjacent positions may also introduce some predictability to the movement of trigger symbols 702 and 704 over the course of the awarded number of consecutive outcomes. Such predictability may build anticipation as trigger symbols 702 and 704 move closer to one another, thus increasing player engagement. However, as previously mentioned, the positions of trigger symbols 702 and 704 may, in some embodiments, be selected randomly between consecutive outcome events and might thus not be adjacent.

Figure 6C:
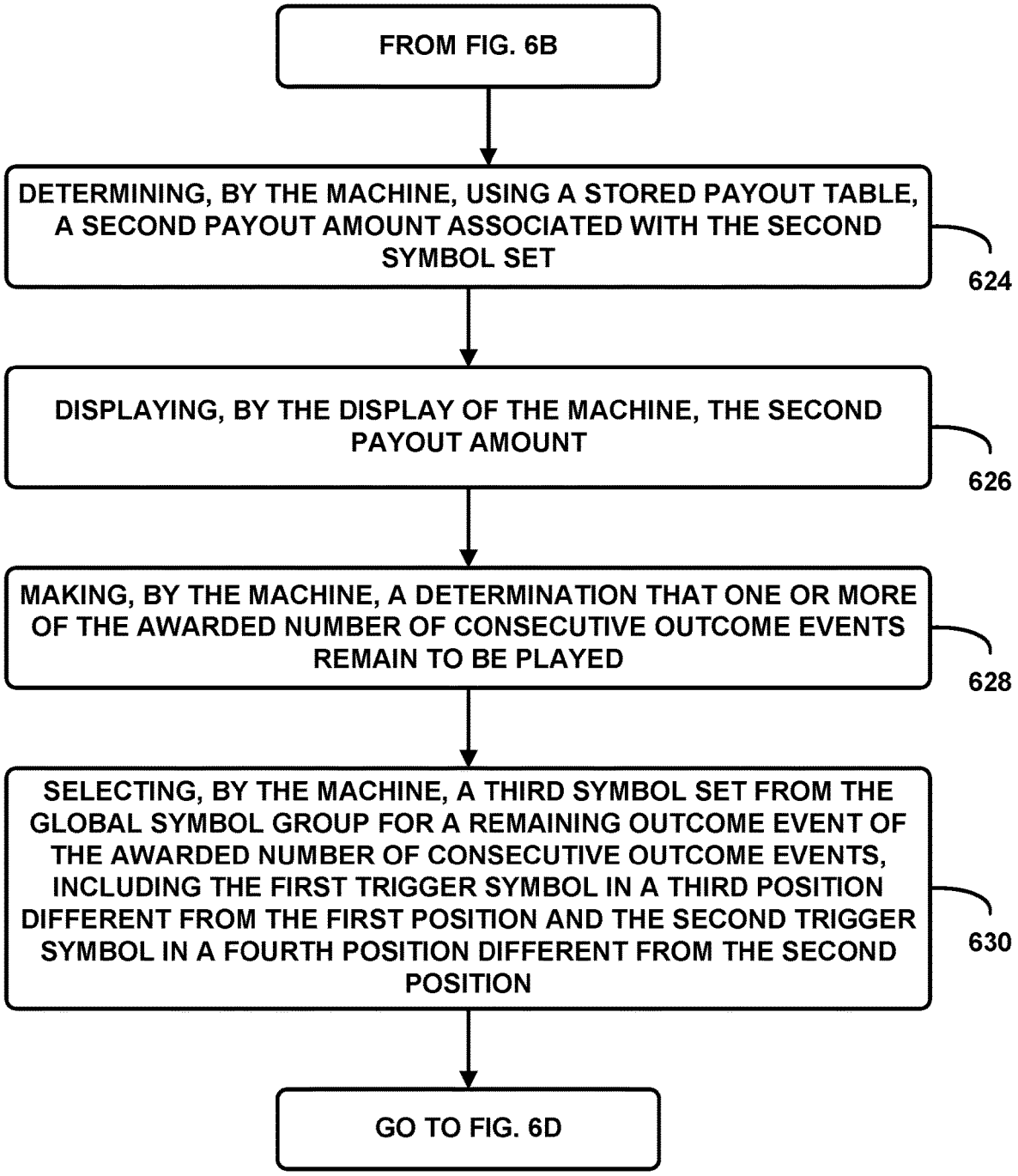
FIG. 6C is a third part of the flow chart of FIG. 6A, in accordance with example embodiments.

Turning to FIG. 6C, block 624 includes determining, by machine 100, using a stored payout table, a second payout amount associated with second symbol set. In one example, the second payout amount may be determined by machine 100 using a stored payout table (not shown) as a function of the received wager and the symbols in the displayed second symbol set (e.g., symbol set 800). In some embodiments, trigger symbols 702 and 704 may be WILD symbols or may function as WILD symbols. Accordingly, second trigger symbol 704, acting as a WILD, and the two "Q" symbols at positions C3,R3 and C5,R3, as shown in FIG. 8, may form a winning combination based on which the second payout amount may be determined. Other winning combinations may be present within symbol set 800 and the second payout amount may also be based thereon.

Next, block 626 includes displaying, by display 110, the determined second payout amount. In one example, the machine 100 may also physically dispense a corresponding payout amount (e.g., cash), or otherwise facilitate the payout to the player (e.g., by adding funds to an electronic account associated with a gaming card).

Next, block 628 includes making, by machine 100, a determination that one or more of the awarded number of consecutive outcome events remain to be played. In that regard, processor 112 may determine that one or more of the awarded outcome events have not occurred by referring to data within data storage 114 that may be displayed at bonus outcome event counter 405 shown in FIG. 4. An awarded outcome event that has not yet occurred can be referred to as a "remaining outcome event."

Next, block 630 includes selecting, by machine 100, a third symbol set from the global symbol group for a remaining outcome event of the awarded number of consecutive outcome events. The third symbol set may include the first trigger symbol in a third position different from the first position and the second trigger symbol in a fourth position different from the second position. Again, in some embodiments, the third position may be adjacent to the first position and the fourth position may be adjacent to the second position. Alternatively, in other embodiments, the third and fourth positions may be selected randomly and might thus not be adjacent to the first and second positions, respectively.

Figure 6D:
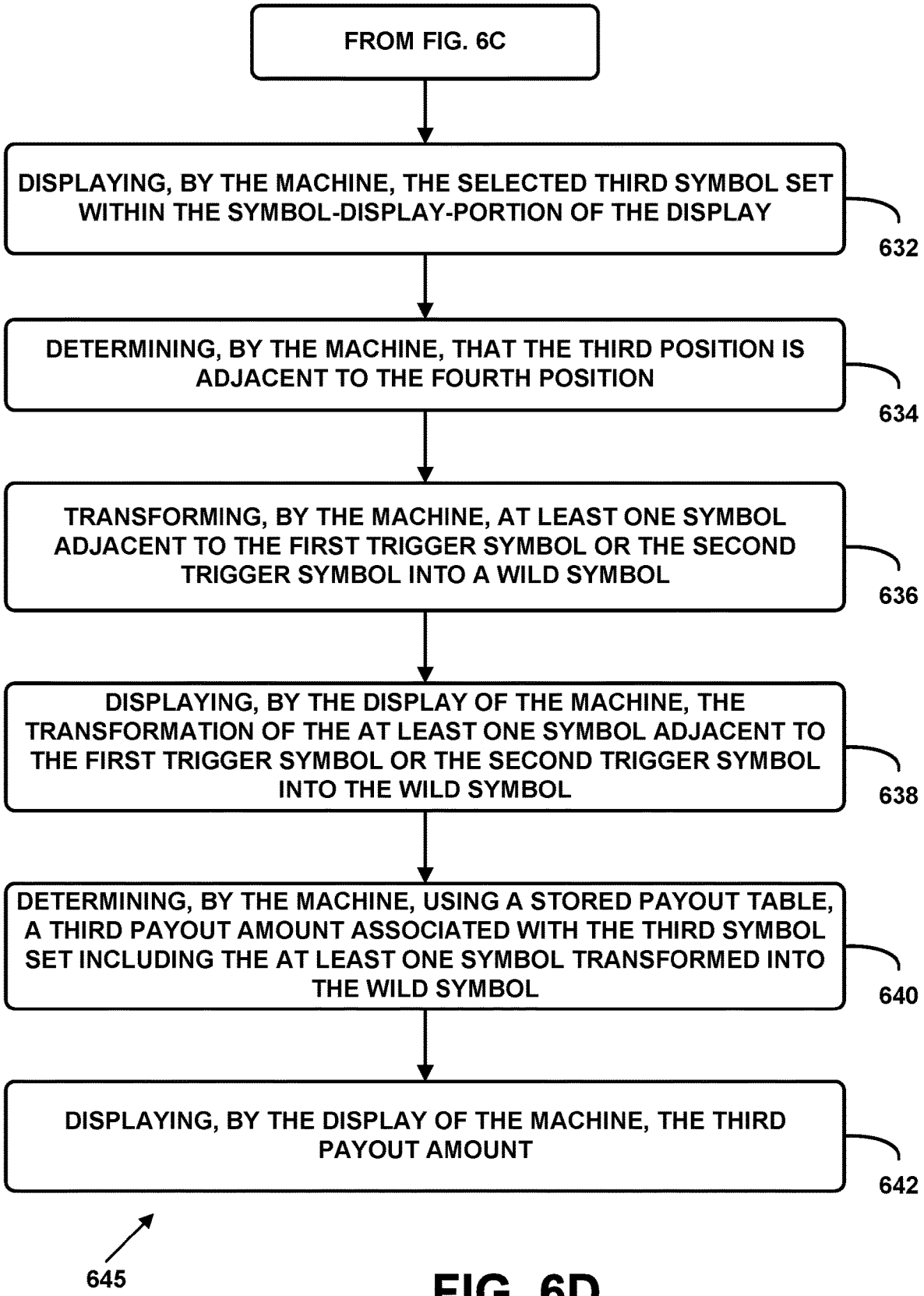
FIG. 6D is a fourth part of the flow chart of FIG. 6A, in accordance with example embodiments.

Turning to FIG. 6D, block 632 includes displaying, by machine 100, the selected third symbol set within the symbol-display-portion of display 110. FIG. 9 shows an example of such a symbol set 900A selected from the global symbol group. Symbol set 900A includes first trigger symbol 702 at third position C2,R2 and second trigger symbol 704 at fourth position C3,R2. Symbol set 900A additionally includes four "10" symbols, three "J" symbols, two "Q" symbols, two "K" symbols, and two "A" symbols at respective arrangement positions. The third position C2,R2 of first trigger symbol 702 in symbol set 900A is adjacent to the first position C2,R1 of first trigger symbol 702 in symbol set 800, as indicated by arrow 902. Likewise, the fourth position C3,R2 of second trigger symbol 704 in symbol set 900A is adjacent to the second position C4,R3 of second trigger symbol 704 in symbol set 800, as indicated by arrow 904. Again, in some embodiments, the positions of trigger symbols 702 and 704 in symbol set 900A might be selected randomly and thus might not be adjacent to their respective prior positions within symbol set 800.

Figure 9A:
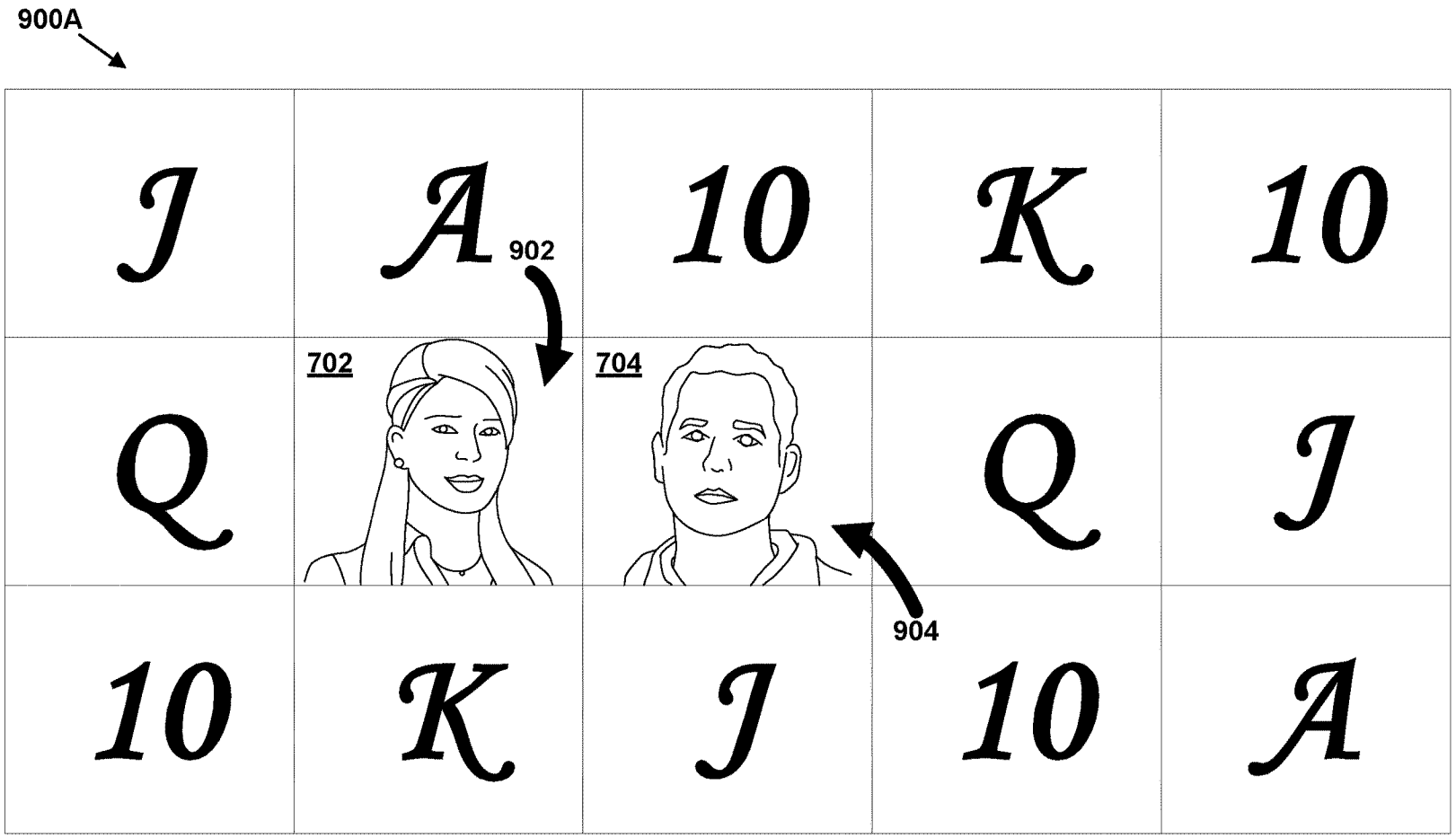
FIG. 9A depicts a further selected symbol set in a display, in accordance with example embodiments.

Next, block 634 includes determining, by machine 100, that the third position is adjacent to the fourth position. For example, processor 112 may determine (i) a difference (i.e., an absolute difference) between the row number in which first trigger symbol 702 is located and the row number in which second trigger symbol 704 is located and (ii) a difference between the column number in which first trigger symbol 702 is located and the column number in which second trigger symbol 704 is located. When (i) the difference between the respective row numbers is less than or equal to one and (ii) the difference between the respective column numbers is less than or equal to one, processor 112 may determine that the third position and the fourth position are adjacent. Processor 112 may thus determine that, for example, the third position C2,R2 of first trigger symbol 702 is adjacent to fourth position C3,R2 of second trigger symbol 704, as shown in FIG. 9A.

Next, block 636 includes, in response to determining that the third position is adjacent to the fourth position, transforming, by machine 100, at least one symbol adjacent to the first trigger symbol or the second trigger symbol into a WILD symbol. The symbols transformed into the WILD symbols may be selected based on the relative positional arrangement between the first trigger symbol and the second trigger symbol when the two are adjacent. In some embodiments, the first trigger symbol and the second trigger symbol may also be transformed into WILD symbols. Alternatively, when the first and second trigger symbols are WILD symbols to being with, they may be maintained as WILD symbols and, in some embodiments, their visual appearance may be modified to indicate the transformation.

Figure 9B:
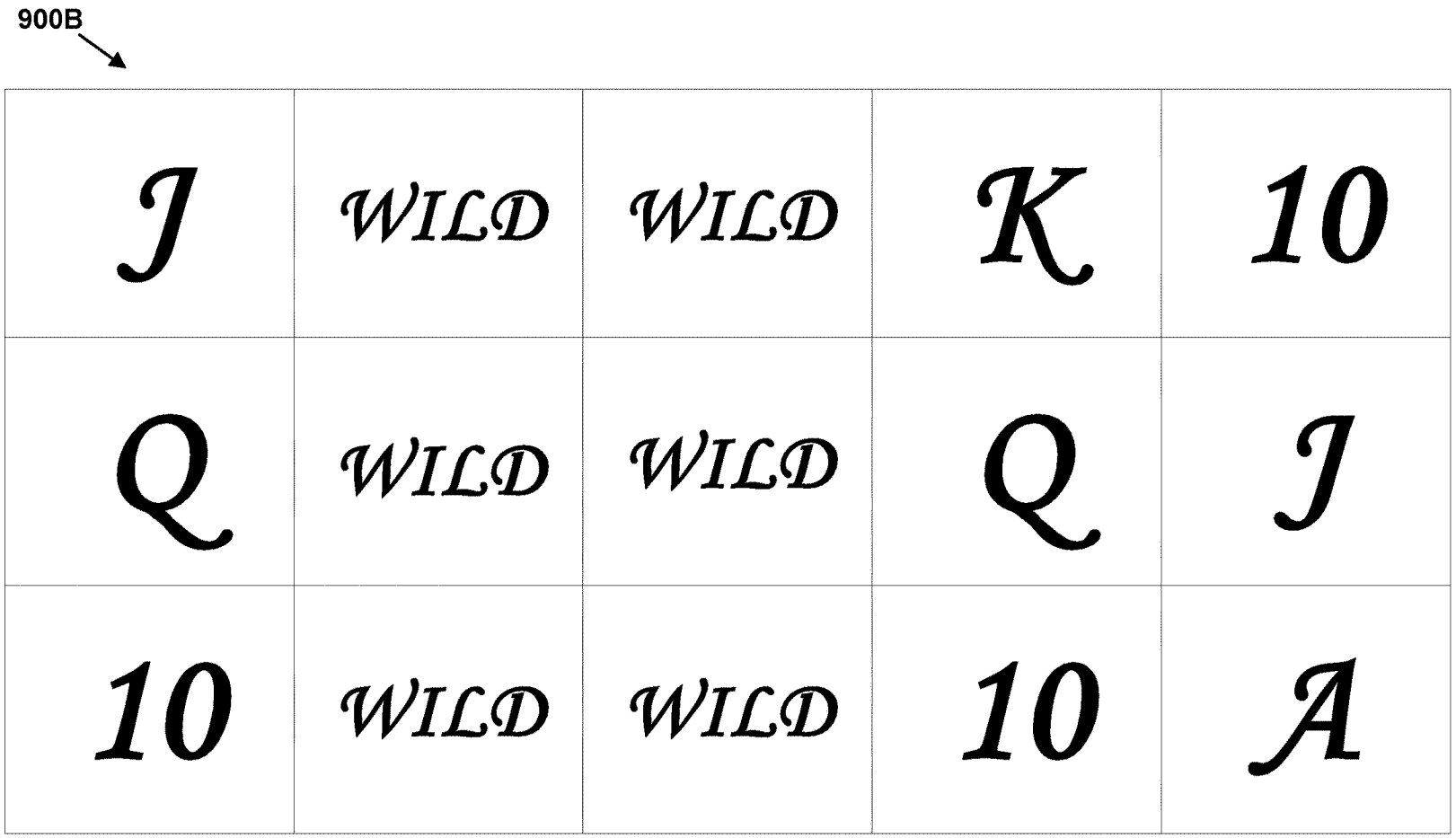
FIG. 9B depicts a transformation of the symbol set of FIG. 9A, in accordance with example embodiments.

Next, block 638 includes displaying, by display 110 of machine 100, the transformation of the at least one symbol adjacent to the first trigger symbol or the second trigger symbol into the WILD symbol. FIG. 9B shows an example transformation of symbols adjacent to the first trigger symbol or the second trigger symbol. Specifically, FIG. 9B shows symbol set 900B that includes all symbols in columns 2 and 3 transformed into WILD symbols. In some embodiments, when the first and second trigger symbols are WILD symbols to begin with, displaying the transformation may include changing a visual appearance of the first and second trigger symbols to indicate the transformation. For example, when the first trigger symbol is a WILD symbol having a first visual appearance and the second trigger symbol is a WILD symbol having a second visual appearance, the transformation may include changing the first and second trigger symbols into WILD symbols having a third visual appearance.

Next, block 640 includes determining, by machine 100, using a stored payout table, a third payout amount associated with the third symbol set including the at least one symbol transformed into the WILD symbol. By transforming the at least one symbol into a WILD symbol, additional winning combinations might be formed that might not have otherwise been possible prior to the transformation. Thus, the symbol transformation at block 636 creates additional potential winning outcomes by introducing additional randomness into an outcome, where the degree of the randomness is based on the positional arrangement of trigger symbols within the symbol set selected for the outcome.

Next, block 642 includes displaying, by display 110 of machine 100, the third payout amount.

Functions of the set 645 can repeat to carry out each remaining outcome of the awarded number of consecutive outcome event in response to machine 100 making the determination of block 628.

As previously mentioned, when a symbol set selected for an outcome event of the number of awarded outcome events includes the first trigger symbol and the second trigger symbol at adjacent arrangement positions, one or more symbols adjacent to the first trigger symbol or the second trigger symbol may be transformed into WILD symbols. The one or more symbols to be transformed into WILD symbols may be selected based on the relative positional arrangement (i.e., the relative position of the first trigger symbol with respect to the second trigger symbol) between the first trigger symbol and the second trigger symbol when the two are adjacent within the selected symbol set.

In particular, FIGS. 9A and 9B illustrate an example transformation from symbol set 900A to symbol set 900B that may result from the first trigger symbol 702 being horizontally adjacent to the second trigger symbol 704 on a pair of adjacent reels. Specifically, when the trigger symbols 702 and 704 are horizontally adjacent to one another on a pair of adjacent reels, all symbols on the pair of adjacent reels, including the trigger symbols 702 and 704, may be transformed into WILD symbols. Notably, symbol set 900B is a transformed version of the symbol set 900A. Symbol set 900B is not an additional, independent symbol set selected for an outcome event. Rather, symbol set 900B is part of the outcome event associated with selection of symbol set 900A.

For example, when trigger symbols 702 and 704 are both in row 2 and in neighboring columns 2 and 3, as shown in FIG. 9A, all symbols in columns 2 and 3 may be transformed into WILD symbols. Notably, all other symbols not included in columns 2 and 3 may remain unchanged. Further, the transformation may take place without determining additional symbol sets for additional outcome events (i.e., without additional spins or iterations of the game).

When trigger symbols 702 and 704 are WILD symbols to begin with, the transformation may include maintaining trigger symbols 702 and 704 as WILD symbols. In some embodiments, when trigger symbols 702 and 704 are WILD symbols having a first and second visual appearance, respectively, the transformation may be shown by transforming all the symbols on the pair of adjacent reels, including the first and second trigger symbols 702 and 704, into WILD symbols having a third visual appearance different from the first visual appearance and the second visual appearance of trigger symbols 702 and 704, respectively.

Regardless of appearance, the WILD symbols may be substitutable for any other symbol within global symbol set to form winning symbol combinations. For example, the WILDs at positions C2,R3 and C3,R3 may substitute for the symbol "10" to form a winning combination with the "10" symbols at arrangement positions C1,R3 and C4,R3. Notably, the example winning symbol combinations are provided herein for illustrative purposes. Additional winning symbol combinations not explicitly enumerated herein may be possible. The example embodiments herein described may operate regardless of the possible symbol patterns (i.e., pay lines) used to form winning combinations. After completion of the outcome event shown in FIGS. 9A and 9B, trigger symbols 702 and 704 may persist until the awarded number of outcome events has been completed. New positions may be selected for trigger symbols 702 and 704 in each outcome event of the awarded number of outcome events.

Figure 10A:
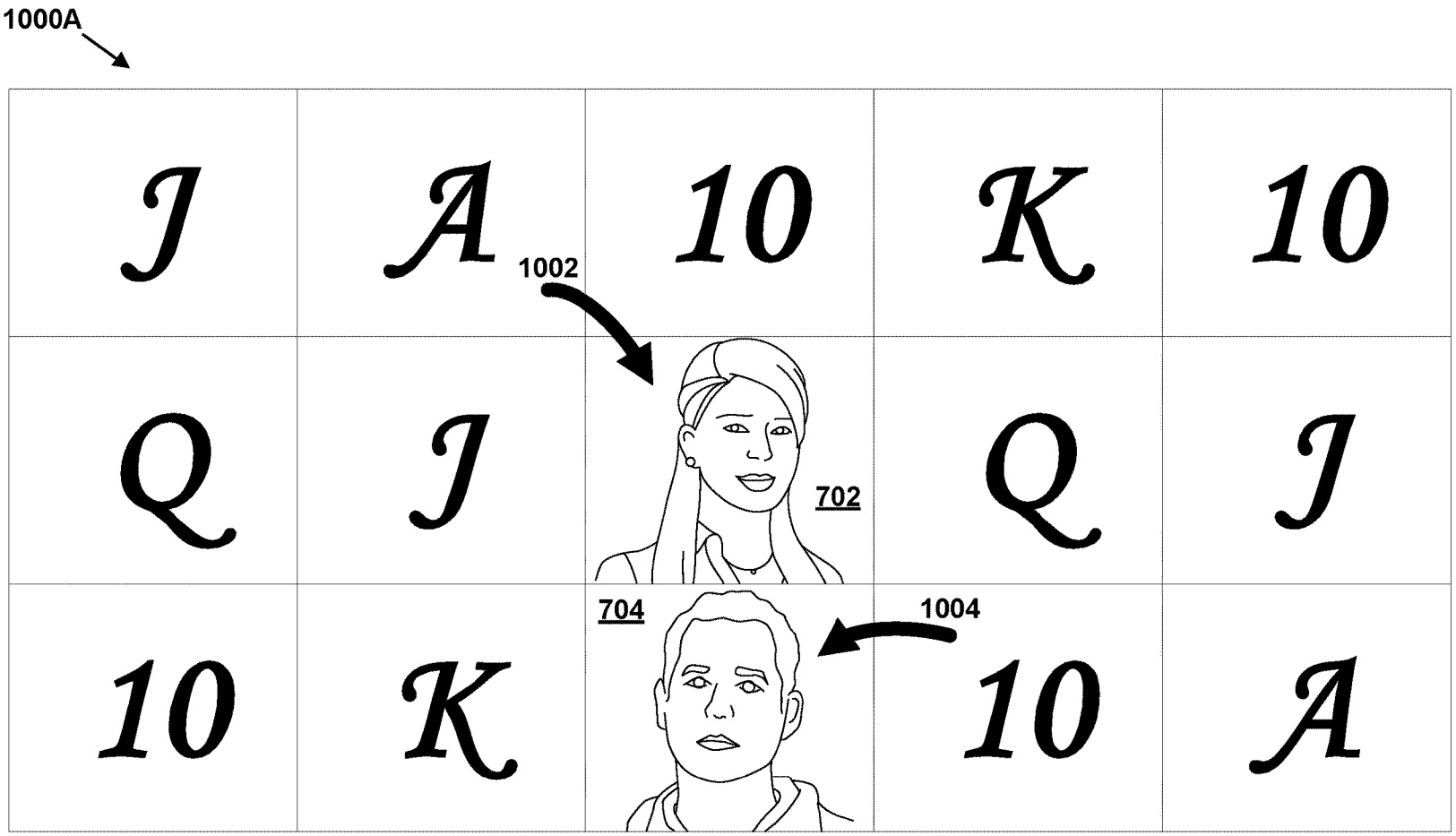
FIG. 10A depicts a yet further selected symbol set in a display, in accordance with example embodiments.
Figure 10B:
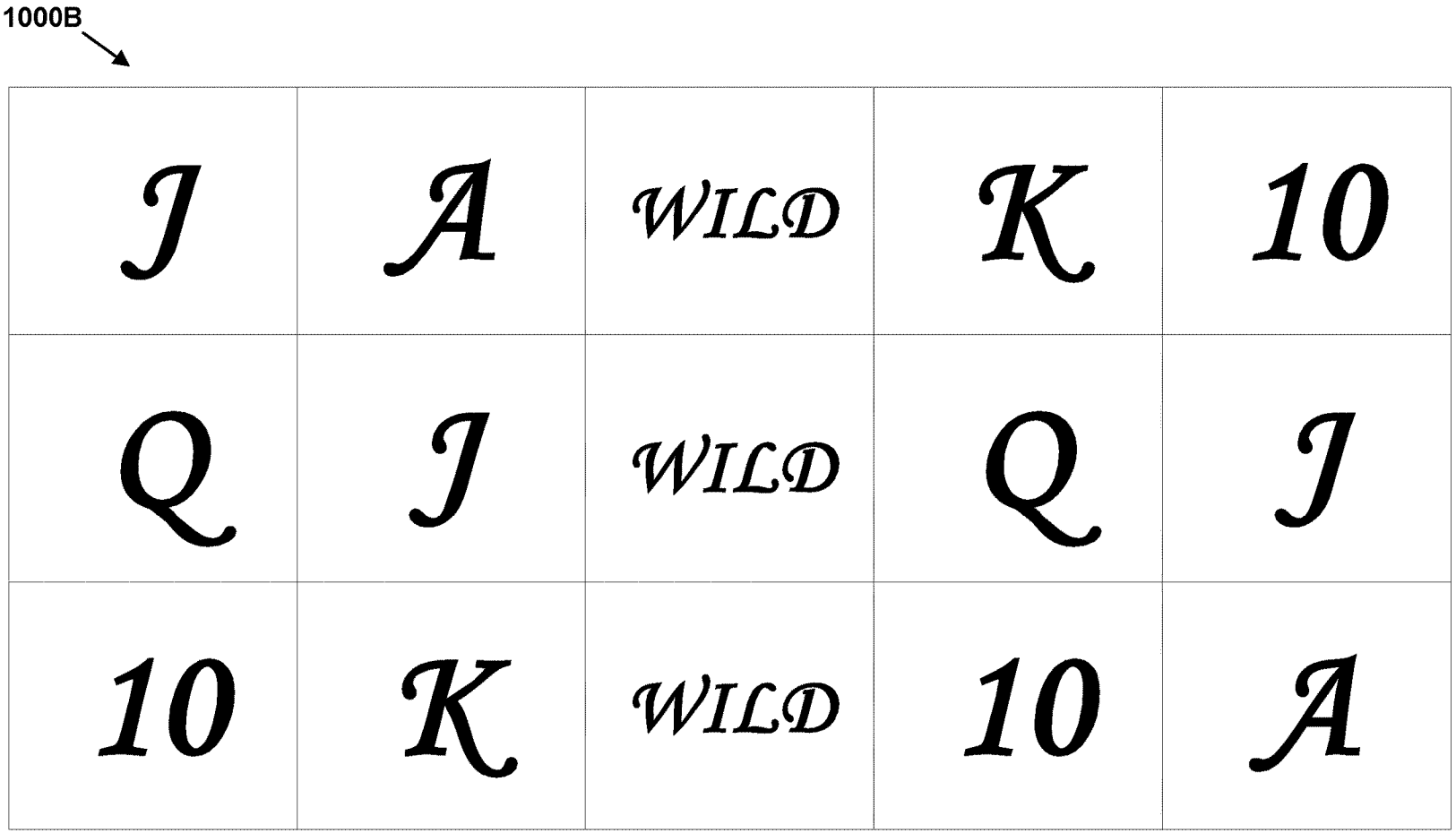
FIG. 10B depicts a transformation of the symbol set of FIG. 10A, in accordance with example embodiments.

FIGS. 10A and 10B illustrate another example symbol transformation resulting from symbol set 1000A including first trigger symbol 702 in a position vertically adjacent to second trigger symbol 704. In particular, symbol set 1000A may be selected for an outcome event following the outcome event shown in FIG. 8. Thus, FIGS. 10A and 10B illustrate an alternative outcome to that shown in FIGS. 9A and 9B. However, generally, symbol sets 1000A and 1000B may equally represent a symbol set for any one of the awarded number of outcome events.

Specifically, first trigger symbol 702 may move from position C2,R1 in symbol set 800 to position C3,R2 in symbol set 1000A, according to arrow 1002, and second trigger symbol 704 may move from position C4,R3 in symbol set 800 to position C3,R3 in symbol set 1000A, according to arrow 1004. Thus, the outcome event shown in FIG. 10A includes trigger symbols 702 and 704 vertically adjacent to one another within the same reel.

In response to trigger symbols 702 and 704 being vertically adjacent to one another within the same reel (i.e., column 3), all symbols within the reel may be transformed into WILD symbols, as illustrated in symbol set 1000B of FIG. 10B. All other symbols (i.e., columns 1, 2, 4, and 5) may remain unchanged and the transformation may take place without selection of a further symbol set. When trigger symbols 702 and 704 are WILD symbols prior to the transformation, the transformation may be handled as described above with respect to FIG. 9B. Namely, trigger symbols 702 and 704 may be maintained as WILD symbols and their visual appearance may be modified to indicate the transformation.

Figure 11A:
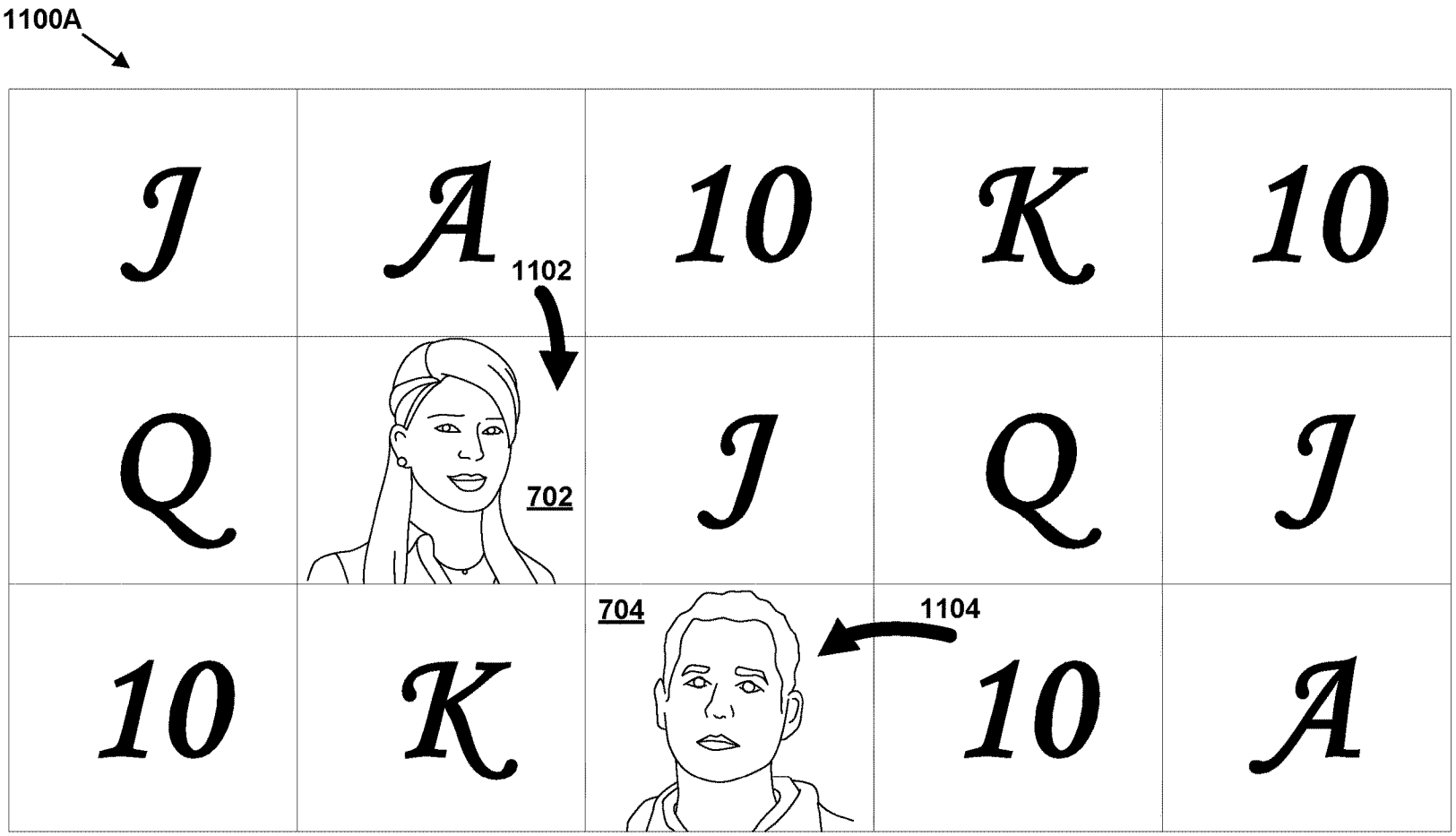
FIG. 11A depicts a yet another selected symbol set in a display, in accordance with example embodiments.
Figure 11B:
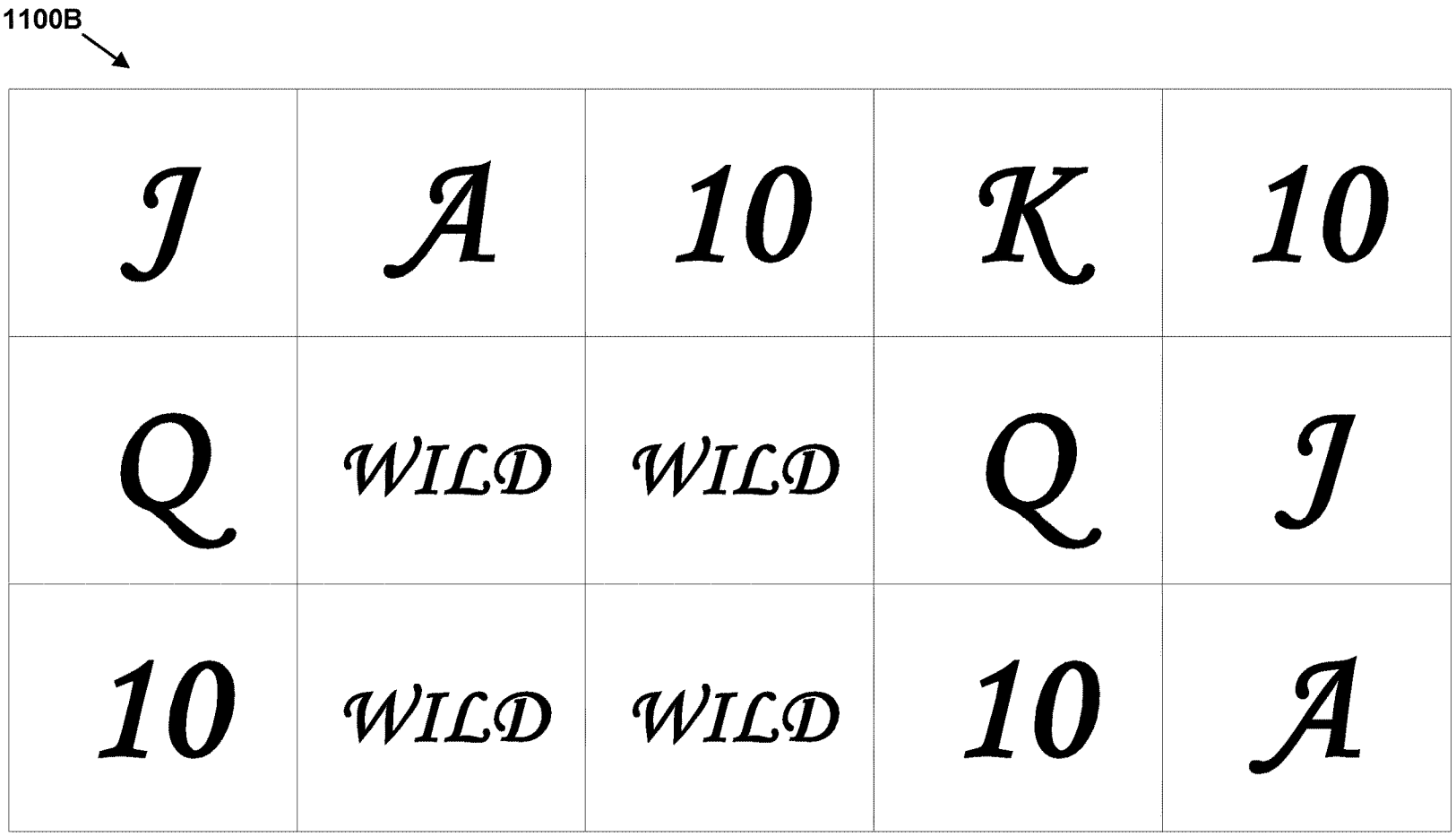
FIG. 11B depicts a transformation of the symbol set of FIG. 11A, in accordance with example embodiments.

FIGS. 11A and 11B illustrate a further example symbol transformation resulting from symbol set 1100A including first trigger symbol 702 in a position diagonally adjacent to second trigger symbol 704. Again, symbol set 1100A may be selected for an outcome event following the outcome event shown in FIG. 8. Thus, FIGS. 11A and 11B illustrate an alternative outcome to those shown in FIGS. 9A, 9B, 10A, and 10B. However, generally, symbol sets 1100A and 1100B may equally represent a symbol set for any one of the awarded number of outcome events.

Specifically, first trigger symbol 702 may move from position C2,R1 in symbol set 800 to position C2,R2 in symbol set 1100A, according to arrow 1102, and second trigger symbol 704 may move from position C4,R3 in symbol set 800 to position C3,R3 in symbol set 1100A, according to arrow 1104. Thus, the outcome event shown in FIG. 11A includes trigger symbols 702 and 704 diagonally adjacent to one another.

In response to trigger symbols 702 and 704 being diagonally adjacent to one another, all symbols within a 2×2 grid containing the first and second trigger symbols 702 and 704 (i.e., symbols at positions C2,R2, C2,R3, C3,R2, and C3,R3) may be transformed into WILD symbols, as illustrated in symbol set 1100B of FIG. 11B. Again, all other symbols may remain unchanged and the transformation may take place without selection of a further symbol set. When trigger symbols 702 and 704 are WILD symbols prior to the transformation, the transformation may be handled as described above with respect to FIG. 9B. Namely, trigger symbols 702 and 704 may be maintained as WILD symbols and their visual appearance may be modified to indicate the transformation.

Figure 12A:
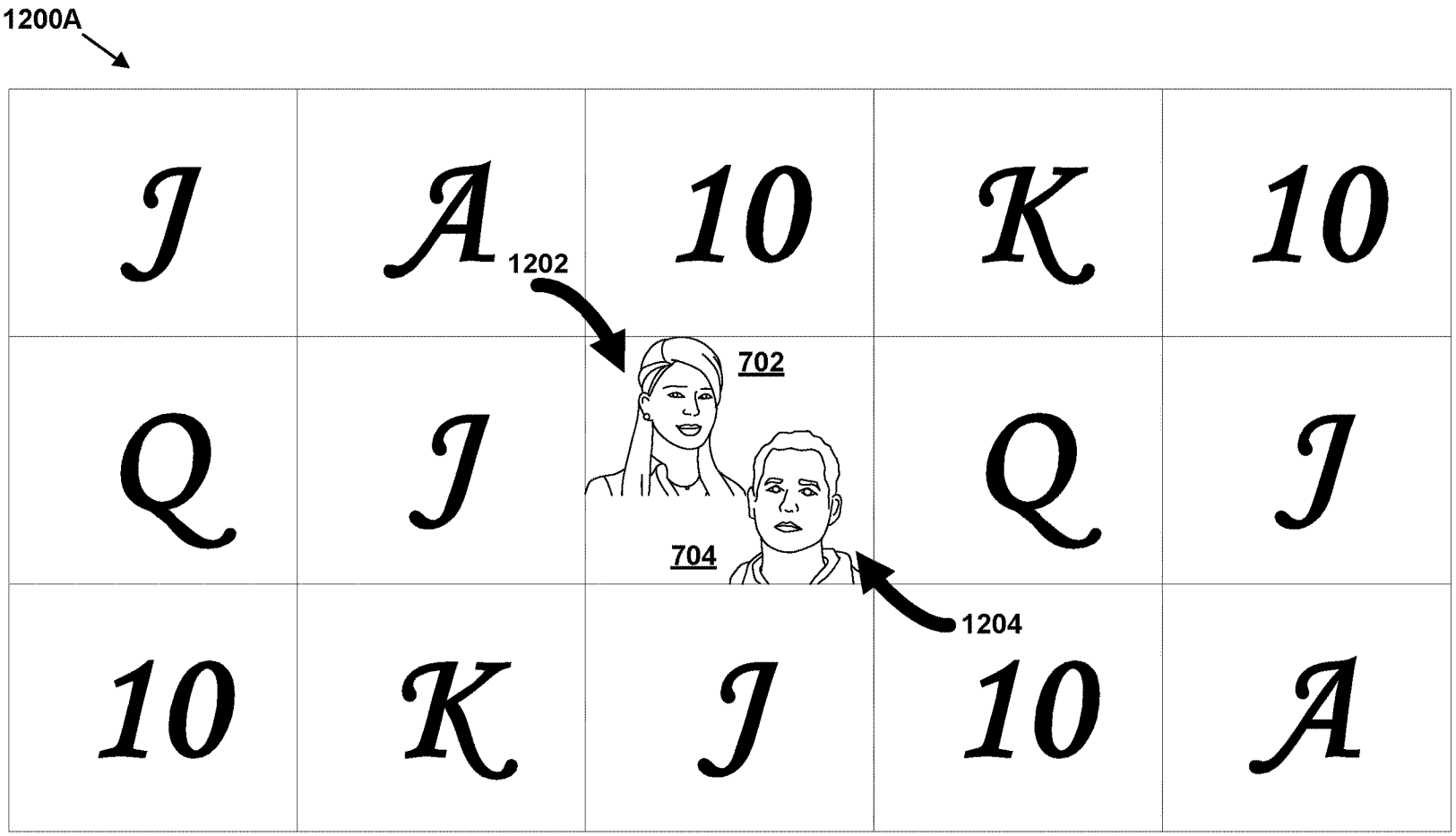
FIG. 12A depicts another additional selected symbol set in a display, in accordance with example embodiments.
Figure 12B:
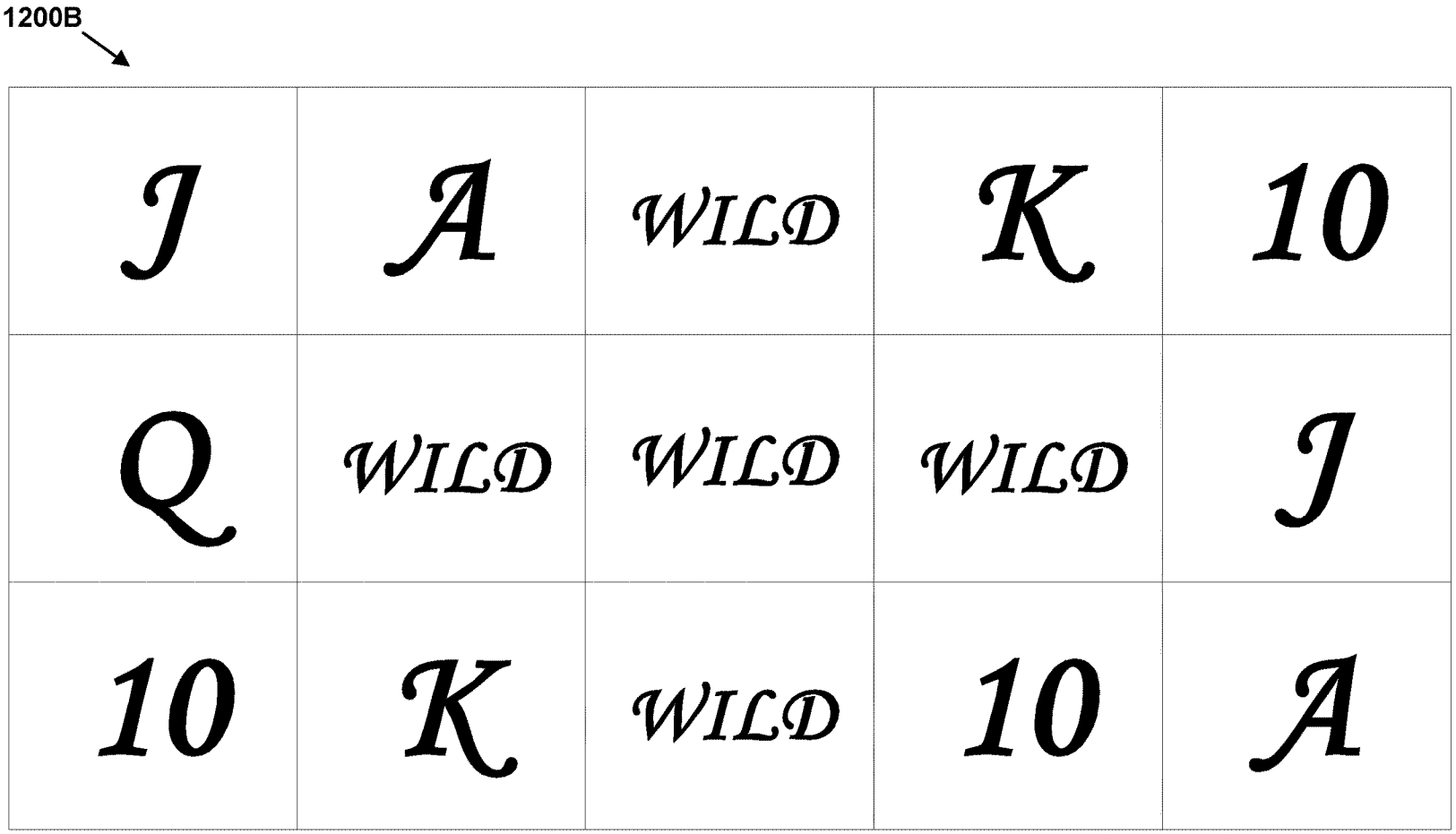
FIG. 12B depicts a transformation of the symbol set of FIG. 12A, in accordance with example embodiments.

FIGS. 12A and 12B illustrate a yet further example symbol transformation resulting from symbol set 1200A including first trigger symbol 702 in the same position as (i.e., overlapping with) second trigger symbol 704. Symbol set 1200A may be selected for an outcome event following the outcome event shown in FIG. 8. Thus, FIGS. 12A and 12B illustrate an alternative outcome to those shown in FIGS. 9A, 9B, 10A, 10B, 11A, and 11B. However, generally, symbol sets 1200A and 1200B may equally represent a symbol set for any one of the awarded number of outcome events.

Specifically, first trigger symbol 702 may move from position C2,R1 in symbol set 800 to position C3,R2 in symbol set 1200A, according to arrow 1202, and second trigger symbol 704 may move from position C4,R3 in symbol set 800 to position C3,R2 in symbol set 1200A, according to arrow 1204. Thus, the outcome event shown in FIG. 12A includes trigger symbols 702 and 704 in the same (i.e., overlapping) position.

In response to trigger symbols 702 and 704 overlapping one another, all symbols within a predetermined pattern around the overlapping first and second trigger symbols 702 and 704 may be transformed into WILD symbols. For example, symbols directly above and below (if any) and symbols directly to the left and right (if any) of the position of overlapping first and second trigger symbols 702 and 704 may be transformed into WILD symbols, as illustrated in symbol set 1200B of FIG. 12B. Again, all other symbols may remain unchanged and the transformation may take place without selection of a further symbol set. Other transformation patterns may be possible. When trigger symbols 702 and 704 are WILD symbols prior to the transformation, the transformation may be handled as described above with respect to FIG. 9B. Namely, trigger symbols 702 and 704 may be maintained as WILD symbols and their visual appearance may be modified to indicate the transformation.

FIGS. 9A, 9B, 10A, 10B, 11A, 11B, 12A, and 12B illustrate example symbol transformations that may take place in response to first trigger symbol 702 and second trigger symbol 704 being in adjacent arrangement positions of a selected symbol set. However, other symbol transformations not explicitly enumerated herein may be possible. The positional arrangement of the first and second trigger symbols 702 and 704 when the two are adjacent may determine the number and positions of the symbols to be transformed into WILD symbols. In particular, each possible positional arrangement of the trigger symbols may be associated with a predetermined transformation pattern of symbols within the selected symbol set.

Further, in addition to symbol transformations, additional awards may be provided in response to the first and second trigger symbols 702 and 704 being adjacent within a selected symbol set. The awards may include, for example, cash prizes, win multipliers, or free spins, among other possibilities. For example, when trigger symbols 702 and 704 are overlapping, a payout associated with each winning symbol combination within the selected symbol set may be multiplied by a win multiplier (e.g., a win multiplier of 3).

In some embodiments, additional positional arrangements (e.g., other than adjacent arrangements) of the first and second trigger symbols may be used to trigger symbol transformations or the award of a prize. For example, when the first and second trigger symbols are in the same row but are separated by one column therebetween, the symbol positioned between the first and second trigger symbols within the one column may be transformed into a WILD symbol. Thus, in some examples, a transformation of symbols into WILD symbols may be triggered when the first and second trigger symbols are non-adjacent but are within a predetermined positional arrangement configured to trigger the transformation.

Further, in some embodiments, additional trigger symbols may be awarded as part of the awarded number of consecutive outcome events. For example, three trigger symbols may be awarded. Accordingly, the predetermined positional arrangements that trigger the transformation of symbols into WILD symbols may comprise positional arrangements of three trigger symbols. Further, in some embodiments, additional trigger symbols may randomly appear and may be accumulated over the course of the awarded number of outcomes.

Notably, the operations of transforming, replacing, reordering, adding, and/or removing symbols from a reel of a reel-based game (e.g., the operations of blocks 634-640, as just some possible examples), necessitate computer implementation. In a mechanical reel-based game, the symbols appearing on each reel are fixed and cannot be changed mid-game. In contrast, the computer implementation herein allows the number of symbols per reel to be changed, as well as the symbols appearing on each reel to be replaced and/or re-ordered and/or to be changed during a game based on cross-dependency with the symbols of other reels. These changes can occur mid-game, for example between spins of the reels or at the end of a game, for example after a spin and based on the symbols identified for the different reels. Consequently, these features of the disclosure herein would not exist but for computer technology.

Particularly, the embodiments herein solve a technical problem of how to add movement and dynamic symbol transformation to individual symbols of a reel-based game and further unpredictability in the reel-based game. The operations of transforming, replacing, reordering, adding, and/or removing symbols from a reel would be prohibitively complex and expensive to implement on a traditional machine with mechanical reels. In effect, the present approach can be seen as providing an implementation which increases the number and variety of possible outcomes in a random selection of data entries based on a reel-based game of luck.

For example, embodiments that involve transforming, based on a position of a first trigger symbol being adjacent to a position of a second trigger symbol, at least one symbol adjacent to the first trigger symbol or the second trigger symbol into a WILD symbol without further spinning of the reels clearly involve a computerized implementation. In particular, computerized implementation is necessitated because the at least one symbol in the selected symbol set is transformed into a WILD symbol while the reels are static and while other symbols within the selected symbol set remain unchanged. Further, the position of the at least one symbol transformed into the WILD symbol is dynamically selected based on the relative positional arrangement of the first and second trigger symbols when they become adjacent within a selected symbol set. Specifically, the relative positional arrangement of the first and second trigger symbols dynamically determines the number and positions of the symbols to be transformed into WILD symbols. In a traditional machine with mechanical reels, transforming a subset of symbols within a symbol set would require an additional spin of the reels which would likely also change symbols other than the symbols selected to be transformed. Alternatively, transforming the subset of symbols into WILD symbols would involve physical replacement of the symbols that would not be feasible while playing the reel-based game.

Additionally, selecting, for the trigger symbol, a position that is adjacent to a position of the trigger symbol in a preceding outcome event, necessitates storing in memory the position of the trigger symbol in the preceding outcome event. In contrast, traditional gaming machines are memoryless and the symbols selected for sequential outcome events are random.

Further, the positions of the first and second trigger symbols may, in some examples, be overlapping to generate additional outcomes. A computerized implementation is necessitated to generate an outcome with such overlapping and display a modified representation of the first and second trigger symbols overlapping to indicate the overlapping condition. In a traditional machine with mechanical reels, overlapping of trigger symbols and dynamically modifying their appearance when overlapping occurs would not be possible due to the mechanical nature of the reels. Thus, to allow dynamic transformation of symbols into WILD symbols, as well as the other features described herein, a computerized implementation is necessary to allow for transforming, replacing, reordering, storing, adding, and/or removing of individual symbols on each of the reels.

Further, these features are an improvement to reel-based gaming technology. Since the symbols appearing on each reel are fixed and cannot be changed mid-game in mechanical reel-based games, the operations of replacing, reordering, adding, and/or removing symbols from a reel could not appear in such games. Due to this technological limitation, players may become disinterested in these basic reel-based games. Computer implementation, however, facilitates the integration of these features into reel-based games, resulting in game dynamics that would otherwise be unavailable. Consequently, the disclosure herein is a technological improvement to reel-based games.

IV. Example Operations

FIGS. 13A-13D depict a flow chart showing a set of operations 1300 (or more simply, "the set 1300") that can, for example, be carried out using server machine 100*a*. The set 1300 may, for example, be carried out by server 100*a* on behalf of one or more client machines 100*b*. Note that several of the operations described in connection with FIGS. 13A-13D parallel operations described in connection with FIGS. 6A-6D. As such, variations of the operations described in connection with FIGS. 6A-6D are likewise applicable to the operations described in connection with FIGS. 13A-13D. However, for the sake of brevity, these variations are not repeated. The server machine 100*a*, in performing the set 1300, can perform the operations described above with respect to machine 100.

Figure 13A:
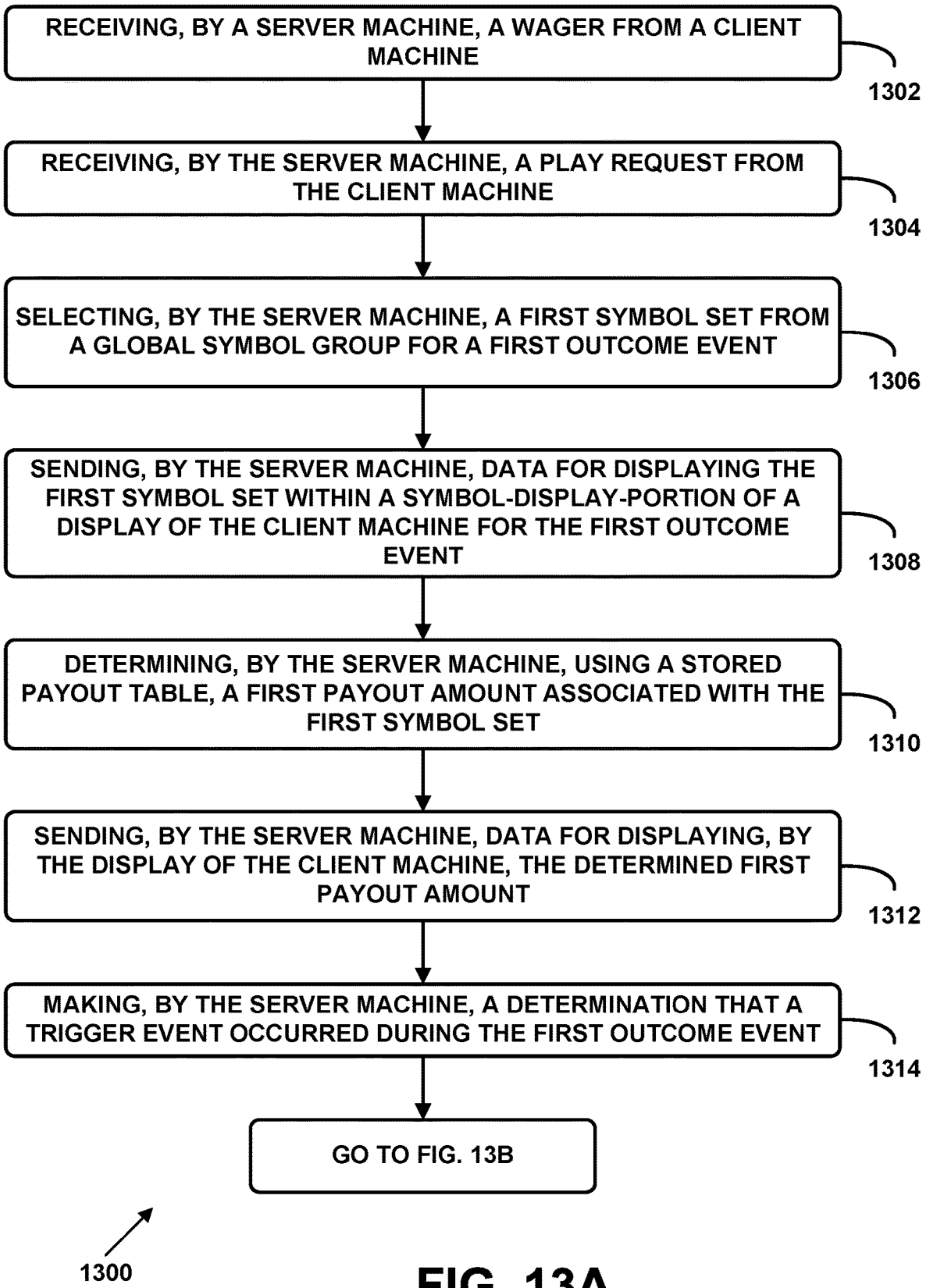
FIG. 13A is a first part of a flow chart, in accordance with example embodiments.

Turning to FIG. 13A, block 1302 includes receiving, by server machine 100*a*, a wager from a client machine 100*b*.

Next, block 1304 includes receiving, by server machine 100*a*, a play request from client machine 100*b*.

Next, block 1306 includes selecting, by server machine 100*a*, a first symbol set from a global symbol group for a base outcome event.

Next, block 1308 includes sending, by server machine 100*a*, data for displaying the first symbol set within a symbol-display-portion of a display 110*b* of client machine 100*b* for the first outcome event.

Next, block 1310 includes determining, by server machine 100*a*, using a stored payout table, a first payout amount associated with the first symbol set.

Next, block 1312 includes sending, by server machine 100*a*, data for displaying, by display 110*b* of client machine 100*b*, the determined first payout amount.

Next, block 1314 includes making, by server machine 100*a*, a determination that a trigger event occurred during the first outcome event.

Figure 13B:
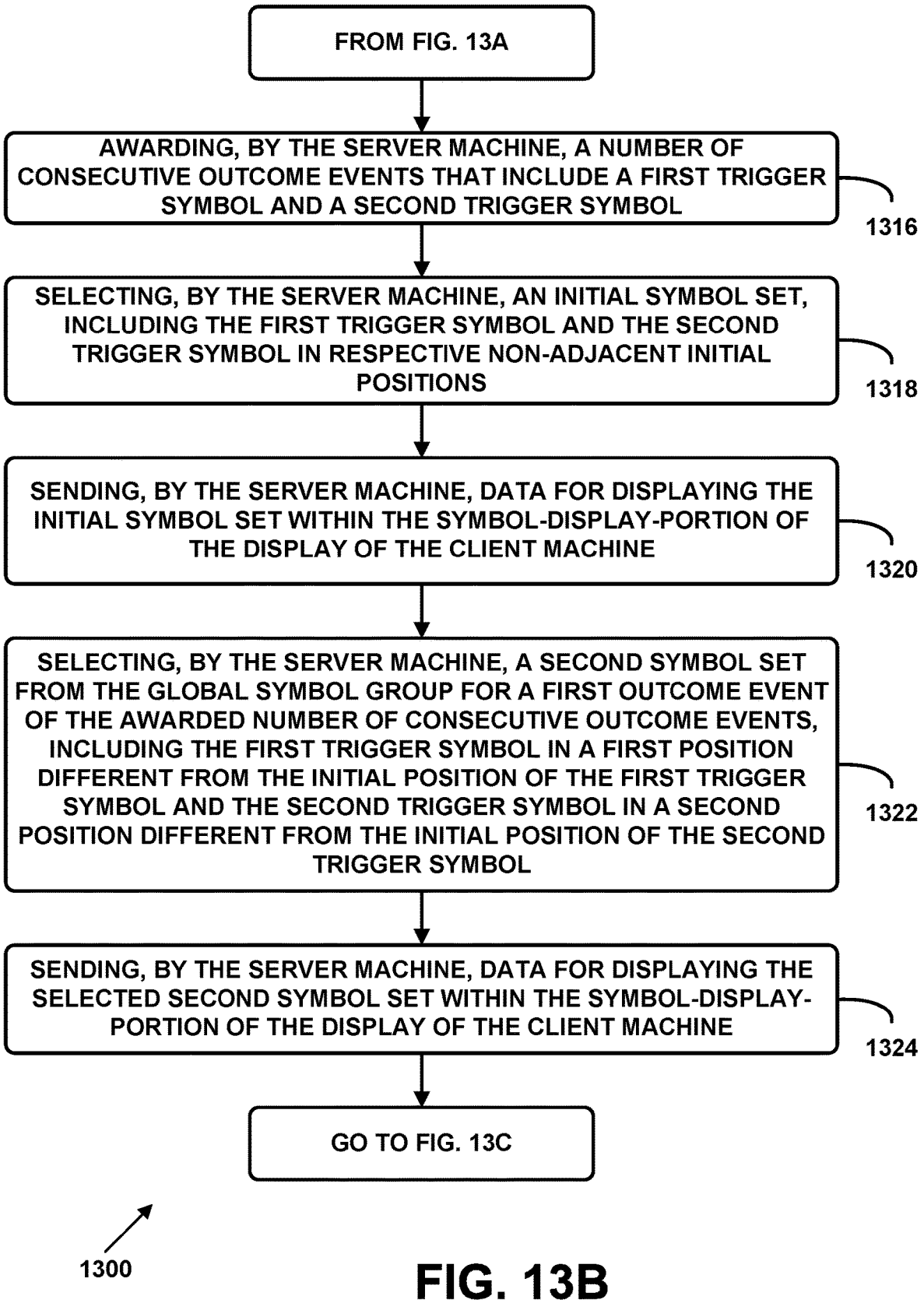
FIG. 13B is a second part of the flow chart of FIG. 13A, in accordance with example embodiments.

Turning to FIG. 13B, block 1316 includes awarding, by server machine 100*a*, a number of consecutive outcome events that include a first trigger symbol and a second trigger symbol.

Next, block 1318 includes selecting, by server machine 100*a*, an initial symbol set. The initial symbol set includes the first trigger symbol and the second trigger symbol in respective non-adjacent initial positions. Selecting the initial symbol set may include determining, by server machine 100*a*, the respective non-adjacent initial positions for the first trigger symbol and the second trigger symbol.

Next, block 1320 includes sending, by server machine 100*a*, data for displaying the initial symbol set within the symbol-display-portion of display 110*b* of client machine 100*b*. Displaying the initial symbol set may involve displaying the first trigger symbol and the second trigger symbol at the respective non-adjacent initial positions within the symbol-display-portion of display 110*b* of client machine 100*b*.

Next, block 1322 includes selecting, by server machine 100*a*, a second symbol set from the global symbol group for a first outcome event of the awarded number of consecutive outcome events. The second symbol set includes the first trigger symbol in a first position different from the initial position of the first trigger symbol and the second trigger symbol in a second position different from the initial position of the second trigger symbol.

Next, block 1324 includes sending, by server machine 100*a*, data for displaying the selected second symbol set within the symbol-display-portion of display 110*b* of client machine 100*b*.

Figure 13C:
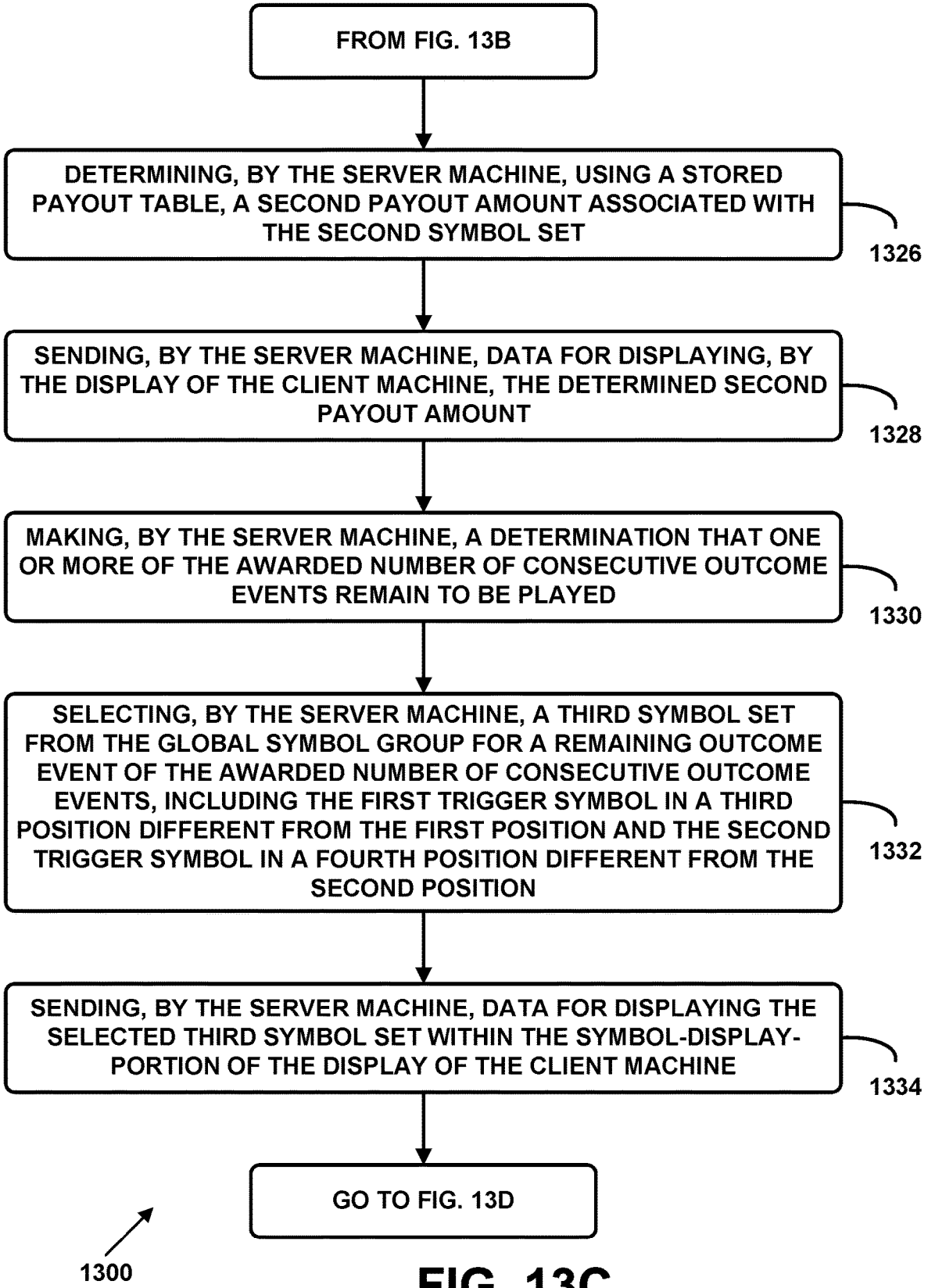
FIG. 13C is a third part of the flow chart of FIG. 13A, in accordance with example embodiments.

Turning to FIG. 13C, block 1326 includes determining, by server machine 100*a*, using a stored payout table, a second payout amount associated with the second symbol set.

Next, block 1328 includes sending, by server machine 100*a*, data for displaying, by display 110*b* of client machine 100*b*, the determined second payout amount.

Next, block 1330 includes making, by server machine 100*a*, a determination that one or more of the awarded number of consecutive outcome events remain to be played.

Next, block 1332 includes selecting, by server machine 100*a*, a third symbol set from the global symbol group for a remaining outcome event of the awarded number of consecutive outcome events. The third symbol set includes the first trigger symbol in a third position different from the first position and the second trigger symbol in a fourth position different from the second position.

Next, block 1334 includes sending, by server machine 100*a*, data for displaying the selected third symbol set within the symbol-display-portion of display 110*b* of client machine 100*b*.

Figure 13D:
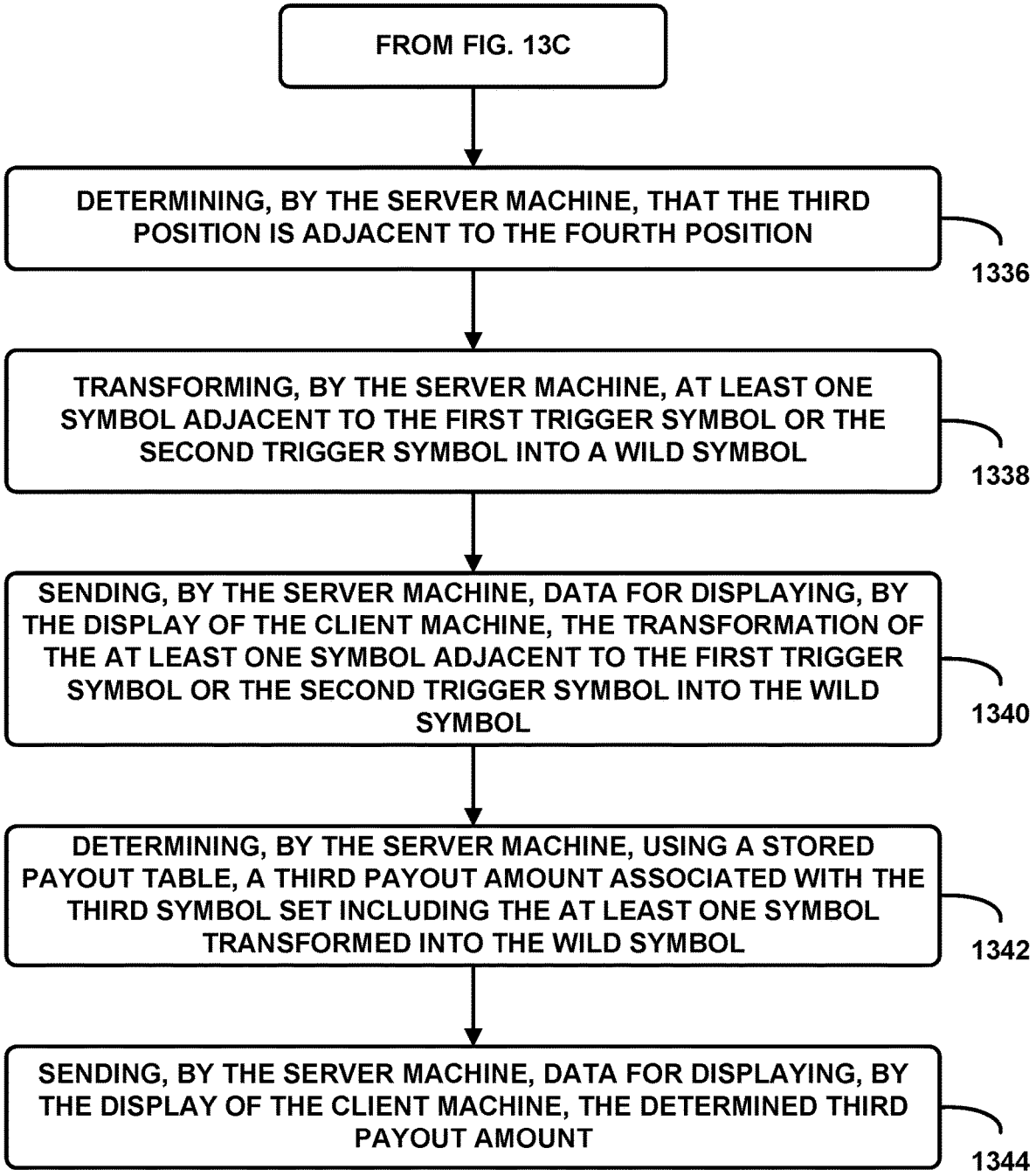
FIG. 13D is a fourth part of the flow chart of FIG. 13A, in accordance with example embodiments.

Turning to FIG. 13D, block 1336 includes determining, by server machine 100*a*, that the third position is adjacent to the fourth position.

Next, block 1338 includes, in response to determining that the third position is adjacent to the fourth position, transforming, by server machine 100*a*, at least one symbol adjacent to the first trigger symbol or the second trigger symbol into a WILD symbol.

Next, block 1340 includes sending, by server machine 100*a*, data for displaying, by display 110*b* of client machine 100*b*, the transformation of the at least one symbol adjacent to the first trigger symbol or the second trigger symbol into the WILD symbol.

Next, block 1342 includes determining, by server machine 100*a*, using a stored payout table, a third payout amount associated with the third symbol set including the at least one symbol transformed into the WILD symbol.

Next, block 1344 includes sending, by server machine 100*a*, data for displaying, by display 110*b* of client machine 100*b*, the determined third payout amount.

FIGS. 14A-14D depict a flow chart showing a set of operations 1400 (or more simply, "the set 1400") that can, for example, be carried out using client machine 100*b*. Note that several of the operations described in connection with FIGS. 14A-14D parallel operations described in connection with FIGS. 6A-6D and FIGS. 13A-13D. As such, variations of the operations described in connection with FIGS. 6A-6D and FIGS. 13A-13D are likewise applicable to the operations described in connection with FIGS. 14A-14D. However, for the sake of brevity, these variations are not repeated. The client machine 100*b*, in performing the set 1400, can perform the operations described above with respect to machine 100.

Figure 14A:
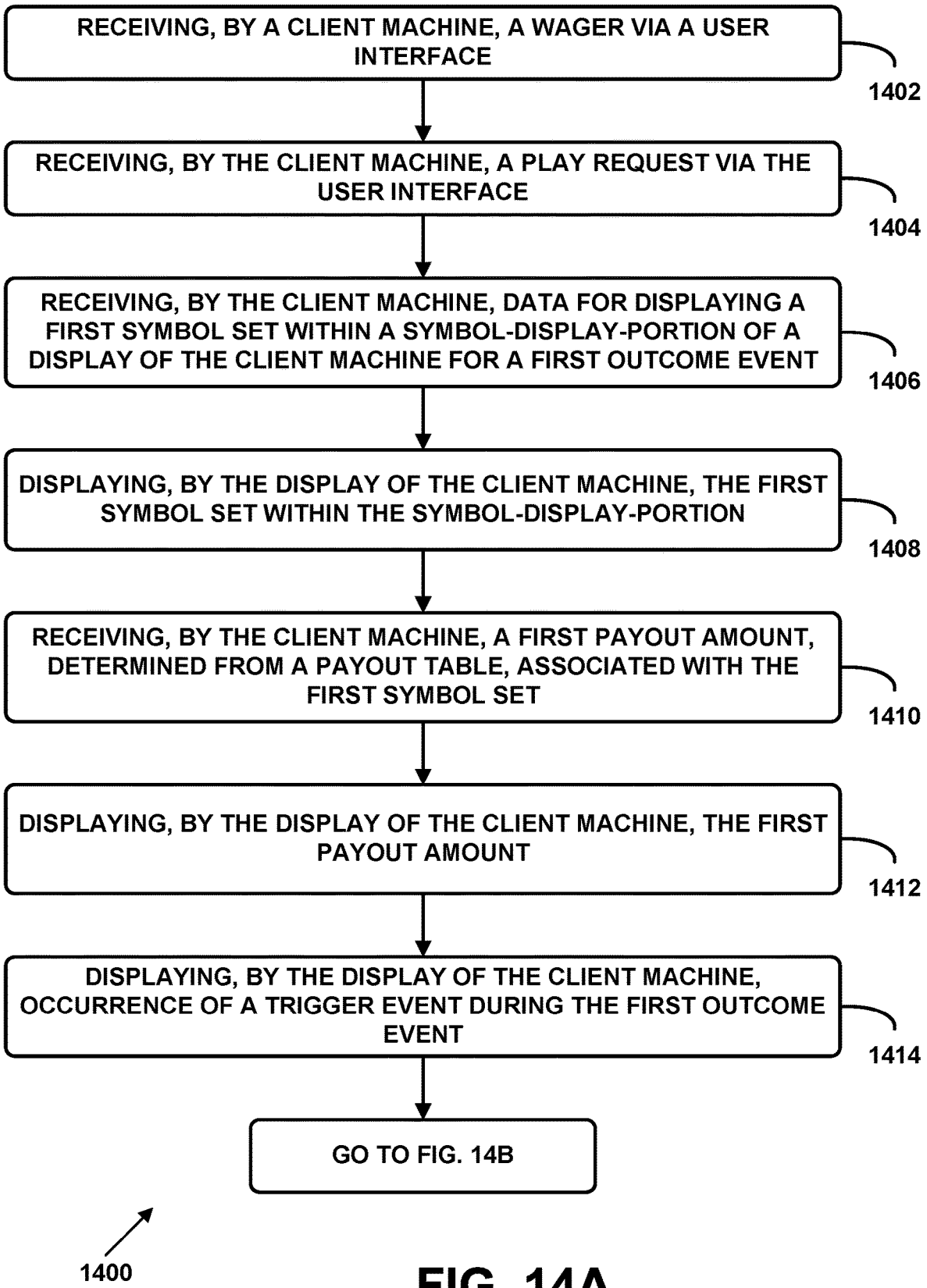
FIG. 14A is a first part of a flow chart, in accordance with example embodiments.

Turning to FIG. 14A, block 1402 includes receiving, by client machine 100*b*, a wager via user interface 104*b*.

Next, block 1404 includes receiving, by client machine 100*b*, a play request via user interface 104*b*.

Next, block 1406 includes receiving, by client machine 100*b*, data for displaying a first symbol set within a symbol-display-portion of display 110*b* of client machine 100*b* for a first outcome event.

Next, block 1408 includes displaying, by display 110*b* of client machine 100*b*, the first symbol set within the symbol-display-portion.

Next, block 1410 includes receiving, by client machine 100*b*, a first payout amount, determined from a payout table, associated with the first symbol set.

Next, block 1412 includes displaying, by display 110*b* of client machine 100*b*, the first payout amount.

Next, block 1414 includes displaying, by display 110*b* of client machine 100*b*, occurrence of a trigger event during the first outcome event.

Figure 14B:
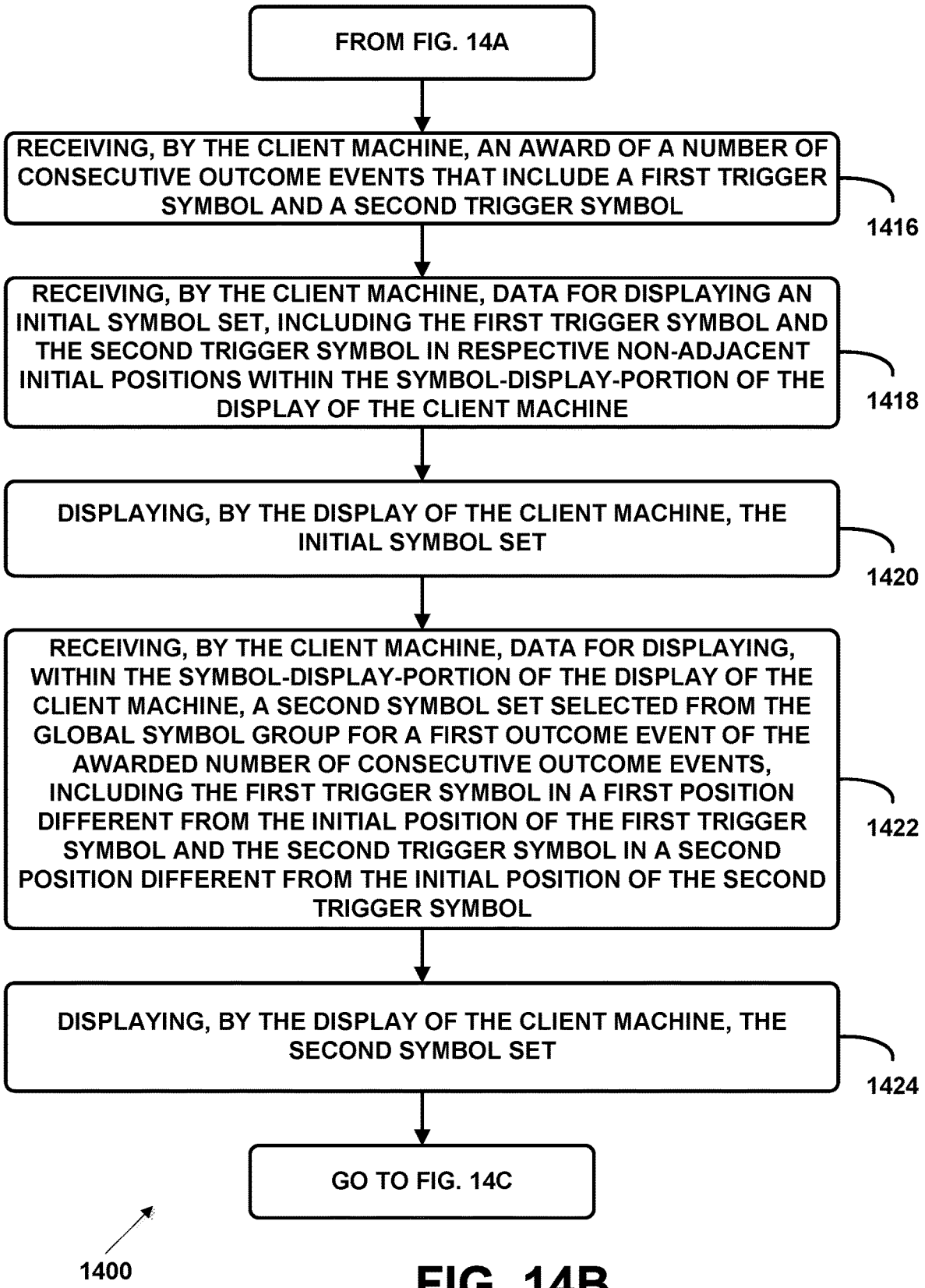
FIG. 14B is a second part of the flow chart of FIG. 14A, in accordance with example embodiments.

Turning to FIG. 14B, block 1416 includes receiving, by client machine 100*b*, an award of a number of consecutive outcome events that include a first trigger symbol and a second trigger symbol.

Next, block 1418 includes receiving, by client machine 100*b*, data for displaying an initial symbol set. The initial symbol set includes the first trigger symbol and the second trigger symbol in respective non-adjacent initial positions within the symbol-display-portion of display 110*b* of client machine 100*b*.

Next, block 1420 includes displaying, by display 110*b* of client machine 100*b*, the initial symbol set, including the first trigger symbol and the second trigger symbol at the respective non-adjacent initial positions.

Next, block 1422 includes receiving, by client machine 100*b*, data for displaying, within the symbol-display-portion of display 110*b* of client machine 100*b*, a second symbol set selected from the global symbol group for a first outcome event of the awarded number of consecutive outcome events. The second symbols set includes the first trigger symbol in a first position different from the initial position of the first trigger symbol and the second trigger symbol in a second position different from the initial position of the second trigger symbol.

Next, block 1424 includes displaying, by display 110*b* of client machine 100*b*, the second symbol set.

Figure 14C:
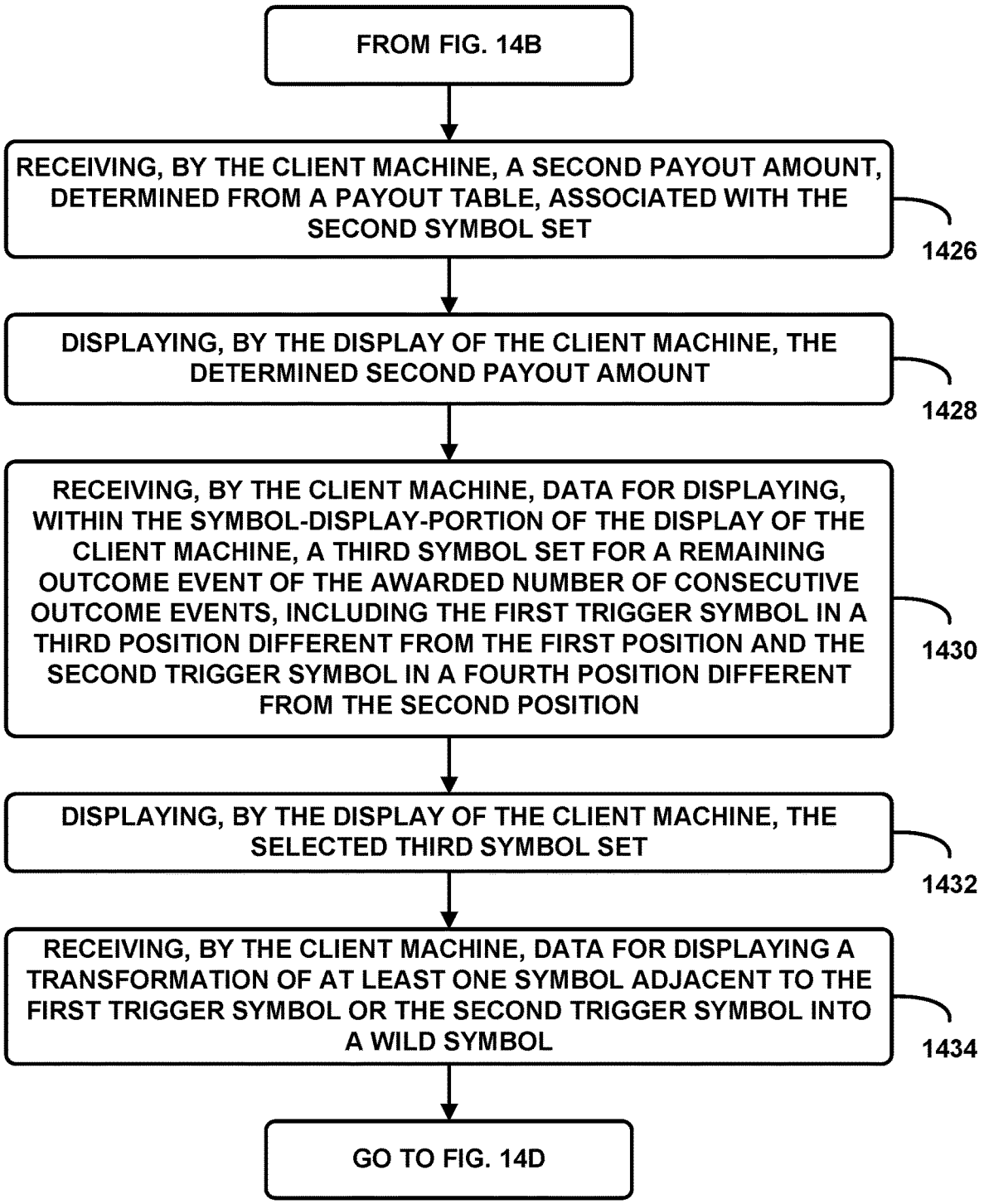
FIG. 14C is a third part of the flow chart of FIG. 14A, in accordance with example embodiments.

Turning to FIG. 14C, block 1426 includes receiving, by client machine 100*b*, a second payout amount, determined from a payout table, associated with the second symbol set.

Next, block 1428 includes displaying, by display 110*b* of client machine 100*b*, the determined second payout amount.

Next, block 1430 includes receiving, by client machine 100*b*, data for displaying, within the symbol-display-portion of display 110*b* of client machine 100*b*, a third symbol set for a remaining outcome event of the awarded number of consecutive outcome events. The third symbol set includes the first trigger symbol in a third position different from the first position and the second trigger symbol in a fourth position different from the second position.

Next, block 1432 includes displaying, by display 110*b* of client machine 100*b*, the selected third symbol set.

Next, block 1434 includes receiving, by client machine 100*b*, data for displaying a transformation of at least one symbol adjacent to the first trigger symbol or the second trigger symbol into a WILD symbol.

Figure 14D:
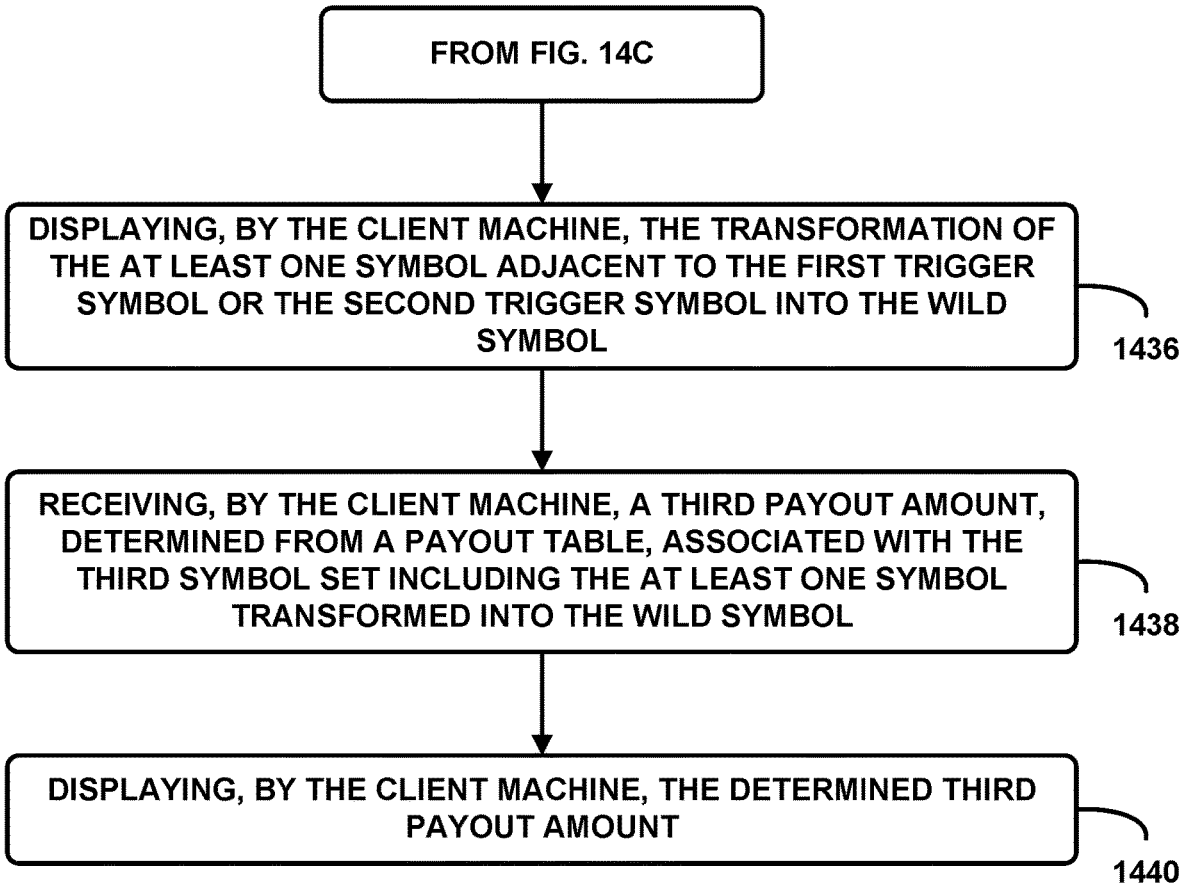
FIG. 14D is a fourth part of the flow chart of FIG. 14A, in accordance with example embodiments.

Turning to FIG. 14D, block 1436 includes displaying, by display 100*b* of client machine 100*b*, the transformation of the at least one symbol adjacent to the first trigger symbol or the second trigger symbol into the WILD symbol.

Next, block 1438 includes receiving, by client machine 100*b*, a third payout amount, determined from a payout table, associated with the third symbol set including the at least one symbol transformed into the WILD symbol.

Next, block 1440 includes displaying, by display 110*b* of client machine 100*b*, the determined third payout amount.

Figure 15:
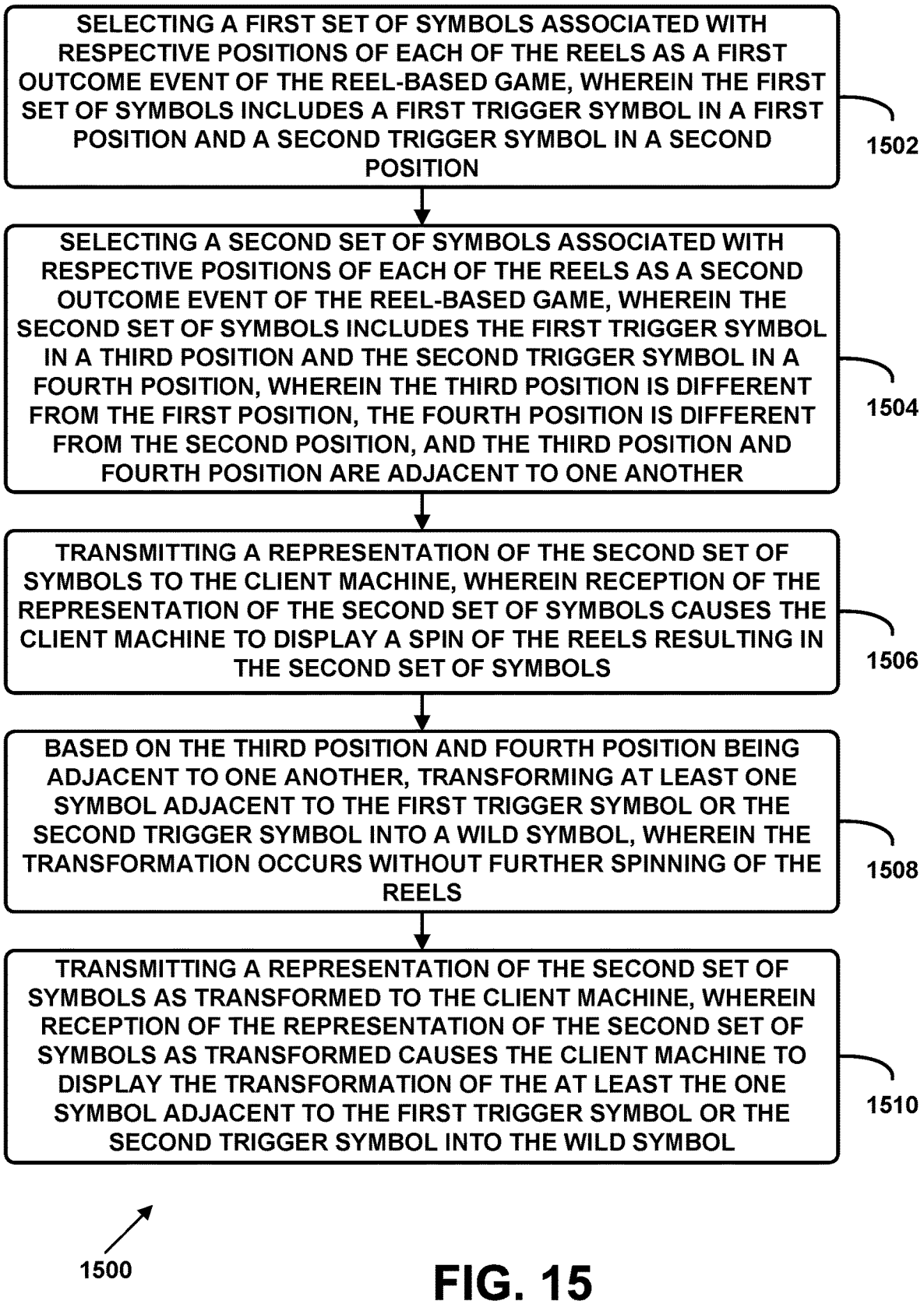
FIG. 15 is a flow chart, in accordance with example embodiments.

FIG. 15 depicts a flow chart showing a set of operations 1500 (or more simply, "the set 1500") that can, for example, be carried out using server machine 100*a* and/or client machine 100*b*. To the extent that a client machine carries out any of the set 1500, these operations may also include displaying various types of information, such as symbol sets, payout amounts, and so on. Note that several of the operations described in connection with FIG. 15 parallel operations described in connection with FIGS. 6A-6D, FIGS. 13A-13D, and FIGS. 14A-14D. As such, variations of the operations described in connection with FIGS. 6A-6D, FIGS. 13A-13D, and FIGS. 14A-14D are likewise applicable to the operations described in connection with FIG. 15.

Block 1502 of FIG. 15 may involve selecting a first set of symbols associated with respective positions of each of the reels of a reel-based game as a first outcome event of the reel-based game. The first set of symbols may include a first trigger symbol in a first position and a second trigger symbol in a second position.

Block 1504 may involve selecting a second set of symbols associated with respective positions of each of the reels as a second outcome event of the reel-based game. The second set of symbols may include the first trigger symbol in a third position and the second trigger symbol in a fourth position. The third position may be different from the first position, the fourth position may be different from the second position, and the third position and fourth position may be adjacent to one another.

Block 1506 may involve transmitting a representation of the second set of symbols to a client machine. Reception of the representation of the second set of symbols may cause the client machine to display a spin of the reels resulting in the second set of symbols.

Block 1508 may involve, possibly based on the third position and fourth position being adjacent to one another, transforming at least one symbol adjacent to the first trigger symbol or the second trigger symbol into a WILD symbol. The transformation may occur without further spinning of the reels.

Block 1508 may involve transmitting a representation of the second set of symbols as transformed to the client machine. Reception of the representation of the second set of symbols as transformed may cause the client machine to display the transformation of the at least the one symbol adjacent to the first trigger symbol or the second trigger symbol into the WILD symbol.

In some embodiments, the first position and the second position may be non-adjacent to one another.

In some embodiments, the at least one symbol adjacent to the first trigger symbol or the second trigger symbol may include the first trigger symbol and the second trigger symbol.

In some embodiments, the third position may be adjacent to the first position and the fourth position may be adjacent to the second position.

In some embodiments, the first trigger symbol and the second trigger symbol may be visually distinct from one another.

In some embodiments, the first trigger symbol and the second trigger symbol may be WILD symbols.

In some embodiments, transforming the at least one symbol adjacent to the first trigger symbol or the second trigger symbol into the WILD symbol may include determining that the third position and fourth position are vertically adjacent to one another on a particular reel and, based on the third position and fourth position being vertically adjacent to one another on the particular reel, transforming all displayed symbols on the particular reel into WILD symbols.

In some embodiments, the first trigger symbol and the second trigger symbol may be WILD symbols. Transforming all displayed symbols on the particular reel into WILD symbols may include transforming all displayed symbols on the particular reel other than the first trigger symbol and the second trigger symbol into WILD symbols.

In some embodiments, the first trigger symbol may be a WILD symbol having a first visual appearance and the second trigger symbol may be a WILD symbols having a second visual appearance. Transforming all displayed symbols on the particular reel into WILD symbols may include transforming all displayed symbols on the particular reel into WILD symbols having a third visual appearance different from the first visual appearance and the second visual appearance.

In some embodiments, transforming the at least one symbol adjacent to the first trigger symbol or the second trigger symbol into the WILD symbol may include determining that the third position and fourth position are horizontally adjacent to one another on a pair of adjacent reels and, based on the third position and fourth position being horizontally adjacent to one another on the pair of adjacent reels, transforming all displayed symbols on the pair of adjacent reels into WILD symbols.

In some embodiments, the first trigger symbol and the second trigger symbol may be WILD symbols. Transforming all displayed symbols on the pair of adjacent reels into WILD symbols may include transforming all displayed symbols on the pair of adjacent reels other than the first trigger symbol and the second trigger symbol into WILD symbols.

In some embodiments, the first trigger symbol may be a WILD symbol having a first visual appearance and the second trigger symbol may be a WILD symbol having a second visual appearance. Transforming all displayed symbols on the pair of adjacent reels into WILD symbols may include transforming all displayed symbols on the pair of adjacent reels into WILD symbols having a third visual appearance different from the first visual appearance and the second visual appearance.

In some embodiments, transforming the at least one symbol adjacent to the first trigger symbol or the second trigger symbol into the WILD symbol may include determining that the third position and fourth position are diagonally adjacent to one another and, based on the third position and fourth position being diagonally adjacent to one another, transforming a 2×2 grid of displayed symbols into WILD symbols, where the 2×2 grid includes the first trigger symbol and the second trigger symbol.

In some embodiments, the first trigger symbol and the second trigger symbol may be WILD symbols. Transforming the 2×2 grid of displayed symbols into WILD symbols may include transforming all symbols within the 2×2 grid of displayed symbols other than the first trigger symbol and the second trigger symbol into WILD symbols.

In some embodiments, the first trigger symbol may be a WILD symbol having a first visual appearance and the second trigger symbol may be a WILD symbol having a second visual appearance. Transforming the 2×2 grid of displayed symbols into WILD symbols may include transforming all symbols within the 2×2 grid of displayed symbols into WILD symbols having a third visual appearance different from the first visual appearance and the second visual appearance.

In some embodiments, transforming the at least one symbol adjacent to the first trigger symbol or the second trigger symbol into the WILD symbol may include determining that the third position and fourth position are identical and, based on the third position and fourth position being identical, transforming at least one of the first trigger symbol or the second trigger symbol into a WILD symbol.

In some embodiments, the first trigger symbol may be a WILD symbol having a first visual appearance and the second trigger symbol may be a WILD symbols having a second visual appearance. Transforming the at least one of the first trigger symbol or the second trigger symbol into the WILD symbol may include transforming the at least one of the first trigger symbol or the second trigger symbol into a WILD symbol having a third visual appearance different from the first visual appearance and the second visual appearance.

In some embodiments, the first set of symbols and the second set of symbols may be selected as spins of a bonus game of the reel-based game.

In some embodiments, the first set of symbols and the second set of symbols may be selected as spins of a base game of the reel-based game.

In some embodiments, respective symbols may be disposed upon the reels in respective cyclical sequences. Selecting the second set of symbols may include, for each reel, randomly selecting a respective reel position such that a respective subsequence of the symbols thereon is in the second set of symbols.

In some embodiments, selecting the second set of symbols may include simulating spins of the reels.

In some embodiments, simulating spins of the reels may include displaying a first animation of the reels spinning to select the second set of symbols. The first trigger symbol and the second trigger symbol might not spin in the first animation. Simulating spins of the reels may also include, after the first animation of the reels spinning ends, displaying a second animation of the first trigger symbol translating from the first position to the third position and the second trigger symbol translating from the second position to the fourth position.

In some embodiments, the first set of symbols may additionally include a third trigger symbol in a fifth position. The second set of symbols may additionally include the third trigger symbol in a sixth position. The sixth position may be different from the fifth position. Transforming the at least one symbol adjacent to the first trigger symbol or the second trigger symbol into the WILD symbol may include transforming at least one symbol adjacent to at least one of the first trigger symbol, the second trigger symbol, or the third trigger symbol into a WILD symbol based on at least two of the third position, the fourth position, or the sixth position being adjacent to one another.

In some embodiments, the reel-based game may have five reels and each of the five reels may contribute three symbols to the first set of symbols and the second set of symbols.

In some embodiments, the client machine may include the one or more processors.

In some embodiments, displaying the transformation of the at least one symbol adjacent to the first trigger symbol or the second trigger symbol into the WILD symbol may include displaying an animation of the transformation.

In some embodiments, the client machine may include a display device. Each of transmitting the representation of the second set of symbols to the client machine and transmitting the representation of the second set of symbols as transformed to the client machine may cause the client machine to display, by way of the display device, the respective transmitted representation.

In some embodiments, the client machine may include an input mechanism. Selection of the first set of symbols may be triggered by way of the input mechanism.

In some embodiments, it may be determined that the second set of symbols includes a winning combination. In response to determining that the second set of symbols includes the winning combination, a payout amount associated with the second set of symbols may be determined. An indication of the payout amount may be transmitted, by the one or more processors, to the client machine.

In some embodiments, in response to the third position and fourth position being adjacent to one another, an award associated with the third position and fourth position being adjacent to one another may be determined. The award may be at least one of (i) a winnings multiplier, (ii) a number of free spins of the reel-based game, (iii) an additional trigger symbol to be used in subsequent spins of the reel-based game, or (iv) a cash prize. An indication of the award may be transmitted, by the one or more processors, to the client machine.

In a further embodiment that may be a variation of that of FIG. 15, a gaming system may be configured for symbol replacement or transformation in a reel-based game. The reel-based game may be executed on behalf of a client machine, and may involve spinning a plurality of reels to determine outcome events.

The gaming system may include a plurality of gaming devices each including at least one display device and a plurality of input devices including (i) an acceptor of a physical item associated with a monetary value, (ii) a validator configured to identify the physical item, and (iii) a cash-out button actuatable to cause an initiation of a payout associated with a credit account.

The gaming system may also include one or more gaming device processors, and one or more gaming device memory devices. The gaming memory devices may store (i) respective pluralities of symbols for the reels and (ii) a plurality of gaming device instructions executable by the one or more gaming device processors to perform any of the operations depicted in or described with reference to FIG. 15.

In yet another embodiment that may be a variation of that of FIG. 15, an article of manufacture, including a non-transitory computer-readable medium, may have stored thereon program instructions that, upon execution by a gaming machine, cause the gaming machine to perform any of the operations depicted in or described with reference to FIG. 15.

In a yet further embodiment that may be a variation of that of FIG. 15, a gaming machine may be configured to perform any of the operations depicted in or described with reference to FIG. 15.

In an additional embodiment that may be a variation of that of FIG. 15, a system may include means for performing any of the operations depicted in or described with reference to FIG. 15.

In some embodiments, a gaming machine may simultaneously execute instances of the reel-based game in real-time on behalf of at least 30 client machines. Each of the at least 30 client machines may communicate with the gaming machine by way of a wide-area packet-switched network. In some cases, the gaming machine may simultaneously execute instances of the reel-based game in real-time on behalf of more or fewer than 30 client machines. For instance, this simultaneous execution may involve 10, 20, 50, 100, or 1000 client machines, or another extent of client machines.

Particularly, simultaneous execution of such a large number of reel-based games in real time necessitates computer implementation. When taking part in an online game, such as the reel-based games disclosed herein, players expect results of reel spin or symbol replacement operations to be displayed on their respective client machines in an expeditious fashion (e.g., in real time, such as a few seconds at most per either of these operations). Failure to do so may result in players becoming disinterested in the game. Consequently, the embodiments that include this simultaneous execution a large number of reel-based games in real time would not exist but for computer implementation thereof.

V. Additional Example Embodiments

The following clauses are offered as further description of the disclosed embodiments.

(1) A computer-implemented method for symbol replacement in a reel-based game, wherein the reel-based game is executed on behalf of a client machine, and wherein the reel-based game involves spinning reels to determine outcome events, the method comprising:

selecting, by one or more processors, a first set of symbols associated with respective positions of each of the reels as a first outcome event of the reel-based game, wherein the first set of symbols includes a first trigger symbol in a first position and a second trigger symbol in a second position;

selecting, by the one or more processors, a second set of symbols associated with respective positions of each of the reels as a second outcome event of the reel-based game, wherein the second set of symbols includes the first trigger symbol in a third position and the second trigger symbol in a fourth position, wherein the third position is different from the first position, the fourth position is different from the second position, and the third position and fourth position are adjacent to one another;

transmitting, by the one or more processors, a representation of the second set of symbols to the client machine, wherein reception of the representation of the second set of symbols causes the client machine to display a spin of the reels resulting in the second set of symbols;

based on the third position and fourth position being adjacent to one another, transforming, by the one or more processors, at least one symbol adjacent to the first trigger symbol or the second trigger symbol into a wild symbol, wherein the transformation occurs without further spinning of the reels; and transmitting, by the one or more processors, a representation of the second set of symbols as transformed to the client machine, wherein reception of the representation of the second set of symbols as transformed causes the client machine to display the transformation of the at least the one symbol adjacent to the first trigger symbol or the second trigger symbol into the wild symbol.

(2) The computer-implemented method of clause 1, wherein the first position and the second position are non-adjacent to one another.

(3) The computer-implemented method of any of clauses 1-2, wherein the at least one symbol adjacent to the first trigger symbol or the second trigger symbol comprises the first trigger symbol and the second trigger symbol.

(4) The computer-implemented method of any of clauses 1-3, wherein the third position is adjacent to the first position and the fourth position is adjacent to the second position.

(5) The computer-implemented method of any of clauses 1-4, wherein the first trigger symbol and the second trigger symbol are visually distinct from one another.

(6) The computer-implemented method of any of clauses 1-5, wherein the first trigger symbol and the second trigger symbol are wild symbols.

(7) The computer-implemented method of any of clauses 1-5, wherein transforming the at least one symbol adjacent to the first trigger symbol or the second trigger symbol into the wild symbol comprises:

determining that the third position and fourth position are vertically adjacent to one another on a particular reel; and based on the third position and fourth position being vertically adjacent to one another on the particular reel, transforming all displayed symbols on the particular reel into wild symbols.

(8) The computer-implemented method of clause 7, wherein the first trigger symbol and the second trigger symbol are wild symbols, and wherein transforming all displayed symbols on the particular reel into wild symbols comprises:

transforming all displayed symbols on the particular reel other than the first trigger symbol and the second trigger symbol into wild symbols.

(9) The computer-implemented method of clause 7, wherein the first trigger symbol is a wild symbol having a first visual appearance, wherein the second trigger symbol is a wild symbols having a second visual appearance, and wherein transforming all displayed symbols on the particular reel into wild symbols comprises:

transforming all displayed symbols on the particular reel into wild symbols having a third visual appearance different from the first visual appearance and the second visual appearance.

(10) The computer-implemented method of any of clauses 1-5, wherein transforming the at least one symbol adjacent to the first trigger symbol or the second trigger symbol into the wild symbol comprises:

determining that the third position and fourth position are horizontally adjacent to one another on a pair of adjacent reels; and based on the third position and fourth position being horizontally adjacent to one another on the pair of adjacent reels, transforming all displayed symbols on the pair of adjacent reels into wild symbols.

(11) The computer-implemented method of clause 10, wherein the first trigger symbol and the second trigger symbol are wild symbols, and wherein transforming all displayed symbols on the pair of adjacent reels into wild symbols comprises:

transforming all displayed symbols on the pair of adjacent reels other than the first trigger symbol and the second trigger symbol into wild symbols.

(12) The computer-implemented method of clause 10, wherein the first trigger symbol is a wild symbol having a first visual appearance, wherein the second trigger symbol is a wild symbol having a second visual appearance, and wherein transforming all displayed symbols on the pair of adjacent reels into wild symbols comprises:

transforming all displayed symbols on the pair of adjacent reels into wild symbols having a third visual appearance different from the first visual appearance and the second visual appearance.

(13) The computer-implemented method of any of clauses 1-5, wherein transforming the at least one symbol adjacent to the first trigger symbol or the second trigger symbol into the wild symbol comprises:

determining that the third position and fourth position are diagonally adjacent to one another; and based on the third position and fourth position being diagonally adjacent to one another, transforming a 2×2 grid of displayed symbols into wild symbols, wherein the 2×2 grid includes the first trigger symbol and the second trigger symbol.

(14) The computer-implemented method of clause 13, wherein the first trigger symbol and the second trigger symbol are wild symbols, and wherein transforming the 2×2 grid of displayed symbols into wild symbols comprises:

transforming all symbols within the 2×2 grid of displayed symbols other than the first trigger symbol and the second trigger symbol into wild symbols.

(15) The computer-implemented method of clause 13, wherein the first trigger symbol is a wild symbol having a first visual appearance, wherein the second trigger symbol is a wild symbol having a second visual appearance, and wherein transforming the 2×2 grid of displayed symbols into wild symbols comprises:

transforming all symbols within the 2×2 grid of displayed symbols into wild symbols having a third visual appearance different from the first visual appearance and the second visual appearance.

(16) The computer-implemented method of any of clauses 1-5, wherein transforming the at least one symbol adjacent to the first trigger symbol or the second trigger symbol into the wild symbol comprises:

determining that the third position and fourth position are identical; and based on the third position and fourth position being identical, transforming at least one of the first trigger symbol or the second trigger symbol into a wild symbol.

(17) The computer-implemented method of clause 16, wherein the first trigger symbol is a wild symbol having a first visual appearance, wherein the second trigger symbol is a wild symbols having a second visual appearance, and wherein transforming the at least one of the first trigger symbol or the second trigger symbol into the wild symbol comprises:

transforming the at least one of the first trigger symbol or the second trigger symbol into a wild symbol having a third visual appearance different from the first visual appearance and the second visual appearance.

(18) The computer-implemented method of any of clauses 1-17, wherein the first set of symbols and the second set of symbols are selected as spins of a bonus game of the reel-based game.

(19) The computer-implemented method of any of clauses 1-17, wherein the first set of symbols and the second set of symbols are selected as spins of a base game of the reel-based game.

(20) The computer-implemented method of any of clauses 1-19, wherein respective symbols are disposed upon the reels in respective cyclical sequences, and wherein selecting the second set of symbols comprises:

for each reel, randomly selecting a respective reel position such that a respective subsequence of the symbols thereon is in the second set of symbols.

(21) The computer-implemented method of any of clauses 1-20, wherein selecting the second set of symbols comprises simulating spins of the reels.

(22) The computer-implemented method of clause 21, wherein simulating spins of the reels comprises:

displaying a first animation of the reels spinning to select the second set of symbols, wherein the first trigger symbol and the second trigger symbol do not spin in the first animation; and after the first animation of the reels spinning ends, displaying a second animation of the first trigger symbol translating from the first position to the third position and the second trigger symbol translating from the second position to the fourth position.

(23) The computer-implemented method of any of clauses 1-22, wherein the first set of symbols additionally includes a third trigger symbol in a fifth position, wherein the second set of symbols additionally includes the third trigger symbol in a sixth position, wherein the sixth position is different from the fifth position, and wherein transforming the at least one symbol adjacent to the first trigger symbol or the second trigger symbol into the wild symbol comprises:

transforming at least one symbol adjacent to at least one of the first trigger symbol, the second trigger symbol, or the third trigger symbol into a wild symbol based on at least two of the third position, the fourth position, or the sixth position being adjacent to one another.

(24) The computer-implemented method of any of clauses 1-23, wherein the reel-based game has five reels and each of the five reels contributes three symbols to the first set of symbols and the second set of symbols.

(25) The computer-implemented method of any of clauses 1-24, wherein the client machine comprises the one or more processors.

(26) The computer-implemented method of any of clauses 1-25, wherein displaying the transformation of the at least one symbol adjacent to the first trigger symbol or the second trigger symbol into the wild symbol comprises displaying an animation of the transformation.

(27) The computer-implemented method of any of clauses 1-26, wherein the client machine includes a display device, wherein each of transmitting the representation of the second set of symbols to the client machine and transmitting the representation of the second set of symbols as transformed to the client machine causes the client machine to display, by way of the display device, the respective transmitted representation.

(28) The computer-implemented method of any of clauses 1-27, wherein the client machine includes an input mechanism, wherein selection of the first set of symbols is triggered by way of the input mechanism.

(29) The computer-implemented method of any of clauses 1-28, wherein a gaming machine simultaneously executes instances of the reel-based game in real-time on behalf of at least 30 client machines, and wherein each of the at least 30 client machines communicates with the gaming machine by way of a wide-area packet-switched network.

(30) The computer-implemented method of any of clauses 1-29, further comprising:

determining that the second set of symbols includes a winning combination;

in response to determining that the second set of symbols includes the winning combination, determining a payout amount associated with the second set of symbols; and transmitting, by the one or more processors, an indication of the payout amount to the client machine.

(31) The computer-implemented method of any of clauses 1-30, further comprising:

in response to the third position and fourth position being adjacent to one another, determining an award associated with the third position and fourth position being adjacent to one another, wherein the award is at least one of (i) a winnings multiplier, (ii) a number of free spins of the reel-based game, (iii) an additional trigger symbol to be used in subsequent spins of the reel-based game, or (iv) a cash prize; and transmitting, by the one or more processors, an indication of the award to the client machine.

(32) An article of manufacture including a non-transitory computer-readable medium, having stored thereon program instructions that, upon execution by a gaming machine, cause the gaming machine to perform the operations of any of clauses 1-31.

(33) A gaming system configured for symbol replacement in a reel-based game, wherein the reel-based game is executed on behalf of a client machine, wherein the reel-based game involves spinning reels to determine outcome events, the gaming system comprising:

a plurality of gaming devices each including at least one display device and a plurality of input devices including (i) an acceptor of a physical item associated with a monetary value, (ii) a validator configured to identify the physical item, and (iii) a cash-out button actuatable to cause an initiation of a payout associated with a credit account;

one or more gaming device processors; and one or more gaming device memory devices storing (i) respective pluralities of symbols for the reels and (ii) a plurality of gaming device instructions executable by the one or more gaming device processors to perform the operations of any of clauses 1-31.

(34) A gaming machine configured to perform the operations of any of clauses 1-31.

(35) A system comprising means for performing the operations of any of clauses 1-31.

VI. Conclusion

While one or more disclosed operations have been described as being performed by certain entities (e.g., machine 100, server machine 100*a*, or client machine 100*b*), one or more of the operations may be performed by any entity, including but not limited to those described herein. As such, while this disclosure includes examples in which the server machine 100*a* performs select operations and sends data to the client machine 100*b*, such that the client machine 100*b* may perform complementing operations and receive the data, variations may to those operations may be made while adhering to the general server-client dichotomy and the scope of the disclosed machines and methods.

For example, rather than the server machine 100*a* sending select data (e.g., a symbol set) to the client machine 100*b*, such that the client machine may generate and display appropriate images, the server machine 100*a* may itself generate the images and send them to the client machine 100*b* for display. Indeed, it will be appreciated by one of ordinary skill in the art that the "break point" between the server machine's operations and the client machine's operations may be varied.

Further, the described operations throughout this application need not be performed in the disclosed order, although in some examples, the recited order may be preferred. Also, not all operations need to be performed to achieve the desired advantages of disclosed machines and methods, and therefore not all operations are required.

Additionally, any enumeration of elements, blocks, or steps in this specification or the claims is for purposes of clarity. Thus, such enumeration should not be interpreted to require or imply that these elements, blocks, or steps adhere to a particular arrangement or are carried out in a particular order.

While examples have been described in terms of select embodiments, alterations and permutations of these embodiments will be apparent to those of ordinary skill in the art. Other changes, substitutions, and alterations are also possible without departing from the disclosed machines and methods in their broader aspects as set forth in the following claims.

What is claimed is:

1. A computer-implemented method involving a software application executed by a server machine on behalf of a client machine with a graphical display unit, wherein a memory of the server machine stores, for each reel of a plurality of reels, a respective plurality of symbols displayable by the graphical display unit, the computer-implemented method comprising:

selecting, by one or more processors of the server machine, a first set of symbols associated with respective positions of each of the reels as a first outcome event of the software application, wherein the first set of symbols includes a first trigger symbol in a first position and a second trigger symbol in a second position, wherein the first position and the second position are non-adjacent to one another;

selecting, by the one or more processors, a second set of symbols associated with respective positions of each of the reels as a second outcome event of the software application, wherein the second set of symbols includes the first trigger symbol in a third position and the second trigger symbol in a fourth position, wherein the third position is different from the first position, the fourth position is different from the second position, and the third position and fourth position are directly adjacent to one another;

transmitting, by the one or more processors, a representation of the second set of symbols to the client machine, wherein reception of the representation of the second set of symbols causes the graphical display unit of the client machine to display an animation that simulates a spin of the reels resulting in the graphical display unit displaying the second set of symbols;

determining, by the one or more processors, a representation of a third set of symbols, wherein the representation of the third set of symbols is identical to the representation of the second set of symbols except that at least one symbol directly adjacent to the first trigger symbol or the second trigger symbol is a wild symbol; and transmitting, by the one or more processors, the representation of the third set of symbols to the client machine, wherein reception of the representation of the third set of symbols causes the graphical display unit of the client machine to display an animated transformation of the second set of symbols into the third set of symbols without further spinning of the reels.

2. The computer-implemented method of claim 1, wherein the representation of the third set of symbols is determined in response to the third position and fourth position being directly adjacent to one another in the second set of symbols.

3. The computer-implemented method of claim 1, wherein, when the third position and the fourth position are vertically adjacent to one another on a particular reel, the at least one symbol being a wild symbol comprises all displayed symbols on the particular reel being wild symbols.

4. The computer-implemented method of claim 3, wherein the first trigger symbol and the second trigger symbol are wild symbols, and wherein, when the third position and the fourth position are vertically adjacent to one another on the particular reel, displaying the animated transformation of the second set of symbols into the third set of symbols without further spinning of the reels comprises:

transforming all displayed symbols on the particular reel other than the first trigger symbol and the second trigger symbol into wild symbols.

5. The computer-implemented method of claim 3, wherein the first trigger symbol is a wild symbol having a first visual appearance, wherein the second trigger symbol is a wild symbols having a second visual appearance, and wherein, when the third position and the fourth position are vertically adjacent to one another on the particular reel, displaying the animated transformation of the second set of symbols into the third set of symbols without further spinning of the reels comprises:

transforming all displayed symbols on the particular reel into wild symbols having a third visual appearance different from the first visual appearance and the second visual appearance.

6. The computer-implemented method of claim 1, wherein, when the third position and the fourth position are horizontally adjacent to one another on a pair of directly adjacent reels, the at least one symbol being a wild symbol comprises all displayed symbols on the pair of directly adjacent reels being wild symbols.

7. The computer-implemented method of claim 6, wherein the first trigger symbol and the second trigger symbol are wild symbols, and wherein, when the third position and the fourth position are horizontally adjacent to one another on the pair of directly adjacent reels, displaying the animated transformation of the second set of symbols into the third set of symbols without further spinning of the reels comprises:

transforming all displayed symbols on the pair of directly adjacent reels other than the first trigger symbol and the second trigger symbol into wild symbols.

8. The computer-implemented method of claim 6, wherein the first trigger symbol is a wild symbol having a first visual appearance, wherein the second trigger symbol is a wild symbol having a second visual appearance, and wherein, when the third position and the fourth position are horizontally adjacent to one another on the pair of directly adjacent reels, displaying the animated transformation of the second set of symbols into the third set of symbols without further spinning of the reels comprises:

transforming all displayed symbols on the pair of directly adjacent reels into wild symbols having a third visual appearance different from the first visual appearance and the second visual appearance.

9. The computer-implemented method of claim 1, wherein, when the third position and the fourth position are diagonally adjacent to one another, the at least one symbol being a wild symbol comprises a 2×2 grid of displayed symbols being wild symbols, wherein the 2×2 grid includes the first trigger symbol and the second trigger symbol.

10. The computer-implemented method of claim 9, wherein the first trigger symbol and the second trigger symbol are wild symbols, and wherein, when the third position and the fourth position are diagonally adjacent to one another, displaying the animated transformation of the second set of symbols into the third set of symbols without further spinning of the reels comprises:

transforming all symbols within the 2×2 grid of displayed symbols other than the first trigger symbol and the second trigger symbol into wild symbols.

11. The computer-implemented method of claim 9, wherein the first trigger symbol is a wild symbol having a first visual appearance, wherein the second trigger symbol is a wild symbol having a second visual appearance, and wherein displaying the animated transformation of the second set of symbols into the third set of symbols without further spinning of the reels comprises:

transforming all symbols within the 2×2 grid of displayed symbols into wild symbols having a third visual appearance different from the first visual appearance and the second visual appearance.

12. The computer-implemented method of claim 1, wherein the third position and fourth position being directly adjacent to one another comprises the third position and the fourth position being identical, and wherein, when the third position and the fourth position are identical, the at least one symbol being a wild symbol comprises two or more of (i) a symbol displayed directly below the fourth position being a wild symbol, (ii) a symbol displayed directly above the fourth position being a wild symbol, (iii) a symbol displayed directly left of the fourth position being a wild symbol, or (iv) a symbol displayed directly right of the fourth position being a wild symbol.

13. The computer-implemented method of claim 1, wherein (i) the third position is directly adjacent to the first position and (ii) the fourth position is directly adjacent to the second position.

14. The computer-implemented method of claim 1, wherein the first trigger symbol and the second trigger symbol are visually distinct from one another.

15. The computer-implemented method of claim 1, wherein the first trigger symbol and the second trigger symbol are wild symbols.

16. The computer-implemented method of claim 1, wherein the first set of symbols and the second set of symbols are selected as spins of a bonus game of the software application or (ii) a base game of the software application.

17. The computer-implemented method of claim 1, wherein displaying the animation that simulates the spin of the reels resulting in the graphical display unit displaying the second set of symbols comprises:

displaying a first animation of the reels spinning to select the second set of symbols, wherein the first trigger symbol and the second trigger symbol do not spin in the first animation; and after the first animation ends, displaying a second animation of the first trigger symbol translating from the first position to the third position and the second trigger symbol translating from the second position to the fourth position.

18. The computer-implemented method of claim 1, wherein the at least one symbol is located at a fifth position different from the third position and the fourth position, and wherein the at least one symbol is selected from a plurality of predetermined transformation patterns based on a relative positional arrangement between the first trigger symbol and the second trigger symbol when the third position and the fourth position are directly adjacent to one another as part of the second set of symbols.

19. A non-transitory computer-readable medium having stored thereon program instructions that define a software application, wherein the software application is executed by a server machine on behalf of a client machine with a graphical display unit, wherein a memory of the server machine stores, for each reel of a plurality of reels, a respective plurality of symbols, and wherein, upon execution by the server machine, the program instructions cause the server machine to perform operations comprising:

selecting a first set of symbols associated with respective positions of each of the reels as a first outcome event of the software application, wherein the first set of symbols includes a first trigger symbol in a first position and a second trigger symbol in a second position, wherein the first position and the second position are non-adjacent to one another;

selecting a second set of symbols associated with respective positions of each of the reels as a second outcome event of the software application, wherein the second set of symbols includes the first trigger symbol in a third position and the second trigger symbol in a fourth position, wherein the third position is different from the first position, the fourth position is different from the second position, and the third position and fourth position are directly adjacent to one another;

transmitting a representation of the second set of symbols to the client machine, wherein reception of the representation of the second set of symbols causes the graphical display unit of the client machine to display an animation that simulates a spin of the reels resulting in the display unit displaying the second set of symbols;

determining a representation of a third set of symbols, wherein the representation of the third set of symbols is identical to the representation of the second set of symbols except that at least one symbol directly adjacent to the first trigger symbol or the second trigger symbol is a wild symbol; and transmitting the representation of the third set of symbols to the client machine, wherein reception of the representation of the third set of symbols causes the graphical display unit of the client machine to display an animated transformation of the second set of symbols into the third set of symbols without further spinning of the reels.

20. A system comprising:

a processor; and memory containing program instructions executable by the processor to perform operations comprising:

selecting a first set of symbols from a plurality of symbols associated with respective positions of each of a plurality of reels as a first outcome event, wherein the first set of symbols includes a first trigger symbol in a first position and a second trigger symbol in a second position, wherein the first position and the second position are non-adjacent to one another;

selecting a second set of symbols from the plurality of symbols associated with respective positions of each of the reels as a second outcome event, wherein the second set of symbols includes the first trigger symbol in a third position and the second trigger symbol in a fourth position, wherein the third position is different from the first position, the fourth position is different from the second position, and the third position and fourth position are directly adjacent to one another;

providing a representation of the second set of symbols, wherein reception of the representation of the second set of symbols causes display of an animation that simulates a spin of the reels resulting in display of the second set of symbols;

determining a representation of a third set of symbols, wherein the representation of the third set of symbols is identical to the representation of the second set of symbols except that at least one symbol directly adjacent to the first trigger symbol or the second trigger symbol is a wild symbol; and providing the representation of the third set of symbols, wherein reception of the representation of the third set of symbols causes display of an animated transformation of the second set of symbols into the third set of symbols without further spinning of the reels.

* * * * *